US009418667B2

(12) United States Patent
Oh et al.

(10) Patent No.: US 9,418,667 B2
(45) Date of Patent: Aug. 16, 2016

(54) APPARATUS FOR PROCESSING A MIX SIGNAL AND METHOD THEREOF

(75) Inventors: Hyen O Oh, Seoul (KR); Yang-Won Jung, Seoul (KR)

(73) Assignee: LG Electronics Inc., Seoul (KR)

( * ) Notice: Subject to any disclaimer, the term of this patent is extended or adjusted under 35 U.S.C. 154(b) by 940 days.

(21) Appl. No.: 12/445,046

(22) PCT Filed: Oct. 12, 2007

(86) PCT No.: PCT/KR2007/005014

§ 371 (c)(1),
(2), (4) Date: Dec. 23, 2009

(87) PCT Pub. No.: WO2008/044901

PCT Pub. Date: Apr. 17, 2008

(65) Prior Publication Data

US 2010/0092008 A1 Apr. 15, 2010

Related U.S. Application Data

(60) Provisional application No. 60/829,230, filed on Oct. 12, 2006, provisional application No. 60/829,233, filed on Oct. 12, 2006, provisional application No. 60/829,350, filed on Oct. 13, 2006, provisional (Continued)

(51) Int. Cl.
*G10L 19/008* (2013.01)

(52) U.S. Cl.
CPC ..... *G10L 19/008* (2013.01)

(58) Field of Classification Search
CPC ... G10L 19/008; G10L 19/00; H04S 2420/03; H04S 2400/01
USPC ..... 381/19–23
See application file for complete search history.

(56) References Cited

U.S. PATENT DOCUMENTS 5,454,723 A 10/1995 Horii
5,974,380 A 10/1999 Smyth et al.

(Continued)

FOREIGN PATENT DOCUMENTS

CN 1487746 4/2004
CN 1783728 6/2006

(Continued)

OTHER PUBLICATIONS

Baumgarte, F. et al., "Binaural cue coding-part I: psychoacoustic fundamentals and design principles" IEEE Transactions on Speech and Audio Processing, IEEE Service Center, New York, NY, US, Nov. 1, 2003, vol. 11, No. 6, pp. 509-519.

(Continued)

*Primary Examiner* — Ping Lee
(74) *Attorney, Agent, or Firm* — Fish & Richardson P.C.

(57) ABSTRACT

A method and apparatus for processing a signal, and more particularly, to an apparatus for processing a mix signal and method thereof are disclosed, by which a mix signal such as an audio signal and a video signal can be encoded/decoded. The present invention includes receiving at least one of a mix signal and source signals and generating a unified side information corresponding to a unified source signal using the mix signal and the at least one of the source signals, wherein the unified source signal is generated by grouping at least one source signal.

8 Claims, 48 Drawing Sheets

Related U.S. Application Data application No. 60/865,908, filed on Nov. 15, 2006, provisional application No. 60/868,304, filed on Dec. 1, 2006, provisional application No. 60/868,308, filed on Dec. 1, 2006, provisional application No. 60/889,715, filed on Feb. 13, 2007.

(56) References Cited

U.S. PATENT DOCUMENTS

| | | | | |
|---|---|---|---|---|
| 6,026,168 | A | 2/2000 | Li et al. | |
| 6,122,619 | A | 9/2000 | Kolluru et al. | |
| 6,128,597 | A | 10/2000 | Kolluru et al. | |
| 6,141,446 | A | 10/2000 | Boliek et al. | |
| 6,496,584 | B2 | 12/2002 | Irwan et al. | |
| 6,546,299 | B1 | 4/2003 | Bradley | |
| 6,584,077 | B1 | 6/2003 | Polomski | |
| 6,888,999 | B2 | 5/2005 | Herberger et al. | |
| 6,952,677 | B1 | 10/2005 | Absar et al. | |
| 7,103,187 | B1 | 9/2006 | Neuman | |
| 7,590,249 | B2 * | 9/2009 | Jang et al. | 381/61 |
| 7,672,744 | B2 * | 3/2010 | Oh et al. | 700/94 |
| 2002/0157883 | A1 | 10/2002 | Ogata et al. | |
| 2003/0231600 | A1 | 12/2003 | Polomski | |
| 2003/0236583 | A1 | 12/2003 | Baumgarte et al. | |
| 2005/0089181 | A1 | 4/2005 | Polk, Jr. | |
| 2005/0117759 | A1 | 6/2005 | Wu | |
| 2005/0157883 | A1 | 7/2005 | Herre et al. | |
| 2005/0195981 | A1 | 9/2005 | Faller et al. | |
| 2006/0009225 | A1 | 1/2006 | Herre et al. | |
| 2006/0085200 | A1 | 4/2006 | Allamanche et al. | |
| 2006/0115100 | A1 | 6/2006 | Faller | |
| 2006/0133618 | A1 | 6/2006 | Villemoes et al. | |
| 2007/0083365 | A1 | 4/2007 | Shmunk | |
| 2008/0002842 | A1 | 1/2008 | Neusinger et al. | |
| 2008/0008327 | A1 * | 1/2008 | Ojala et al. | 381/20 |
| 2009/0144063 | A1 * | 6/2009 | Beack et al. | 704/500 |
| 2011/0022402 | A1 * | 1/2011 | Engdegard et al. | 704/501 |
| 2011/0058679 | A1 | 3/2011 | Van Loon et al. | |

FOREIGN PATENT DOCUMENTS

| | | |
|---|---|---|
| EP | 00798866 | 10/1997 |
| EP | 1565036 | 8/2005 |
| EP | 1640972 | 3/2006 |
| EP | 1691348 | 8/2006 |
| EP | 1 853 093 | 11/2007 |
| EP | 1853092 | 11/2007 |
| EP | 1784819 | 4/2008 |
| JP | 08-65169 | 3/1996 |
| JP | 11-352962 | 12/1999 |
| JP | 2001-249664 | 9/2001 |
| JP | 2002-051399 | 2/2002 |
| JP | 2002-058100 | 2/2002 |
| JP | 2002-125010 | 4/2002 |
| JP | 2002-372970 | 12/2002 |
| JP | 16-080735 | 3/2004 |
| JP | 2004-078183 | 3/2004 |
| JP | 2004-170610 | 6/2004 |
| JP | 2004-535145 | 11/2004 |
| JP | 2005-523480 | 8/2005 |
| JP | 2005-523624 | 8/2005 |
| JP | 2005-533426 | 11/2005 |
| JP | 2006-323408 | 11/2006 |
| JP | 2008-511848 | 4/2008 |
| JP | 2008-512708 | 4/2008 |
| KR | 10-2000-0053152 | 8/2000 |
| KR | 10-2006-0049941 | 5/2006 |
| KR | 10-2006-0049980 | 5/2006 |
| KR | 10-2006-0060927 | 6/2006 |
| KR | 10-2007-0107698 | 11/2007 |
| RU | 2129336 | 4/1999 |
| RU | 2185024 | 7/2002 |
| WO | 92/12607 | 7/1992 |
| WO | 98/58450 | 12/1998 |
| WO | 03-090207 | 10/2003 |
| WO | 03/090208 | 10/2003 |
| WO | 2004/097794 | 11/2004 |
| WO | 2005/029467 | 3/2005 |
| WO | 2005-086139 | 9/2005 |
| WO | 2006/002748 | 1/2006 |
| WO | 2006/008683 | 1/2006 |
| WO | 2006/027079 | 3/2006 |
| WO | 2006/027138 | 3/2006 |
| WO | WO 2006/048226 | 5/2006 |
| WO | 2006/060278 | 6/2006 |
| WO | WO 2006/072270 | 7/2006 |
| WO | 2006/084916 | 8/2006 |
| WO | WO 2006/084916 | 8/2006 |
| WO | 2006/132857 | 12/2006 |
| WO | 2007/013775 | 2/2007 |
| WO | WO 2007/073818 | 7/2007 |
| WO | WO 2007/080212 | 7/2007 |

OTHER PUBLICATIONS

Office Action, Japanese Appln. No. 2009-508223, dated Nov. 22, 2010, 7 pages with English translation, 2008-508223.

Search Report, European Appln. No. 10012979, dated Jan. 12, 2011, 5 pages.

Search Report, European Appln. No. 10012980, dated Jan. 14, 2011, 5 pages.

Breebaart, J., et al., "MPEG Spatial Audio Coding/MPEG Surround: Overview and Current Status", Audio Engineering Society Convention Paper 6599, Oct. 2005, New York, New York, 17 pages.

De Smet, P., et al., "Subband Based MPEG Audio Mixing for Internet Streaming Applications", IEEE, Belgium, 4 pages.

Faller, C., "Coding of Spatial Audio Compatible with Different Playback Formats", Audio Engineering Society Convention Paper, Oct. 2004, San Francisco, CA, 12 pages.

Faller, C., "Parametric Coding of Spatial Audio", Doctoral Thesis No. 3062, 2004, 180 pages.

Kim, J., "Lossless Wideband Audio Compression: Prediction and Transform", Dissertation, 196 pages.

Liebchen, T., et al., "Improved Forward-Adaptive Prediction for MPEG-4 Audio Lossless Coding", AES 118$^{th}$ Convention Paper, May 10, 2005, Barcelona, Spain, 10 pages.

Liebchen, T., et al., The MPEG-4 Audio Lossless Coding (ALS) Standard-Technology and Applications, AES Convention Paper, Oct. 2005, New York, New York, 14 pages.

Vera-Candeas, P., et al., "A New Sinusoidal Modelling Approach for Parametric Speech and Audio Coding", Proceedings of the 3$^{rd}$ International Symposium on Image and Signal Processing and Analysis, 2003, 6 pages.

Russian Patent Application, Serial No. 2008147719 dated Aug. 5, 2010 , 13 pages.

European Search Report & Written Opinion for Application No. EP 07833119.6, dated Aug. 20, 2009, 6 pages.

European Search Report & Written Opinion for Application No. EP 07833324.2, dated Sep. 10, 2009, 6 pages.

Office Action from CN 200780038150.X dated Jun. 28, 2010, 15 pages (English language translation included).

Office Action, Korean Appln. No. 10-2010-7027943, dated Mar. 3, 2011, 11 pages with English translation.

Baumgarte and Faller, "Binaural Cue Coding—Part I: Psychoacoustic Fundamentals and Design Principles" IEEE Transactions on Speech and Audio Processing, vol. 11, No. 6, Nov. 2003, pp. 509-519.

Faller and Baumgarte, "Binaural Cue Coding—Part II: Schemes and Applications," IEEE Transactions on Speech and Audio Processing, IEEE Service Center, Oct. 6, 2003, vol. 11, No. 6, pp. 520-531.

Faller, "Parametric Multichannel Audio Coding: Synthesis of Coherence Cues," IEEE Transactions on Audio, Speech and Language Processing, vol. 14, No. 1, Jan. 2006, pp. 299-310.

Search Report, European Appln. No. 06113521.6, mailed Sep. 15, 2006, 4 pages.

Office Action, U.S. Appl. No. 11/744,156, dated Jun. 28, 2011, 18 pages.

(56) References Cited

OTHER PUBLICATIONS

Faller and Baumgarten "Binaural Cue Coding Applied to Audio Compression with Flexible Rendering," AES 112$^{th}$ Convention Paper 5686, Oct. 5-8, 2002, Los Angeles, CA, 10 pages.
Faller, "Parametric Joint-Coding of Audio Sources," AES 120$^{th}$ Convention Paper 6752, May 20-23, 2006, Paris, France, 12 pages.
Office Action, European Appln. No. 07009077.4, dated Jun. 13, 2012, 26 pages with English translation.
USPTO Non-Final Office Action in U.S. Appl. No. 12/443,466, mailed Aug. 1, 2013, 13 pages.
U.S. Office Action in U.S. Appl. No. 12/443,466, dated Feb. 28, 2014, 16 pages.

* cited by examiner

APPARATUS FOR PROCESSING A MIX SIGNAL AND METHOD THEREOF

TECHNICAL FIELD

The present invention relates to a method and apparatus for processing a signal, and more particularly, to an apparatus for processing a mix signal and method thereof. Although the present invention is suitable for a wide scope of applications, it is particularly suitable for encoding or decoding a mix signal such as an audio signal and a video signal.

BACKGROUND ART

Generally, stereo signals are generated and used most frequently and widely by consumers. Recently, multi-channel signals tend to be popularly used. Yet, limitation is put on mix signals which are processed not by a source signal unit but by a channel signal unit. So, in case of processing a mix signal by a channel signal unit, it is unable to independently process a specific source signal configuring the mix signal. For instance, it is impossible to raise a volume of background music only while a volume for actors' voices is maintained uniform in viewing a movie.

Meanwhile, in case of a stereo channel, if such effect as reverberation is added to a signal of a prescribed source, attributes for each channel (left and right channels) are added to a signal of a single source. In other words, although a left signal of a specific source having reverberation effect added thereto and a right signal of a specific source having reverberation effect added thereto correspond to a single source, they are treated as two independent source signals instead of being treated as a single source signal.

However, in remixing a mix signal per a source signal, side information and control information need to be processed per the source signal, all side information (and control information) for each source signal should be processed.

In the related art, since a mix signal and side information are multiplexed to be transmitted, it is unable to extract the mix signal and the side information independently.

In case that a mix signal and side information differ from each other in domain, a method for matching the domain has not been proposed.

In case that side information is intactly transmitted, a size of information is considerably increased.

DISCLOSURE OF THE INVENTION

Technical Problem

Accordingly, the present invention is directed to an apparatus for processing a mix signal and method thereof that substantially obviate one or more of the problems due to limitations and disadvantages of the related art.

An object of the present invention is to provide an apparatus for processing a mix signal and method thereof, by which source signals associated with each other in remixing a mix signal per a source signal are grouped to facilitate a user to control the associated source signals.

Another object of the present invention is to provide an apparatus for processing a signal and method thereof, by which a user is able to transmit a mix signal and side information independently.

Another object of the present invention is to provide an apparatus for processing a signal and method thereof, by which a remix signal is generated in a manner of extracting a mix signal and side information independently.

Another object of the present invention is to provide an apparatus for processing a signal and method thereof, by which side information is modified suitable for a new mix signal.

Another object of the present invention is to provide an apparatus for processing a signal and method thereof, by which, by which a mix signal and side information can be transformed into the same domain.

Another object of the present invention is to provide an apparatus for processing a signal and method thereof, by which a remix signal is generated using a mix signal and side information having the same domain.

Another object of the present invention is to provide an apparatus for processing a signal and method thereof, by which a remix signal is generated in a manner of matching a domain of a mix signal to a domain of side information if the domains differ from each other.

Another object of the present invention is to provide an apparatus for encoding and method thereof, by which side information is modified to have a small information size.

A further object of the present invention is to provide an apparatus for processing a mix signal and method thereof, by which a mix signal is controllable by a source signal unit using modified side information.

Additional features and advantages of the invention will be set forth in the description which follows, and in part will be apparent from the description, or may be learned by practice of the invention. The objectives and other advantages of the invention will be realized and attained by the structure particularly pointed out in the written description and claims thereof as well as the appended drawings.

Technical Solution

To achieve these and other advantages and in accordance with the purpose of the present invention, as embodied and broadly described, a signal processing method according to the present invention includes receiving at least one of a mix signal and source signals and generating a unified side information corresponding to a unified source signal using the mix signal and the at least one of the source signals, wherein the unified source signal is generated from grouping at least one source signal.

To further achieve these and other advantages and in accordance with the purpose of the present invention, a signal processing apparatus according to the present invention includes a receiving unit receiving at least one of a mix signal and source signals and a unified side information generating unit generating a unified side information corresponding to a unified source signal using the mix signal and the at least one of the source signals, wherein the unified source signal is generated from grouping at least one source signal.

To further achieve these and other advantages and in accordance with the purpose of the present invention, a signal processing method according to the present invention includes receiving at least one of a mix signal and source signals, receiving a side information of the mix signal and side informations of the source signals, and generating a unified side information corresponding to a unified source signal using the received side informations, wherein the unified source signal is generated from grouping at least one source signal.

To further achieve these and other advantages and in accordance with the purpose of the present invention, signal processing apparatus according to the present invention includes a receiving unit receiving at least one of a mix signal and source signals, the receiving unit receiving a side information of the mix signal and side informations of the source signals and a unified side information generating unit generating a unified side information corresponding to a unified source signal using the received side informations, wherein the unified source signal is generated from grouping at least one source signal.

To further achieve these and other advantages and in accordance with the purpose of the present invention, a signal processing method according to the present invention includes receiving at least one of a mix signal and source signals, receiving a unified control information, and decoding at least one of the mix signal and a synthetic signal using at least one of the mix signal, the source signals and the unified control information, wherein the unified source signal is generated from grouping at least one source signal.

To further achieve these and other advantages and in accordance with the purpose of the present invention, a signal processing apparatus according to the present invention includes a receiving unit receiving at least one of a mix signal and source signals and a remixing unit receiving a unified control information, the remixing unit decoding at least one of the mix signal and a synthetic signal using at least one of the mix signal, the source signals and the unified control information, wherein the unified source signal is generated from grouping at least one source signal.

To further achieve these and other advantages and in accordance with the purpose of the present invention, a signal processing method according to the present invention includes obtaining a first mix signal or a side information from a multiplexed first mix signal and side information, obtaining a user-mix parameter, and generating a remix signal using the first mix signal or the side information and the user-mix parameter, wherein the first mix signal comprises at least one source signal and wherein the side information indicates a relation between a source signal to be remixed and the first mix signal.

To further achieve these and other advantages and in accordance with the purpose of the present invention, a signal processing method according to the present invention includes obtaining a mix signal including at least one source signal, obtaining a side information indicating a relation between a source signal to be remixed among the source signals and the mix signal, and multiplexing the mix signal and the side information together.

To further achieve these and other advantages and in accordance with the purpose of the present invention, a signal processing method according to the present invention includes extracting a first identification information from a mix signal and obtaining a second identification information from a side information and if the first identification information and the second identification information are matched to each other, generating a remix signal using the side information and the mix signal, wherein the side information indicates relation between source signals and the mix signal.

To further achieve these and other advantages and in accordance with the purpose of the present invention, a signal processing apparatus according to the present invention includes a core decoding unit extracting a first identification information from a mix signal including at least one source signal, a side information decoding unit extracting a second identification information from a side information, an identification information reading unit generating a control signal by deciding whether the first identification information and the second identification information are matched to each other, and a remix rendering unit generating a remix signal using the side information, the mix signal and a control information obtained from a user in accordance with the control signal.

To further achieve these and other advantages and in accordance with the purpose of the present invention, a signal processing apparatus according to the present invention includes a mix signal storing unit storing a first mix signal obtained from a multiplexed first mix signal and side information, a side information storing unit storing a side information obtained from the multiplexed first mix signal and side information, and a remix rendering unit generating a remix signal using the first mix signal or the side information and a control information obtained from a user.

To further achieve these and other advantages and in accordance with the purpose of the present invention, signal processing method according to the present invention includes obtaining a mix signal including at least one source signal, obtaining a side information, obtaining a user-mix parameter, and if domains of the mix signal and the side information are matched to each other, generating a remix signal using the mix signal, the side information, and the user-mix parameter, wherein the side information indicates relation between source signals to be remixed among the source signals or relation between the source signal to be remixed and the mix signal.

To further achieve these and other advantages and in accordance with the purpose of the present invention, a signal processing apparatus according to the present invention includes a mix signal decoding unit obtaining mix signal including at least one source signal, a side information decoding unit obtaining a side information, and a remix rendering unit, if domains of the mix signal and the side information are matched to each other, the remix rendering unit generating a remix signal using the mix signal, the side information, and a user-mix parameter, wherein the side information indicates relation between source signals to be remixed among the source signals or relation between the source signal to be remixed and the mix signal and wherein the user-mix parameter is generated using a control information provided by a user.

To further achieve these and other advantages and in accordance with the purpose of the present invention, a signal processing method according to the present invention includes obtaining a mix signal including at least one source signal, obtaining a first side information, obtaining a mix parameter, and generating a remix signal using the mix signal, the first side information, and the mix parameter, wherein the first side information comprises an information generated from modifying a second side information indicating relation between a source signal to be remixed among the source signals and the mix signal.

To further achieve these and other advantages and in accordance with the purpose of the present invention, a signal processing method according to the present invention includes obtaining a mix signal including at least one source signal, obtaining a source signal to be remixed from the source signals, generating a first side information using the mix signal and the source signal to be remixed, and modifying the first side information into a second side information, wherein the first side information indicates a relation between the source signal to be remixed and the mix signal.

To further achieve these and other advantages and in accordance with the purpose of the present invention, a signal processing method according to the present invention includes obtaining a first mix signal and a first side information, obtaining a second mix signal, modifying the first side information into a second side information using a result of comparing the first mix signal and the second mix signal to each other, wherein the first side information is an information required for remixing the first mix signal and wherein the second side information is an information required for remixing the second mix signal.

To further achieve these and other advantages and in accordance with the purpose of the present invention, a signal processing apparatus according to the present invention includes a mix signal decoding unit obtaining a mix signal including at least one source signal, a side information decoding unit obtaining a first side information, and a remix rendering unit generating a remix signal using the mix signal, the first side information, and a mix parameter, wherein the first side information is generated from modifying a second side information indicating a relation between a source signal to be remixed among the source signals and the mix signal and wherein the mix parameter is generated using a control information obtained from a user.

To further achieve these and other advantages and in accordance with the purpose of the present invention, a signal processing apparatus according to the present invention includes a side information generating unit generating a first side information using a mix signal including at least one source signal and a source signal to be remixed, a side information modifying unit modifying the first side information into a second side information, and a side information encoding unit encoding the second side information, wherein the first side information is an information indicating a relation between the source signal to be remixed and the mix signal.

It is to be understood that both the foregoing general description and the following detailed description are exemplary and explanatory and are intended to provide further explanation of the invention as claimed.

Advantageous Effects

Accordingly, the present invention provides the following effects or advantages.

First of all, according to an apparatus for processing a signal and method thereof, in remixing a mix signal per a source signal, specific effect applied channel signals (e.g., reverberation-applied left channel signal, reverberation-applied right channel signal) are grouped to construct a single source. Hence, a user is able to control a grouped (unified) source only without controlling each source.

Secondly, according to an apparatus for processing a signal and method thereof, a user is able to overall control sounds of a plurality of musical instruments (e.g., base drum, Hi-Hat, Low-Tom, snare drum, cymbals, etc.) belonging to a prescribed classification (e.g., drum) at a time.

Thirdly, according to an apparatus for processing a signal and method thereof, associated source signals are grouped into a single source signal. So, a user is further facilitated to remix a mix signal by just controlling the grouped source without controlling the respective source signals one by one.

Fourthly, according to an apparatus for processing a signal and method thereof, a mix signal is controllable per a source signal, a mix signal and side information are independently transmittable, and side information can be modified suitable for a new mix signal.

Fifthly, according to an apparatus for processing a signal and method thereof, a mix signal and side information are transformed into the same domain. And, a remix signal can be generated using the mix signal and the side information in the same domain.

Sixthly, according to an apparatus for processing a signal and method thereof, in case that a domain of a mix signal differs from a domain of side information, the domain of the side information is transformed into the domain of the mix signal. A remix signal is then generated using the domain-transformed side information and the mix signal. Hence, an operation amount or load can be reduced.

Seventhly, according to an apparatus for processing a signal and method thereof, a mix signal is controllable per a source signal using modified side information.

Eighthly, according to an apparatus for processing a signal and method thereof, side information is modified to generate small-size side information and the generated side information is transmitted. Hence, an amount of data transmission can be reduced.

DESCRIPTION OF DRAWINGS

The accompanying drawings, which are included to provide a further understanding of the invention and are incorporated in and constitute a part of this specification, illustrate embodiments of the invention and together with the description serve to explain the principles of the invention.

In the drawings.

MODE FOR INVENTION

Reference will now be made in detail to the preferred embodiments of the present invention, examples of which are illustrated in the accompanying drawings.

Figure 1:
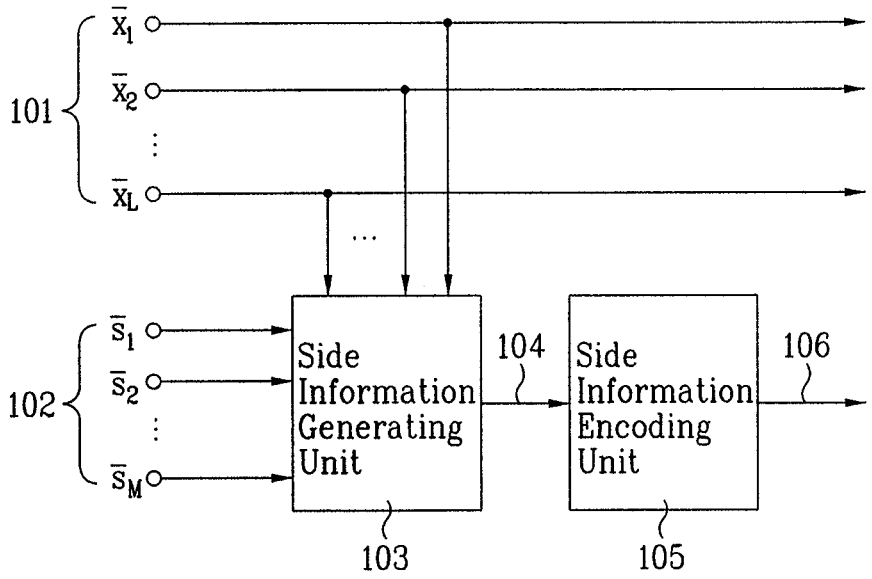
FIG. 1 is a block diagram of a first signal processing apparatus according to one embodiment of the present invention.

FIG. 1 is a block diagram of a first signal processing apparatus according to one embodiment of the present invention.

Referring to FIG. 1, a first signal processing apparatus includes a side information generating unit 103 and a side information encoding unit 105.

The side information generating unit 103 generates side information 104 using a general mix signal 101 and a source signal 102 configuring the mix signal.

The mix signal 101 can include a mono, stereo or multichannel audio signal.

The source signal 102 can include a portion or whole part of source signals configuring the mix signal 101.

And, the side information 104 means information used in processing the mix signal by a source signal unit. The side information 104 includes a mix parameter for remixing the mix signal. The mix parameter includes an encoder mix parameter generated by an encoder using a source signal and may selectively include a blind mix parameter generated using a mix signal only. A gain value for each source signal, a subband power, and the like can be examples of the mix parameter. A specific definition and generation method for the side information 104 will be described in FIG. 2.

The present invention includes a method of generating the side information 104 using the source signal 102 configuring the mix signal only.

And, the side information encoding unit 105 generates an encoded side information signal 106 by encoding the generated side information 104. The mix signal 101 and the side information signal 106 are transferred to a decoding device.

Figure 2:
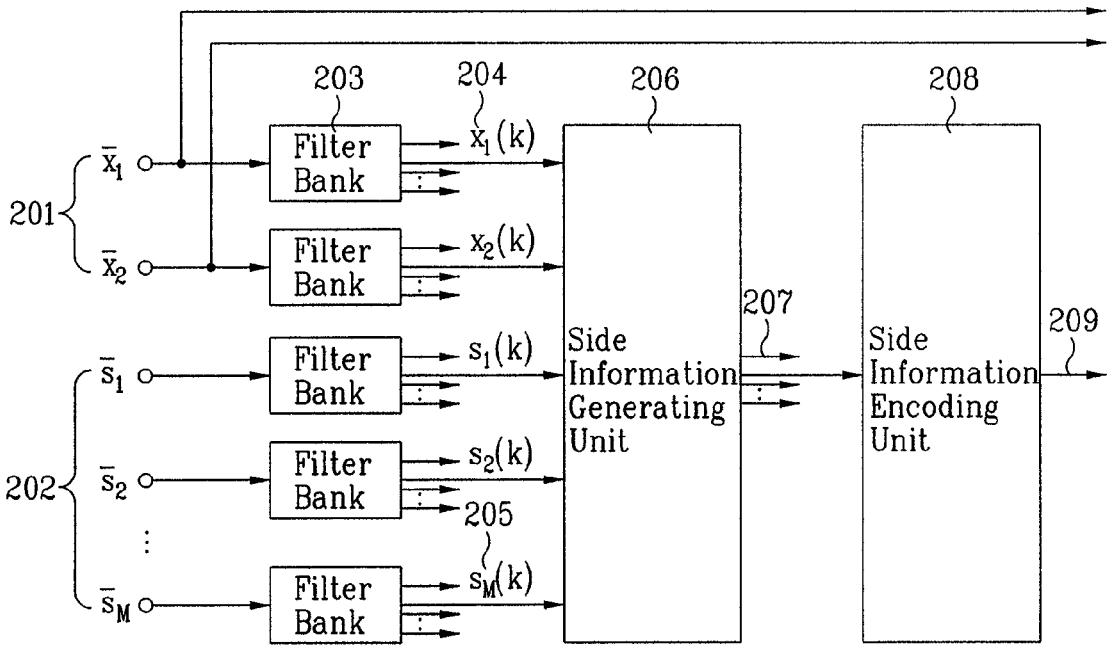
FIG. 2 is a detailed block diagram of the first signal processing apparatus shown in FIG. 1 in case of using a stereo signal.

FIG. 2 is a detailed block diagram of the first signal processing apparatus shown in FIG. 1 in case of using a stereo signal. As mentioned in the foregoing description, a mix signal used by the present invention can include a mono, stereo or multi-channel audio signal. For clarity and convenience, a stereo signal 201 is taken as an example.

The stereo signal 201 $\overline{x_1}(n)$ and $\overline{x_2}(n)$ can be represented as a sum of source signals constructing the stereo signal, where 'n' indicates a time index. Hence, the stereo signal 201 can be represented as Formula 1.

$$\tilde{x}_1(n) = \sum_{i=1}^{I} a_i \tilde{s}_i(n) \qquad \text{[Formula 1]}$$

$$\tilde{x}_2(n) = \sum_{i=1}^{I} b_i \tilde{s}_i(n),$$

In this case, 'I' indicates the number of source signals included in the stereo signal and '$\overline{s_i}(n)$' indicates a source signal. And, '$a_i$' and '$b_i$' are values for determining an amplitude panning and a gain for each source signal, respectively. Each $\overline{s_i}(n)$ is independent. Every $\overline{s_i}(n)$ can be a pure source signal or can include a pure source signal to which little reverberation and sound effect signal components are added. For instance, a specific reverberation signal component can be represented a two source signal, i.e., a signal mixed to a left channel and a signal mixed to a right channel.

The object of the present invention is to modify a stereo signal including source signals in order to remix M source signals ($0 \le M \le I$). The source signals can be remixed into a stereo signal with different gain factors. A remix signal can be represented as Formula 2.

$$\tilde{y}_1(n) = \sum_{i=1}^{M} c_i \tilde{s}_i(n) + \sum_{i=M+1}^{I} a_i \tilde{s}_i(n) \qquad \text{[Formula 2]}$$

$$\tilde{y}_2(n) = \sum_{i=1}^{M} d_i \tilde{s}_i(n) + \sum_{i=M+1}^{I} b_i \tilde{s}_i(n),$$

In Formula 2, '$c_i$' and '$d_i$' are new gain factors for M source signals to be remixed. The '$c_i$' and '$d_i$' can be provided by a decoder end. In this case, a side information generating unit 206 is able to generate side information 207 using the stereo signal 201 and M source signals 202.

As mentioned in the foregoing description, the object of the present invention is to remix a general stereo signal by a source signal unit if the general stereo signal and small side information are given.

It is not possible to perfectly generate a remix signal represented as Formula 2 from a mix signal represented as Formula 1 using a very small quantity of side information.

So, without accessing each source signal $\overline{s_i}(n)$, in case that a general mix signal represented as Formula 1 is given, the object of the present invention is to perceptually imitate a remix signal represented as Formula 2.

Referring to FIG. 2, a general stereo signal 201 and M source signals 202 included in the stereo signal 201 are inputted to a first signal processing apparatus. The stereo signal 201 is delayed to be synchronized with side information and is then directly usable as an output signal.

In order to generate side information, the stereo signal 201 and the source signals 202 are decomposed into signals per subband 204 and 205 in time-frequency domain through filter banks 203. In particular, the stereo signal 201 and the source signals 202 are processed in the time-frequency domain. And, the time-frequency domain will be explained later.

The signal per subband 204 is similarly processed on a center frequency of each subband. A subband pair 204 of the stereo signal 201 on a specific frequency is represented as $x_1(k)$ and $x_2(k)$. In this case, is a time index of each subband signal. Similarly, the subband signals 205 of the M source signals 202 are represented as $S_1(k)$, $S_2(k)$, . . . , $S_M(k)$. For clarity, a subband (frequency) index is not used.

If the subband signals 205 of the source signals 202 are given, a side information generating unit 206 generates a short-time subband power per subband $E\{s_i^2(k)\}$.

And, the side information generating unit 206 generates gain factors $a_i$ and $b_i$ per a subband using the subband pair 204 of the stereo signal 201. The gain factors $a_i$ and $b_i$ can be directly given from outside. Side information per subband 207 is generated using the short-time subband power per subband and the gain factors per subband.

The side information generating unit 206 can generate different information associated with the stereo signal as the side information 207 as well as the short-time subband power and the gain factors.

And, a side information encoding unit 208 generates an encoded side information signal 209 using the side information per subband 207.

For a number of stereo signals 201, gain factors $a_i$ and $b_i$ shall be fixed. If the gain factors $a_i$ and $b_i$ are variable in accordance with a time k, the gain factors will be generated as a function of time. Instead of being directly quantized and coded, the gain factors can be transformed into different values more suitable for quantization and coding.

And, $E\{s_i^2(k)\}$ can be normalized into a value relative to a subband power of the stereo signal 201. This makes the present invention strong against a change if a general encoding device is used to encode a stereo signal efficiently. For instance, $a_i$ and $b_i$ can be transformed into a gain and decibel (dB) unit level difference represented as Formula 3 and then transported.

$$g_i = 10\log_{10}(a_i^2 + b_i^2) \qquad \text{[Formula 3]}$$

$$l_i = 20\log_{10}\frac{b_i}{a_i}.$$

And, instead of being directly encoded as side information, $E\{s_i^2(k)\}$ can be transformed into a value defined relative to a stereo signal, which is represented as Formula 4, and then transported.

$$A_i(k) = 10\log_{10}\frac{E\{s_i^2(k)\}}{E\{x_1^2(k)\} + E\{x_2^2(k)\}}. \qquad \text{[Formula 4]}$$

To generate a short-time, the present invention uses single-pole averaging. Namely, $E\{s_i^2(k)\}$ can be calculated as Formula 5.

$$E\{s_i^2(k)\} = \alpha s_i^2(k) + (1-\alpha)E\{s_i^2(k-1)\}, \qquad \text{[Formula 5]}$$

In Formula 5, $\alpha \in [0,1]$ determines a time-constant of an estimation window that decreases exponentially as Formula 6.

$$T = \frac{1}{\alpha f_s}, \quad \text{[Formula 6]}$$

In Formula 6, $f_s$ indicates a subband sampling frequency. For instance, it is able to use T=40 ms.

In the following description, E{ } indicates short-time averaging. If $a_i$ and $b_i$ are not given, they need to be generated by the side information generating unit 206. Since $E\{s_i(n)\overline{x_1}(n)\}=a_iE\{s_i^2(n)\}$, $a_i$ can be calculated by Formula 7.

$$a_i = \frac{E\{\tilde{s}_i(n)\tilde{x}_i(n)\}}{E\{\tilde{s}_i^2(n)\}}. \quad \text{[Formula 7]}$$

Similarly, $b_i$ can be calculated by Formula 8.

$$b_i = \frac{E\{\tilde{s}_i(n)\tilde{x}_2(n)\}}{E\{\tilde{s}_i^2(n)\}}. \quad \text{[Formula 8]}$$

Figure 3:
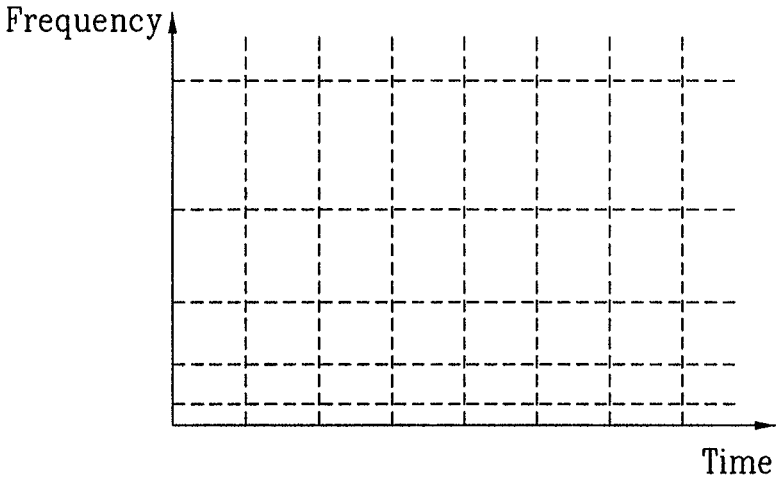
FIG. 3 is a graph of a domain for processing a media signal according to one embodiment of the present invention.

FIG. 3 shows a domain for processing a media signal according to one embodiment of the present invention.

As mentioned in the foregoing description, audio signal and side information are processed as a signal per subband in a time-frequency domain as shown in FIG. 3.

The signal per subband in the time-frequency domain is perceptually induced. For instance, it is able to generate a signal per subband using STFT (short time Fourier transform) having a sine analysis and synthesis window of about 20 ms. In this case, STFT coefficients can be grouped in a manner that one group has a bandwidth about two times greater than ERB (equivalent rectangular bandwidth).

Figure 4:
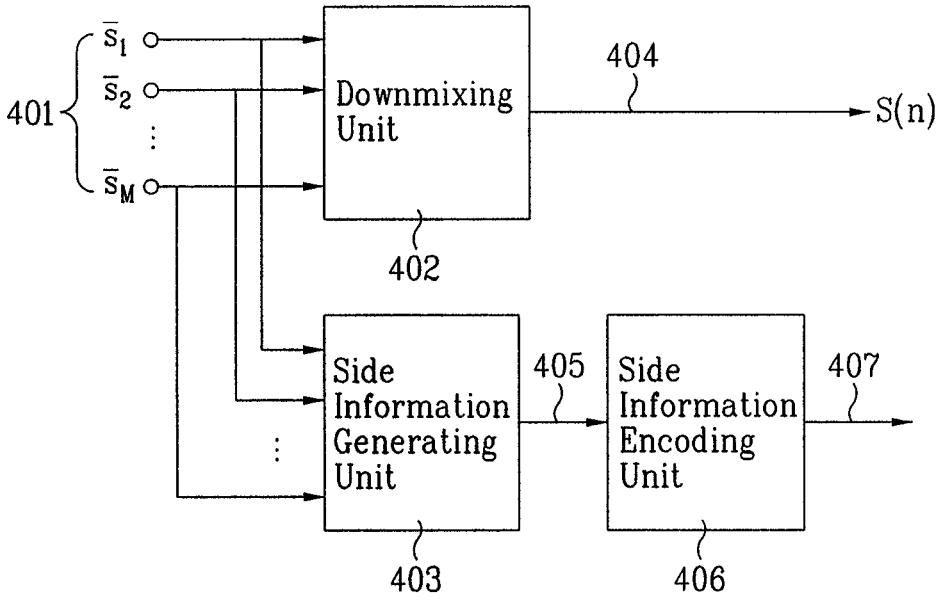
FIG. 4 is a block diagram of a second signal processing apparatus according to one embodiment of the present invention.

FIG. 4 is a block diagram of a second signal processing apparatus according to one embodiment of the present invention.

Referring to FIG. 4, a downmixing unit 406 generates a sum signal by adding a plurality of source signals 401 together. Unlike the first signal processing apparatus, a second signal processing apparatus transports the sum signal 404 instead of transporting a stereo signal.

A side information generating unit 403 generates side information 405 using the source signals 401. The side information 405 includes a subband power and a gain factor corresponding to each of the source signals. And, the side information 405 can include a parameter corresponding to a delay in a remix rendering unit. Similar to that in the first signal processing apparatus, the side information 405 can be transported by being transformed into a different value more suitable for quantization and encoding.

A side information encoding unit generates a side information signal 407 using the generated side information 405.

The generated sum signal 405 and the generated side information signal 407 are transported to a decoding device.

The present invention also includes an encoding device failing to have the downmixing unit 402. In this case, source signals 401 are not transformed into a sum signal 404 but are directly transported.

Figure 5:
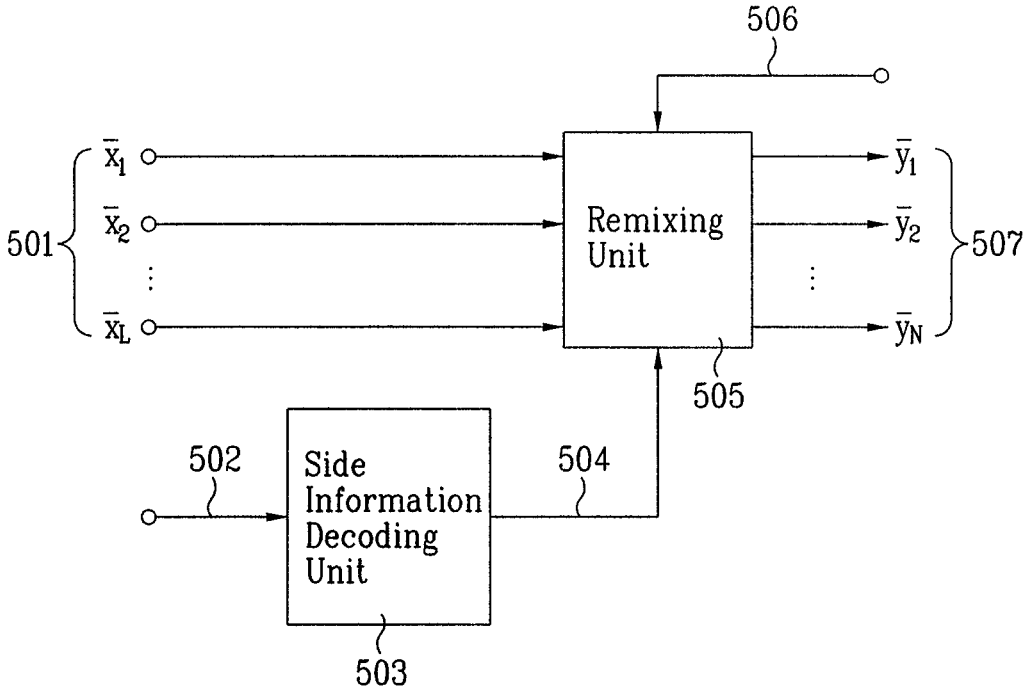
FIG. 5 is a block diagram of a third signal processing apparatus according to one embodiment of the present invention.

FIG. 5 is a block diagram of a third signal processing apparatus according to one embodiment of the present invention.

Referring to FIG. 5, a third signal processing apparatus according to one embodiment of the present invention includes a side information decoding unit 503 and a remix rendering unit 505.

A mix signal 501 and a side information signal 502 are inputted to the third signal processing apparatus. The mix signal 501 can include a mono, stereo or multi-channel audio signal.

The side information decoding unit 503 generates side information 504 by decoding the side information signal 502. The side information 504 includes gain factors and subband powers of source signals included in the transported audio signal 501.

A user-mix parameter 506 generated using control information directly provided by a user can be inputted to the remix rendering unit 505.

The remix rendering unit 505 generates a remix signal 507 using the mix signal 501, the transported side information 504, and the user-mix parameter 506. Details of a method for generating the remix signal will be explained later with reference to FIG. 6.

The remix signal 507 is generated into an eq-channel mix signal having a channel number equal to that of the transported mix signal or can be generated as an up-channel mix signal having a channel number greater than that of the mix signal.

Figure 6:
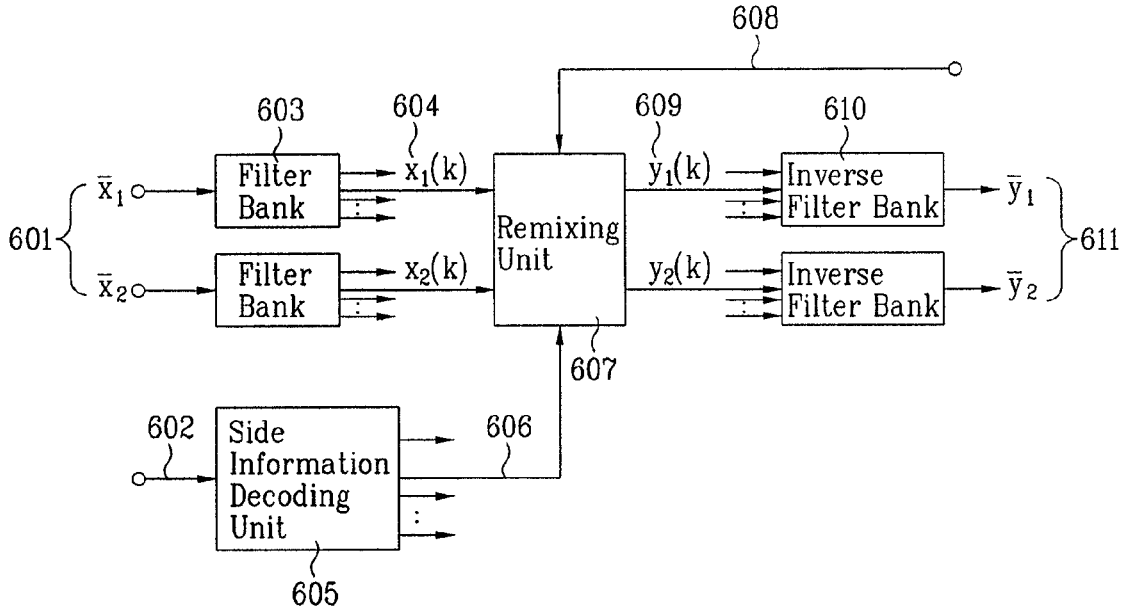
FIG. 6 is a detailed block diagram of the third signal processing apparatus shown in FIG. 5 in case of using a stereo signal.

FIG. 6 is a detailed block diagram of the third signal processing apparatus shown in FIG. 5 in case of using a stereo signal. As mentioned in the foregoing description, a transported mix signal can include a mono, stereo or multi-channel audio signal. For convenience, it is assumed that the transported mix signal includes a stereo signal 601.

Referring to FIG. 6, the stereo signal 601 is decomposed into signals per subband 604 in time-frequency domain via filter banks 603. The signals per subband 604 on a specific frequency are represented as $x_1(k)$ and $x_2(k)$, respectively.

A side information decoding unit 605 generates a side information per subband 606 by decoding a transported side information signal 602.

A user-mix parameter 608 generated using control information provided by a user can be inputted to a remix rendering unit 607. And, the user-mix parameter 608 can be provided per a subband.

As mentioned in the foregoing description, the side information 606 includes a subband power represented as gain factors per subband $a_i$ and $b_i$ and $E\{s_i^2(k)\}$ for M source signals to be remixed.

The remix rendering unit 607 generates a remix signal per subband 609 ($y_1(k)$, $y_2(k)$) using the stereo signal 604 generated per the subband, the transported side information 606, and the user-mix parameter 608. A method of generating the remix signal 609 will be explained in detail. The remix signals 609 are transformed into a stereo signal $(\overline{y_1}, \overline{y_2})$ 611, in a time domain via inverse filter tanks 610.

A method of generating the remix signal 609 from the remix rendering unit 607 is explained as follows.

First of all, Formula 1 and Formula 2 are effective on the signals per subband 604 and 609. In this case, a source signal $\overline{s_i}(n)$ is replaced by a source signal per subband $s_i(k)$.

$$x_1(k) = \sum_{i=1}^{I} a_i s_i(k) \quad \text{[Formula 9]}$$

$$x_2(k) = \sum_{i=1}^{I} b_i s_i(k),$$

The remix signals per subband 609 can be represented as Formula 10.

$$y_1(k) = \sum_{i=1}^{M} c_i s_i(k) + \sum_{i=M+1}^{I} a_i s_i(k)$$ [Formula 10]

$$y_2(k) = \sum_{i=1}^{M} d_i s_i(k) + \sum_{i=M+1}^{I} b_i s_i(k),$$

To generate the remix signal 609, least squares estimation can be used. If the mix signals per subband ($x_1(k)$, $x_2(k)$) 604 are given, remix signals per subband 609 having different gains, as shown in Formula 11, can be estimated as a linear combination of the mix signals per subband 604.

$$\hat{y}_1(k)=w_{11}(k)x_1(k)+w_{12}(k)x_2(k)$$

$$\hat{y}_2(k)=w_{21}(k)x_1(k)+w_{22}(k)x_2(k),$$ [Formula 11]

In Formula 11, $W_{11}(k)$ $W_{12}(k)$, $W_{21}(k)$ and $w_{22}(k)$ are weight factors, respectively. In this case, generated estimation error can be defined as Formula 12.

$$\begin{aligned} e_1(k) &= y_1(k) - \hat{y}_1(k) \\ &= y_1(k) - w_{11}(k)x_1(k) - w_{12}(k)x_2(k) \\ e_2(k) &= y_2(k) - \hat{y}_2(k) \\ &= y_2(k) - w_{21}(k)x_1(k) - w_{22}(k)x_2(k). \end{aligned}$$ [Formula 12]

The weight factors $w_{11}(k)$, $w_{12}(k)$, $w_{21}(k)$ and $w_{22}(k)$ can be generated per a subband to minimize mean square errors $E\{e_1^2(k)\}$ and $E\{e_2^2(k)\}$. For this, it is able to use a fact that the mean square error can be minimized when $e_1(k)$ and $e_2(k)$ become orthogonal to $x_1(k)$ and $x_2(k)$, respectively. The generated $w_{11}(k)$ and $w_{12}(k)$ can be represented as Formula 13.

$$w_{11} = \frac{E\{x_2^2\}E\{x_1y_1\} - E\{x_1x_2\}E\{x_2y_1\}}{E\{x_1^2\}E\{x_2^2\} - E^2\{x_1x_2\}}$$ [Formula 13]

$$w_{12} = \frac{E\{x_1x_2\}E\{x_1y_1\} - E\{x_1^2\}E\{x_2y_1\}}{E^2\{x_1x_2\} - E\{x_1^2\}E\{x_2^2\}}.$$

In Formula 13, $E\{x_1^2\}$, $E\{x_2^2\}$ and $E\{x_1x_2\}$ can be directly generated. Yet, $E\{x_1y_1\}$ and $E\{x_2y_1\}$ can be generated by Formula 14 using the transported side information 606 (e.g., $E\{s_i^2\}$, $a_i$, $b_i$) and the control information 608 (e.g., gain factors $c_i$ and $d_i$) provided by a user.

$$E\{x_1y_1\} = E\{x_1^2\} + \sum_{i=1}^{M} a_i(c_i - a_i)E\{s_i^2\}$$ [Formula 14]

$$E\{x_2y_1\} = E\{x_1x_2\} + \sum_{i=1}^{M} b_i(c_i - a_i)E\{s_i^2\}.$$

Similarly, $w_{21}$ and $w_{22}$ can be generated by Formula 15.

$$w_{21} = \frac{E\{x_2^2\}E\{x_1y_2\} - E\{x_1x_2\}E\{x_2y_2\}}{E\{x_1^2\}E\{x_2^2\} - E^2\{x_1x_2\}}$$ [Formula 15]

$$w_{22} = \frac{E\{x_1x_2\}E\{x_1y_2\} - E\{x_1^2\}E\{x_2y_2\}}{E^2\{x_1x_2\} - E\{x_1^2\}E\{x_2^2\}},$$

In Formula 15, $E\{x_1y_2\}$ and $E\{x_2y_2\}$ can be represented as Formula 16.

$$E\{x_1y_2\} = E\{x_1x_2\} + \sum_{i=1}^{M} a_i(d_i - b_i)E\{s_i^2\}$$ [Formula 16]

$$E\{x_2y_2\} = E\{x_2^2\} + \sum_{i=1}^{M} b_i(d_i - b_i)E\{s_i^2\}.$$

If phases of the mix signal 604 are coherent to each other or almost become coherent, a value represented as Formula 17 approximates 1.

$$\phi = \frac{E\{x_1x_2\}}{\sqrt{E\{x_1^2\}E\{x_2^2\}}}$$ [Formula 17]

In this case, the weights can be represented as Formula 18.

$$w_{11} = \frac{E\{x_1y_1\}}{E\{x_1^2\}}$$ [Formula 18]

$$w_{12} = w_{21} = 0$$

$$w_{22} = \frac{E\{x_2y_2\}}{E\{x_2^2\}}.$$

As mentioned in the foregoing description, the above-generated remix signal per subband 609 is transformed into a remix signal 611 in time-frequency domain via the inverse filter bank 610.

The remix signal 611 sounds similar to a remix signal generated from remixing source signals independently using the user-mix parameters $c_i$ and $d_i$ generated using the control information provided by a user.

The remixing of the 2-channel stereo signal has been mainly dealt with so far. Yet, as mentioned in the foregoing description, the present invention is applicable to the remixing of a multi-channel audio signal, e.g., 5.1-channel audio signal as well as to the stereo signal. It is apparent to those skilled in the art that a multi-channel audio signal can be remixed in a manner similar to that applied to the stereo signal described in this disclosure. If so, Formula 11 can be rewritten into Formula 19.

$$\hat{y}_1(k) = \sum_{c=1}^{C} w_{1c}(k)x_c(k)$$ [Formula 19]

$$\hat{y}_2(k) = \sum_{c=1}^{C} w_{2c}(k)x_c(k)$$

$$\ldots$$

$$\hat{y}_C(k) = \sum_{c=1}^{C} w_{Cc}(k)x_c(k).$$

Selectively, a specific one of channels of a mix signal can remain intact without being remixed. For instance, remixing is applied to front channels of 5.1 surround channels while two rear channels are not modified. For this, 2- or 3-channel remixing algorithm is applied to front channels.

Figure 7:
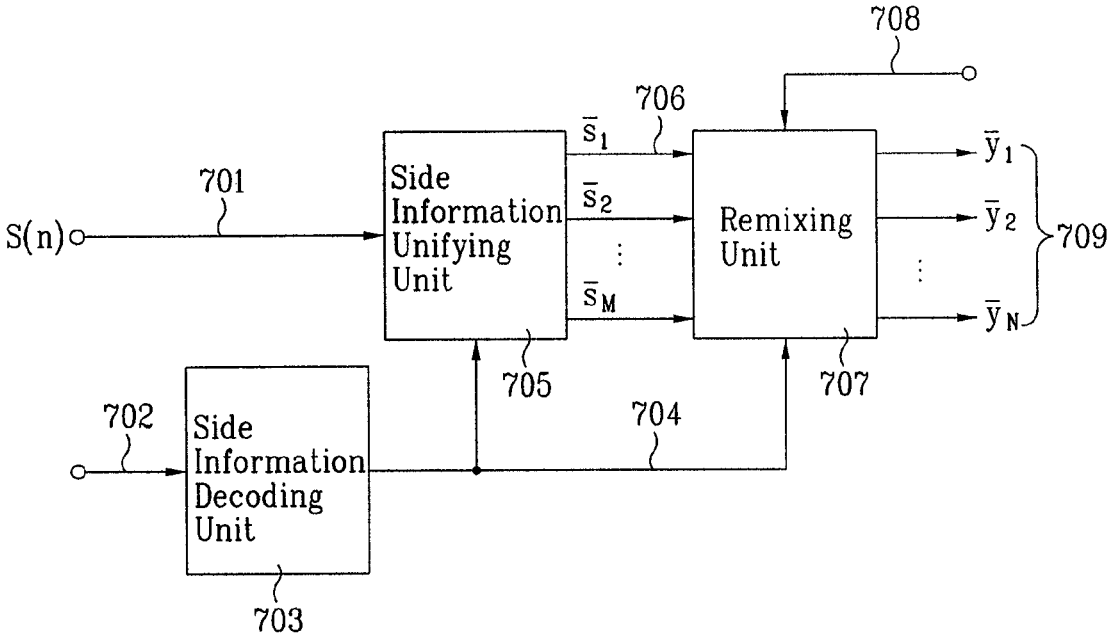
FIG. 7 is a block diagram of a fourth signal processing apparatus according to one embodiment of the present invention.

FIG. 7 is a block diagram of a fourth signal processing apparatus according to one embodiment of the present invention.

Referring to FIG. 7, a fourth signal processing apparatus according to one embodiment of the present invention includes a side information decoding unit 703, a spatial information unifying unit 705, and a remix rendering unit 707.

A sum signal 701 of source signals and a side information signal 702 are inputted to the fourth signal processing apparatus.

The side information decoding unit 703 generates side information 704 by decoding the side information signal 702. The side information 704 includes a gain factor, a delay constant, a subband power, and the like.

The side information unifying unit 705 separates the sum signal 701 into a plurality of source signals 706 using the side information 704.

The remix rendering unit 707 is able to generate a remix signal 709 using the source signals 706. In this case, the remix rendering unit 707 is able to generate the remix signal 709 using a mix parameter carried by the side information.

And, the remix rendering unit 707 is able to generate the remix signal 709 using a user-mix parameter 708 generated using control information provided by a user.

Figure 8:
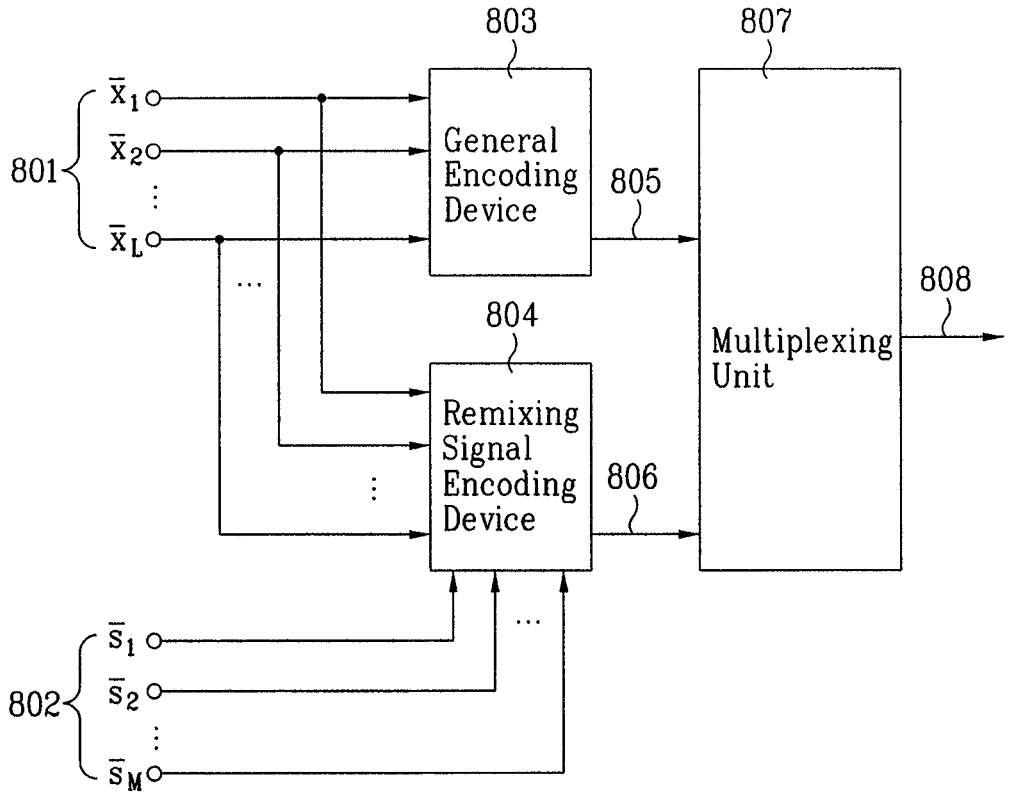
FIG. 8 is a block diagram of a combined configuration of a general encoding device and a signal processing apparatus according to one embodiment of the present invention.

FIG. 8 is a block diagram of a combined configuration of a general encoding device and a signal processing apparatus according to one embodiment of the present invention.

Referring to FIG. 8, a mix signal 801 can be transformed into an encoded mix signal 805 by being encoded by a general encoding device 803. The mix signal 801 can include a signal per channel or a source signal. And, the general encoding device 803 includes an encoder to be developed in the future as well as a conventional encoder such as AAC, MP3 encoder and the like.

A remix signal encoding apparatus 804 according to the present invention generates a side information signal 806 using the mix signal 801 and a source signal 802 included in the mix signal.

A multiplexing unit 807 generates a bitstream 808 using the encoded mix signal 805 and the side information signal 806. As mentioned in the foregoing description, the side information signal 806 can be inserted in an auxiliary data area within a conventional mix signal format to have compatibility with conventional devices.

Figure 9:
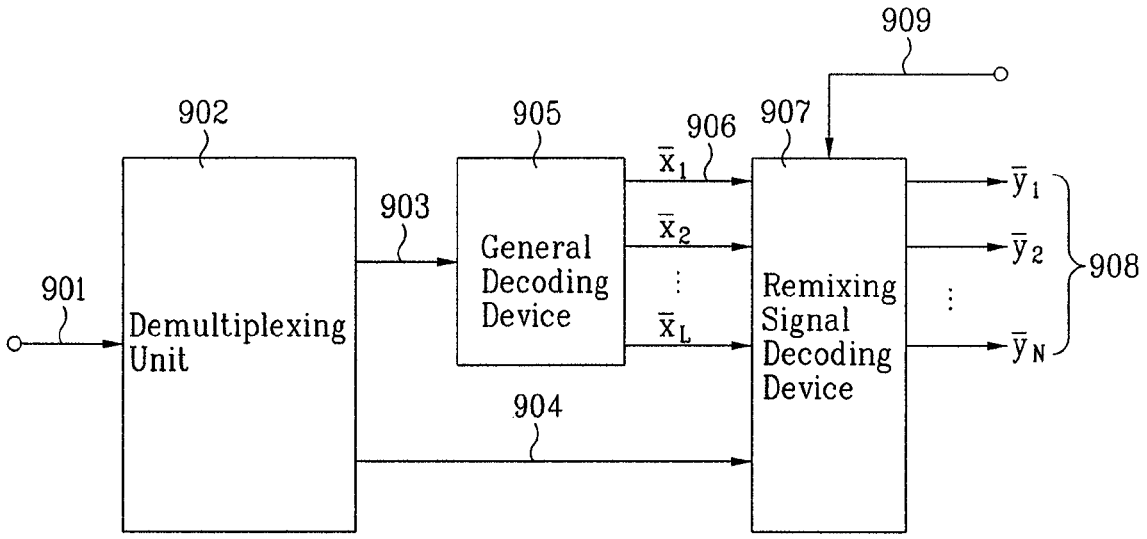
FIG. 9 is a block diagram of a combined configuration of a general decoding device and a signal processing apparatus according to one embodiment of the present invention.

FIG. 9 is a block diagram of a combined configuration of a general decoding device and a signal processing apparatus according to one embodiment of the present invention.

Referring to FIG. 9, a demultiplexing unit 902 separates a transported bitstream 901 into an encoded mix signal 903 and a side information signal 904.

Subsequently, a general decoding device 905 generates a mix signal 906 usable for a remix signal decoding apparatus 907 according to the present invention by decoding the encoded mix signal 903. And, the general decoding device 905 includes a decoder to be developed in the future as well as a conventional decoder such as AAC, MP3 decoder and the like. The mix signal 906 can include a signal per channel or a source signal. The remix signal decoding apparatus 907 according to the present invention is able to transform the mix signal 906 into a remix signal 909 using at least one of the side information signal and a user-mix parameter 908.

Figure 10:
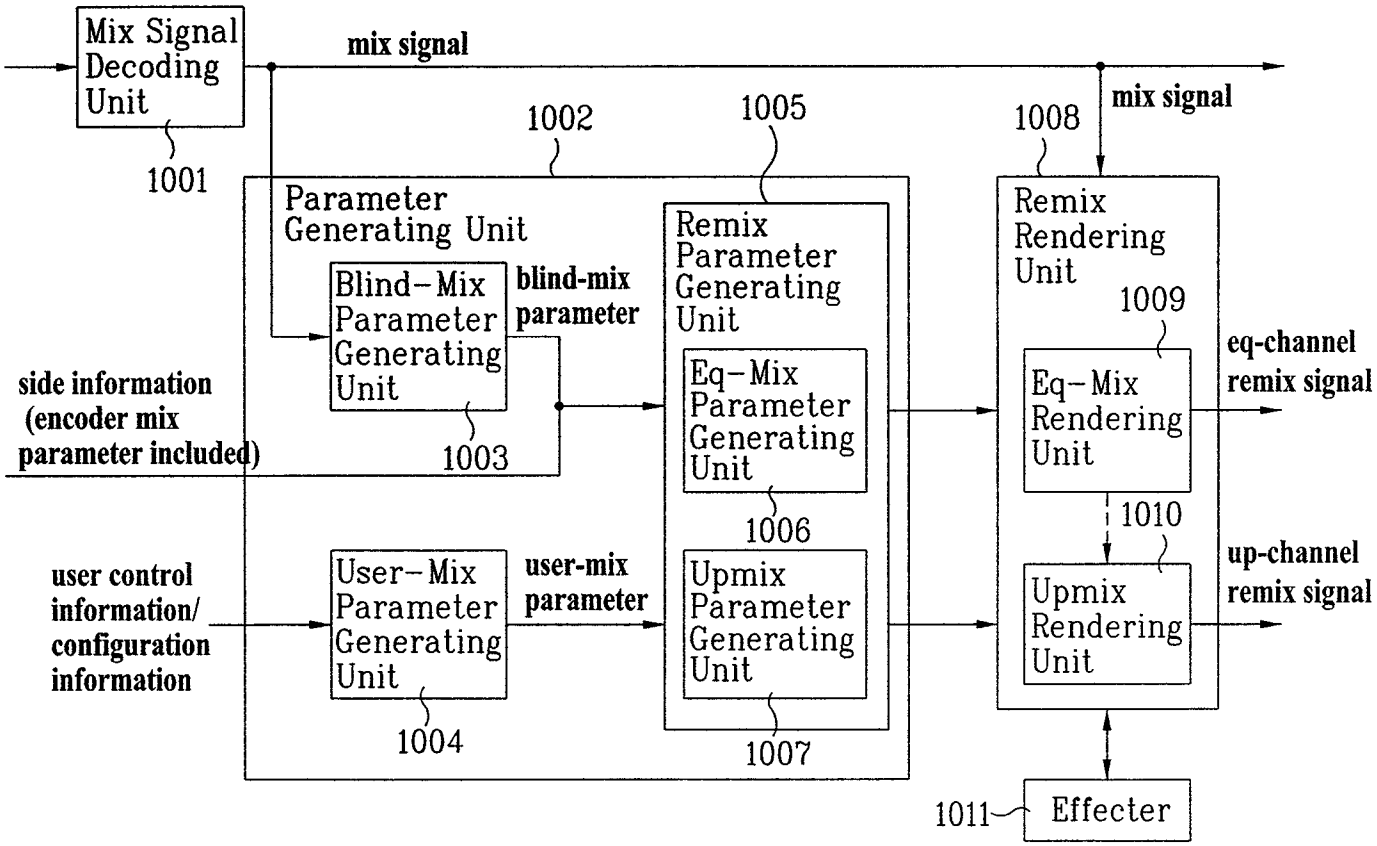
FIG. 10 is a block diagram of a fifth signal processing apparatus according to one embodiment of the present invention.

FIG. 10 is a block diagram of a fifth signal processing apparatus according to one embodiment of the present invention.

Referring to FIG. 10, a fifth signal processing apparatus according to one embodiment of the present invention includes a mix signal decoding unit 1001, a parameter generating unit 1002, and a remix rendering unit 1008. Optionally, the fifth signal processing apparatus may include an effecter 1011.

The parameter generating unit 1002 can include a blind-mix parameter generating unit 1003, a user-mix parameter generating unit 1004, and a remix parameter generating unit 1005.

The remix parameter generating unit 1005 includes an eq-mix parameter generating unit 1006 and may optionally include an upmix parameter generating unit 1007.

The remix rendering unit 1008 includes an eq-mix rendering unit 1009 and may optionally include an upmix rendering unit 1010.

The mix signal decoding unit 1001 generates a mix signal by decoding an encoded mix signal transported by an encoding end.

The parameter generating unit 1002 receives side information and user control information (or configuration information) transported by the encoding end. And, the user control information may be generated from a decoder end instead of being transported by the encoder end.

The user-mix parameter generating unit 1004 generates a user-mix parameter using the user control information. And, an encoder mix parameter may be included in the side information transported by the encoder end.

The blind-mix parameter generating unit 1003 is able to generate a blind-mix parameter using the mix signal. Either the encoder mix parameter or the blind-mix parameter can be selectively inputted to the remix parameter generating unit 1005.

The remix parameter generating unit 1005 generates a remix parameter using the side information and the user-mix parameter. The remix parameter can be generated to be applicable to a channel of the remix signal.

The eq-mix parameter generating unit 1006 included in the remix parameter generating unit 1005 generates a remix parameter used in generating a remix signal having a channel number equal to that of the mix signal.

And, the upmix parameter generating unit 1007 generates a remix parameter used in generating a remix signal having a channel number greater than that of the mix signal. The remix parameter is inputted to the remix rendering unit 1008.

The eq-mix rendering unit 1009 included in the remix rendering unit 1008 generates an eq-channel remix signal having a channel number equal to that of the mix signal using the remix parameter and the mix signal.

The upmix rendering unit 1010, which may be included in the remix rendering unit 1008, generates an up-channel remix signal having a channel number greater than that of the mix signal using the remix parameter generated from the upmix parameter generating unit 1007 and the mix signal. The upmix rendering unit 1010 can generate an up-channel remix signal using the remix signal generated from the eq-channel rendering unit 1009.

Hence, the fifth signal processing apparatus outputs the mix signal transported by the encoding end as it is, outputs the mix signal into the eq-channel remix signal, or outputs the mix signal into the up-channel remix signal. Optionally, using information provided by the effecter 1011, the remix rendering unit can give various effects to the remix signal.

Figure 11:
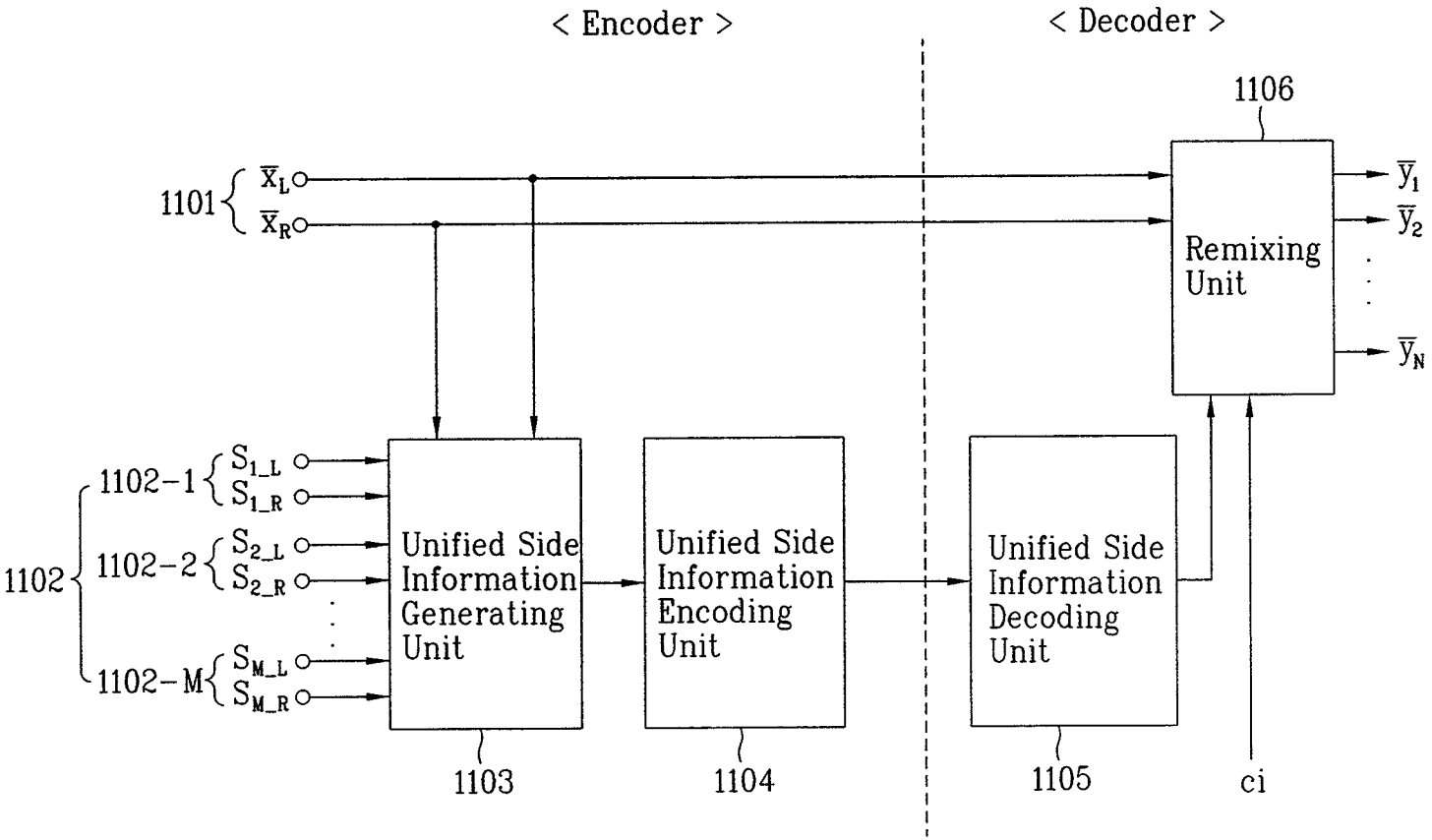
FIG. 11 is a block diagram of a sixth signal processing apparatus according to one embodiment of the present invention.

FIG. 11 is a block diagram of a sixth signal processing apparatus according to one embodiment of the present invention.

Referring to FIG. 11, an encoder of a sixth signal processing apparatus according to one embodiment of the present invention includes a unified side information generating unit 1103 and a unified side information encoding unit 1104. And, a decoder of the sixth signal processing apparatus includes a unified side information decoding unit 1105 and a remix rendering unit 1106.

The unified side information generating unit 1103 generates unified side information using a mix signal 1101 or source signals 1102. In the following description, the mix signal 1101, the source signals 1102, source signal ($S_{1_L}$, $S_{1_R}$, $S_{2_L}$, $S_{2_R}$, . . . , $S_{M_L}$, $S_{M_L}$), unified source signal ($\overline{S_1}$(1102-1), $\overline{S_2}$(1102-2), . . . , $\overline{S_M}$(1102-M)), side information and unified side information will be explained for their concepts in turn.

First of all, the mix signal 1101 means a signal that includes at least one channel signal. In case that the mix signal 1101 is a stereo signal, it includes a left channel signal $\overline{X_L}$ and a right channel signal $\overline{X_R}$.

The 'source signals 1102' is a terminology that indicates at least one source signal ($S_{1_L}$, $S_{1_R}$, $S_{2_L}$, $S_{2_R}$, . . . , $S_{M_L}$, $S_{M_R}$) overall. The source signal ($S_{1_L}$, $S_{1_R}$, $S_{2_L}$, $S_{2_R}$, . . . , $S_{M_L}$, $S_{M_R}$) is a signal that is treated as a single object by the signal processing apparatus of the present invention. And, side information may exist per a source signal. Besides, the side information will be explained later. In this case, '$S_{1_L}$' among the source signals indicates a signal introduced into a left channel by applying a special effect to a first signal $S_1$ (e.g., specific musical instrument signal) and '$S_{1_R}$' among the source signals indicates a signal introduced into a right channel by applying a special effect to the first signal $S_1$. As mentioned in the foregoing description of FIG. 2, despite a single source signal (e.g., specific musical instrument signal), if a prescribed effect (e.g., reverberation effect) is applied, per-channel attribute is added. So, a single introduced into each channel constructs a separate source signal.

The unified source signal ($\overline{S_1}$(1102-1), $\overline{S_2}$(1102-2), . . . , $\overline{S_M}$(1102-M)) means a signal generated from grouping at least two source signals ($S_{1_L}$, $S_{1_R}$, $S_{2_L}$, $S_{2_R}$, . . . , $S_{M_L}$, $S_{M_R}$). For instance, '$\overline{S_1}$(1102-1)' indicates a unified source signal generated from grouping $S_{1_L}$ and $S_{1_R}$ together. And, '$\overline{S_M}$(1102-M)' indicates a unified source signal generated from grouping $S_{M_L}$ and $S_{M_R}$ together. It is able to generate the unified source signal using source signals. For instance, a unified source signal can be generated by Formula 20, which does not restrict various implementations of the present invention.

$$\overline{S_1}=\tfrac{1}{2}*(S_{1_L}+S_{1_R}) \quad \text{[Formula 20]}$$

Meanwhile, unified side information exists for the unified source signal ($\overline{S_1}$(1102-1), $\overline{S_2}$(1102-2), . . . , $\overline{S_M}$(1102-M)), which will be explained later.

Side information is the information applicable to the source signal ($S_{1_L}$, $S_{1_R}$, $S_{2_L}$, $S_{2_R}$, . . . , $S_{M_L}$, $S_{M_R}$) each. As mentioned in the foregoing description of FIG. 1 and FIG. 2, side information can include at least one of gain factor ($a_i$, $b_i$) and subband power ($E\{s_i^2(k)\}$). If a source signal is '$S_{1_L}$', side information is represented as $a_{1_L}$, $b_{1_L}$, $E\{s_{1_L}^2(k)\}$. If a source signal is '$S_{1_R}$', side information is represented as $a_{1_R}$, $b_{1_R}$, $E\{s_{1_R}^2(k)\}$. Side information required for source signal ($S_{1_L}$, $S_{1_R}$, $S_{2_L}$, $S_{2_R}$, . . . , $S_{2_L}$, $S_{M_R}$) is illustrated as follows.

$$a_{1_R}, b_{1_R}, E\{s_{1_R}^2(k)\}$$

$$a_{2_L}, b_{2_L}, E\{s_{2_L}^2(k)\}$$

$$a_{2_R}, b_{2_R}, E\{s_{2_R}^2(k)\}$$

. . .

$$a_{M_L}, b_{M_L}, E\{s_{M_L}^2(k)\}$$

$$a_{M_L}, b_{M_R}, E\{s_{M_R}^2(k)\} \quad \text{[Formula 21]}$$

Unified side information is the side information applicable to unified source signal ($\overline{S_1}$(1102-1), $\overline{S_2}$(1102-2), . . . , $\overline{S_1}$(1102-M)). The unified side information can include relation information between unified source signals ($\overline{S_1}$, $\overline{S_2}$, . . . , $\overline{S_M}$), relation information between the unified source signal ($\overline{S_1}$, $\overline{S_2}$, . . . , $\overline{S_M}$) and the mix signal 1101, energy information corresponding to the unified source signals ($\overline{S_1}$, $\overline{S_2}$, . . . , $\overline{S_M}$) and may further include gain factor and subband power of the unified source signal. This does not restrict various implementations of the present invention. In case that unified side information includes gain factor and subband power, unified side information corresponding to the unified source signal ($\overline{S_1}$(1102-1), $\overline{S_2}$(1102-2), . . . , $\overline{S_M}$(1102-M)) is illustrated in Formula 22.

$$\overline{a_1}, \overline{b_1}, E\{\overline{s_1}^2(k)\}$$

$$\overline{a_2}, \overline{b_2}, E\{\overline{s_2}^2(k)\}$$

. . .

$$\overline{a_M}, \overline{b_M}, E\{\overline{s_M}^2(k)\} \quad \text{[Formula 22]}$$

In the above description, the respective terminologies are explained. Hereinafter, the unified side information generating unit 1103 is explained in detail as follows. First of all, the united side information generating unit 1103 generates united side information ($\overline{a_1}$, $\overline{b_1}$, $E\{\overline{s_1}^2(k)\}$, etc.). For this process, Formula 23 is usable. Namely, it is able to calculate unified side information ($\overline{a_1}$, $\overline{b_1}$) that satisfies given source signals ($S_{1_L}$, $S_{1_R}$) and a unified source signal ($\overline{S_1}$).

$$S_{1_L}=\overline{a}_1*\overline{S}_1$$

$$S_{1_R}=\overline{b}_1*\overline{S}_1 \quad \text{[Formula 23]}$$

Meanwhile, in order to generate the united side information ($\overline{a_1}$, $\overline{b_1}$, $E\{\overline{s_1}^2(k)\}$, etc.), side information ($a_{1_L}$, $b_{1_L}$, $E\{s_{1_L}^2(k)\}$, $a_{1_R}$, $b_{1_R}$, $E\{s_{1_R}^2(k)\}$, etc.) is generated using the mix signal 1101 or the source signals 1102 and the united side information ($\overline{a_1}$, $\overline{b_1}$, $E\{\overline{s_1}^2(k)\}$, etc.) is then generated using the generate side information. This does not restrict various implementations of the present invention.

The united side information encoding unit 1104 generates a united side information bit stream by encoding the united side information generated by the united side information generating unit 1103.

The united side information decoding unit extracts united side information by decoding the received united side information bit stream.

The remix rendering unit 1106 generates remixed mix signals ($\overline{y}_1$, $\overline{y}_2$, . . . , $\overline{y}_N$) by decoding the mix signal 1101 (e.g., $\overline{X_L}$, $\overline{X_R}$) using the united side information received from the united side information decoding unit 1105 and unified control information (ci) inputted from outside. In this case, the united control information is control information applicable to a united source signal ($\overline{S_1}$, etc.) and is inputted from a user. The united control information (ci) is identical to the control information 506 explained with reference to FIG. 5 or the control information 608 ($c_i$, $d_i$) explained with reference to FIG. 6 except that it is applicable to the united source signal ($\overline{S_1}$, etc.). Details will be omitted in the following description.

Figure 12:
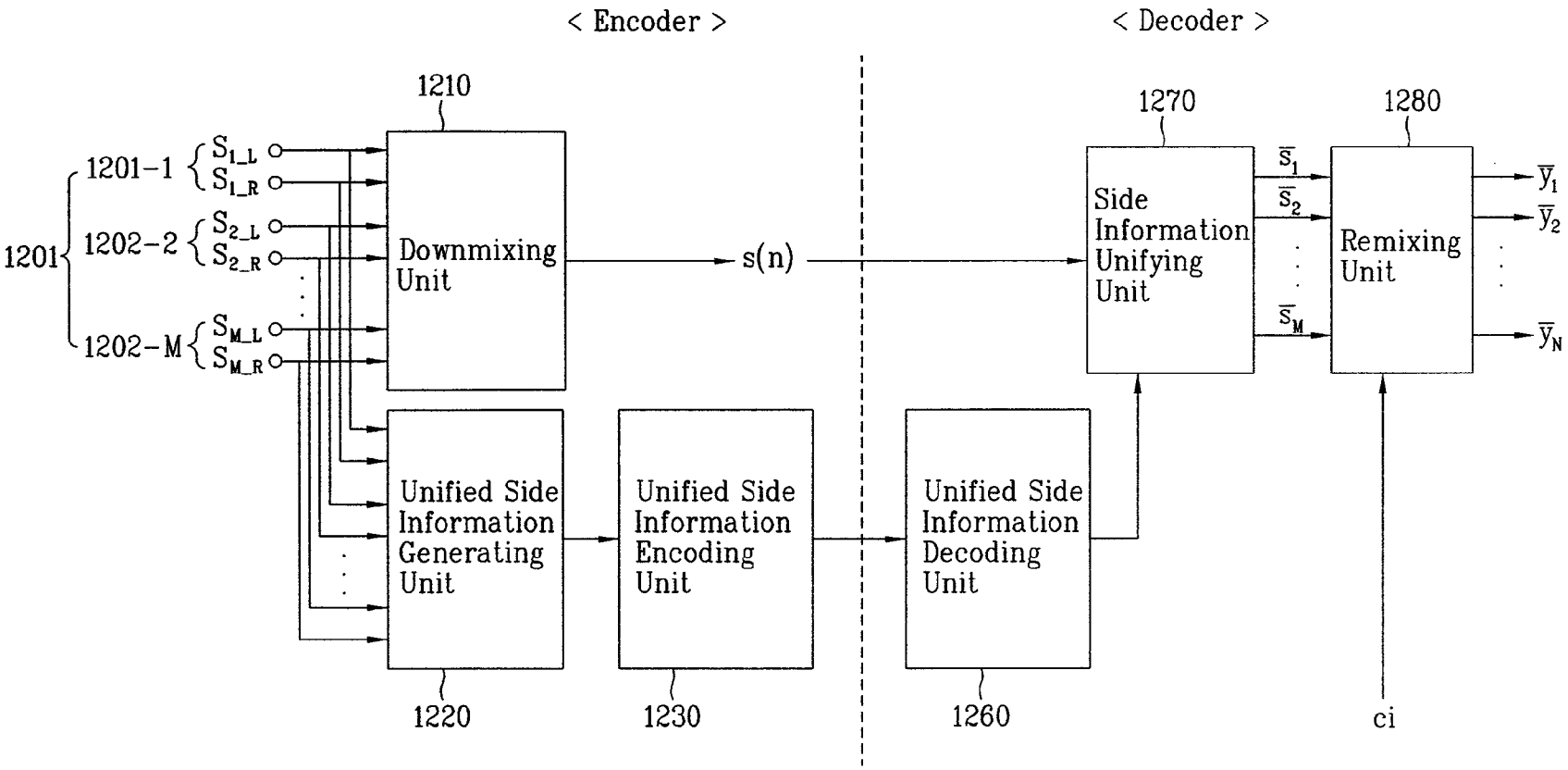
FIG. 12 is a block diagram of a seventh signal processing apparatus according to one embodiment of the present invention.

FIG. 12 is a block diagram of a seventh signal processing apparatus according to one embodiment of the present invention. A seventh signal processing apparatus according to one embodiment of the present invention differs from the sixth signal processing apparatus explained with reference to FIG. 11 as follows. First of all, in the sixth signal processing apparatus, the united side information is generated from the mix signal 1101 and the source signals 1102. In the seventh signal processing apparatus, a downmixing unit 1210 downmixes a source signal 1201 to generate a synthetic source signal S(n). Unified side information is generated in the course of downmixing the source signal 102. The seventh signal processing apparatus is explained in detail with reference to FIG. 12 as follows.

Referring to FIG. 12, an encoder of the seventh signal processing apparatus includes a downmixing unit 1210, a united side information generating unit 1220, and a united side information encoding unit 1230. A decoder of the seventh signal processing apparatus includes a unified side information decoding unit 1260, a side information unifying unit 1270, and a remix rendering unit 1280.

The downmixing unit 1210 generates a synthetic source signal S(n) by downmixing source signals 1201. The downmixing unit 1210 performs functions almost similar to those of the former downmixing unit 402 explained with reference to FIG. 4. In this case, the synthetic source signal S(n) may be equal to the sum signal S(n) 404 explained with reference to FIG. 4, by which implementations of the present invention are not restricted. The united side information generating unit 1220 generates unified side information from source signals 102. In this case, the united side information generating unit 1220 performs functions almost identical to those of the former side information generating unit 403 explained with reference to FIG. 4 except generating unified side information without generating side information. The united side information encoding unit 1230 generates a unified side information bit stream by encoding the united side information generated by the united side information generating unit 1220.

The united side information decoding unit 1260 extracts unified side information by decoding the unified side information bit stream. The side information unifying unit 1270 generates unified source signal $(\overline{S_1}, \overline{S_2}, \ldots, \overline{S_M})$ from the synthetic source signal S(n) using the unified side information. And, the remix rendering unit 1280 generates remixed mix signal $(\overline{y}_1, \overline{y}_2, \ldots, \overline{y}_N)$ by decoding the unified source signal $(\overline{S_1}, \overline{S_2}, \ldots, \overline{S_M})$ using the unified control information (ci).

Figure 13:
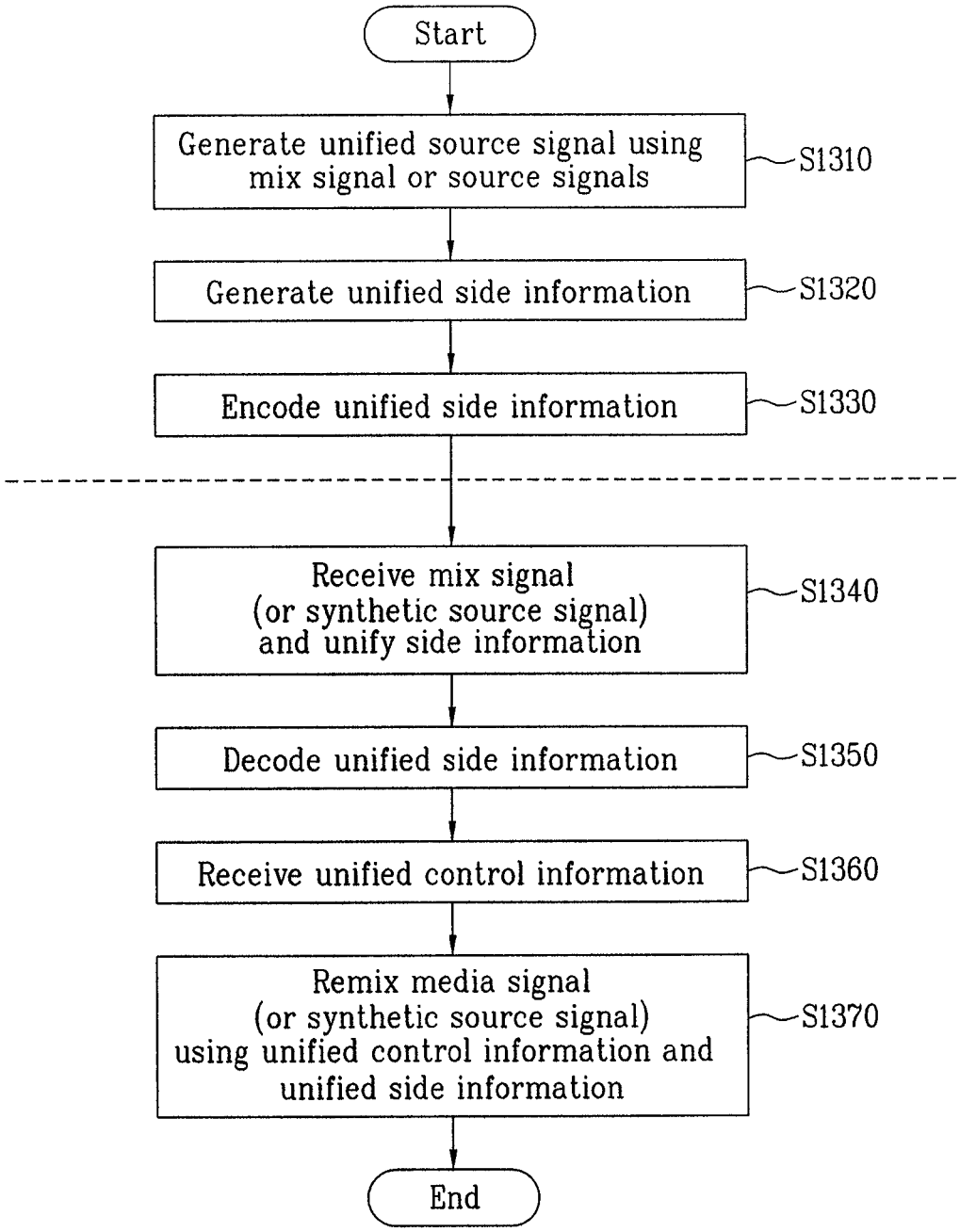
FIG. 13 is a flowchart of a signal processing method according to one embodiment of the present invention.

FIG. 13 is a flowchart of a signal processing method according to one embodiment of the present invention. A signal processing method according to one embodiment of the present invention can be implemented by the sixth/seventh signal processing apparatus explained with reference to FIG. 11/FIG. 12.

Referring to FIG. 13, an encoder of a signal processing apparatus (hereinafter called an encoder) generates a unified source signal using at least one source signal (S1310). In this case, the unified source signal is a signal generated from grouping at least one source signal. The step S1310 can be executed based on a grouping selection signal received from a user. In other words, a user is able to select or decide prescribed source signals to be grouped. Subsequently, the encoder generates unified side information using the unified source signal generated in the step S1310 (S1320). This unified side information generating process is equal to that explained with reference to FIG. 11, of which details are omitted in the following description. Alternatively, in the step S1320, unified side information can be generated not using the unified source signal but using a mix signal or source signals. The encoder then encodes the unified side information generated in the step S1320 (S1330).

If so, a decoder of the signal processing apparatus (hereinafter called a decoder) receives the mix signal (or synthetic source signal) and the unified side information generated by the encoder (S1340). The decoder decodes the unified side information received in the step s1340 (S1350). The decoder receives unified control information from the user (S1360). Subsequently, the decoder remixes the mix signal (or the synthetic source signal) using the unified control information received in the step S1360 and the unified side information decoded in the step S1350 (S1370).

Figure 14:
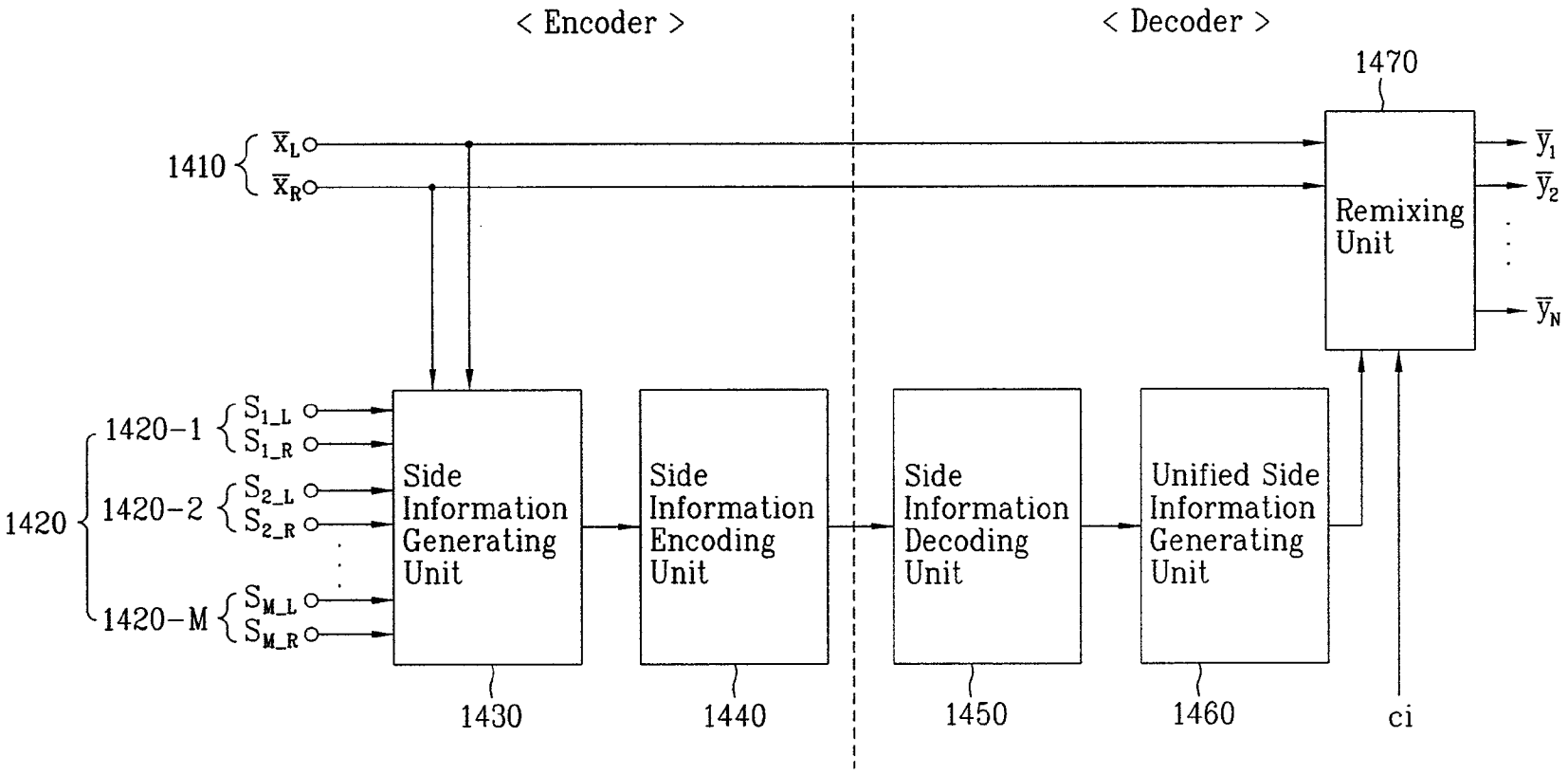
FIG. 14 is a block diagram of an eighth signal processing apparatus according to one embodiment of the present invention.
Figure 15:
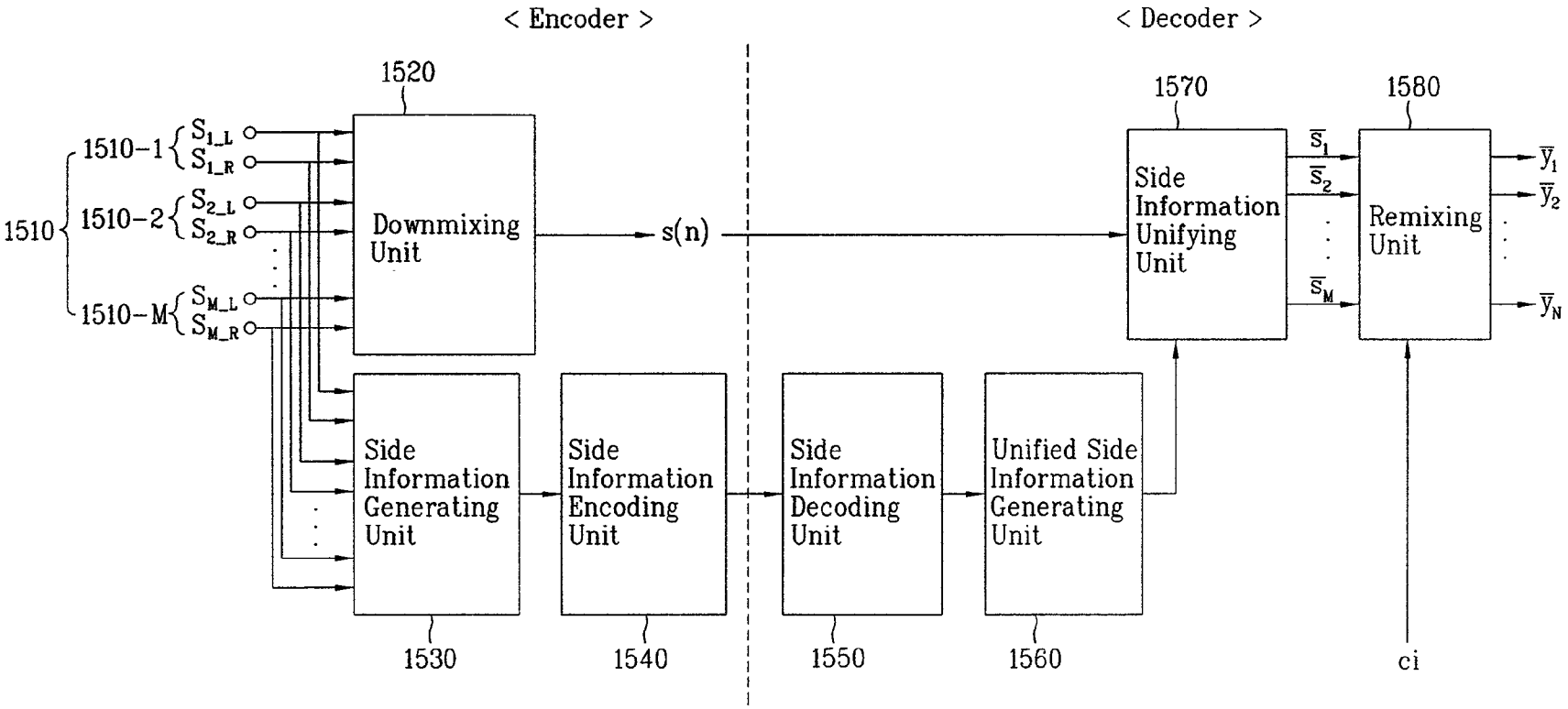
FIG. 15 is a block diagram of a ninth signal processing apparatus according to one embodiment of the present invention.
Figure 16:
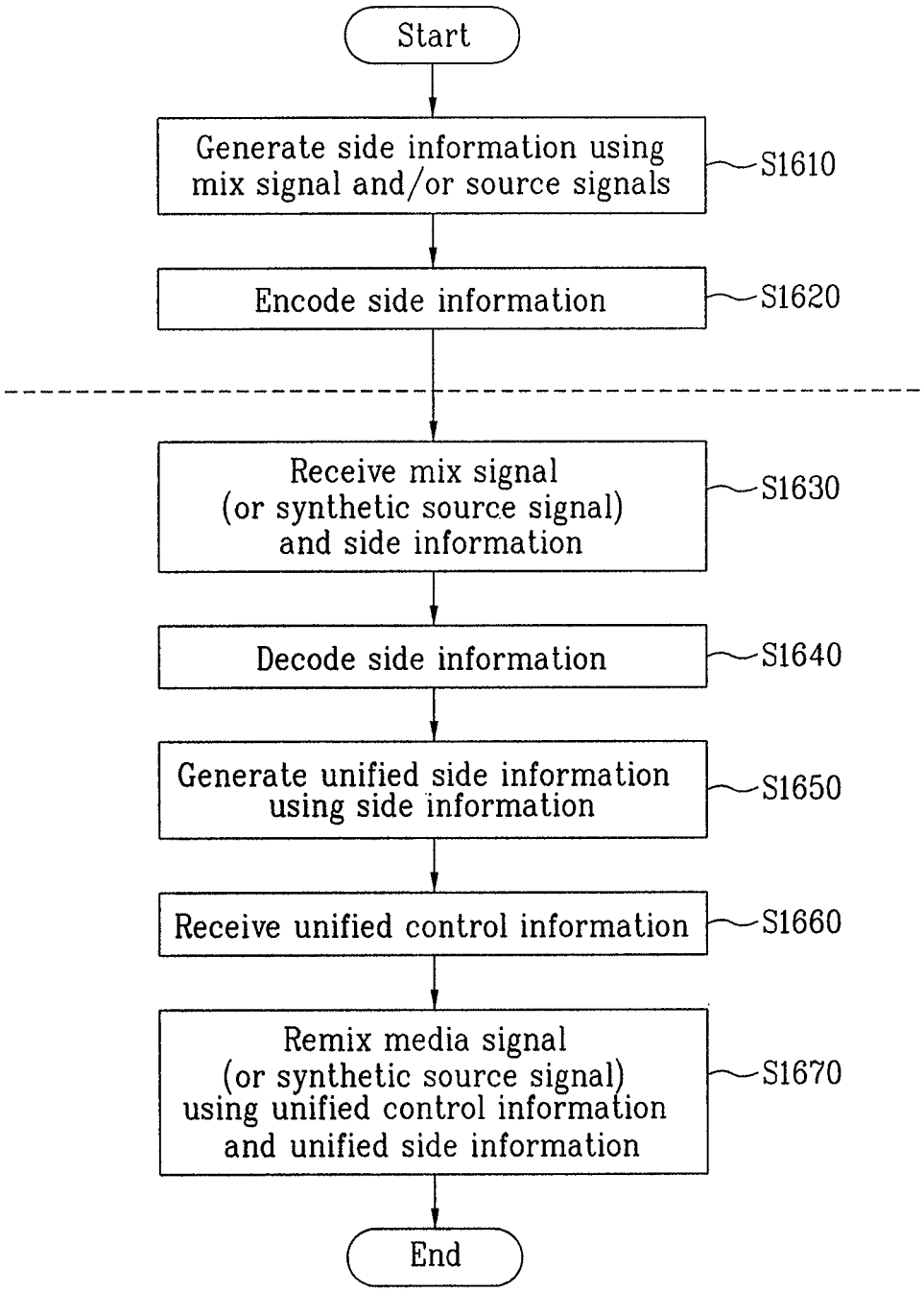
FIG. 16 is a flowchart of another signal processing method according to one embodiment of the present invention.

FIG. 14 is a block diagram of an eighth signal processing apparatus according to one embodiment of the present invention. Embodiments explained with reference to FIGS. 14 to 16 are the examples that unified side information is generated not by an encoder but by a decoder. Referring to FIG. 14, an encoder of an eighth signal processing apparatus includes a side information generating unit 1430 and a side information encoding unit 1440. And, decoder thereof includes a side information decoding unit 1450, a unified side information generating unit 1460, and a remix rendering unit 1470.

The side information generating unit 1430 generates side information $(a_{1_L}, b_{1_L}, E\{s_{1_L}^2(k)\}, a_{1_R}, b_{1_R}, E\{s_{1_R}^2(k)\}$, etc.) from a mix signal $(\overline{X}_L, \overline{X}_R)$ 1410 and source signals $(S_{1_L}, S_{1_R}, S_{2_L}, S_{2_R}, \ldots, S_{M_L}, S_{M_R})$ 1420. The side information generating unit 1430 has the almost same function of the former side information generating unit 103 explained with reference to FIG. 1. The side information encoding unit 1440 generates a side information bit stream by encoding the side information generated by the side information generating unit 1430.

The side information decoding unit 1450 extracts the side information by decoding the received side information bit stream. The unified side information generating unit 1460 generates unified side information using the extracted side information. This process for generating the unified side information using the side information is also explained with reference to FIG. 11 in the foregoing description, of which details will be omitted in the following description. The remix rendering unit 1470 generates remixed mix signal $(\overline{y}_1, \overline{y}_2, \ldots, \overline{y}_N)$ by decoding the mix signal (e.g., $\overline{X}_L, \overline{X}_R$) 1410 using the unified side information generated by the unified side information generating unit 1460 and unified control information (ci) received from outside.

FIG. 15 is a block diagram of a ninth signal processing apparatus according to one embodiment of the present invention. A ninth signal processing apparatus according to one embodiment of the present invention differs from the eighth signal process apparatus explained with reference to FIG. 14 in that a synthetic source signal S(n) is generated in a manner that a source signal 1510 is downmixed by a downmixing unit 1520. The ninth signal processing apparatus is explained in detail with reference to FIG. 15 as follows.

Referring to FIG. 15, an encoder of the ninth signal processing apparatus includes a downmixing unit 1520, a side information generating unit 1530, and a side information encoding unit 1540. And, a decoder thereof includes a side information decoding unit 1550, a unified side information generating unit 1560, a side information unifying unit 1570, and a remix rendering unit 1580.

The downmixing unit 1520 generates a synthetic source signal S(n) by downmixing source signals 1510. The downmixing unit 1520 performs the almost same function of the former downmixing unit 402 explained with reference to FIG. 4. The side information generating unit 1530 generates side information from the source signal S(n). And, the side information encoding unit 1540 generates a side information bit stream by encoding the side information.

The side information decoding unit 1550 extracts the side information by decoding the received side information bit stream. The unified side information generating unit 1560 is an element for generating unified side information using the side information, which is the almost same element of the former unified side information generating unit 1570 in the third embodiment of the present invention. And, the side information unifying unit 1570 and the remix rendering unit 1580 are the almost same elements of the former side information unifying unit 1270 and the former remix rendering unit 1280 shown in FIG. 12, respectively.

FIG. 16 is a flowchart of another signal processing method according to one embodiment of the present invention. A signal processing method according to one embodiment of the present invention can be implemented by the eighth/ninth signal processing apparatus explained with reference to FIG. 14/FIG. 15.

Referring to FIG. 16, an encoder of a signal processing apparatus generates side information using at least one of a mix signal and source signals (S1610). Subsequently, the encoder encodes the side information generated in the step S1610 (S1620).

Meanwhile, a decoder of the signal processing apparatus receives the downmix signal (or a synthetic source signal) and the side information (S1630). Subsequently, the decoder decodes the side information received in the step S1630 (S1640). The decoder generates unified side information using the side information decoded in the step S1640 (S1650). The decoder receives unified control information from a user (S1660). Then, the decoder remixes the mix signal (or the synthetic source signal) using the unified control information received in the step S1660 and the unified side information generated in the step S1650 (S1670).

Figure 17:
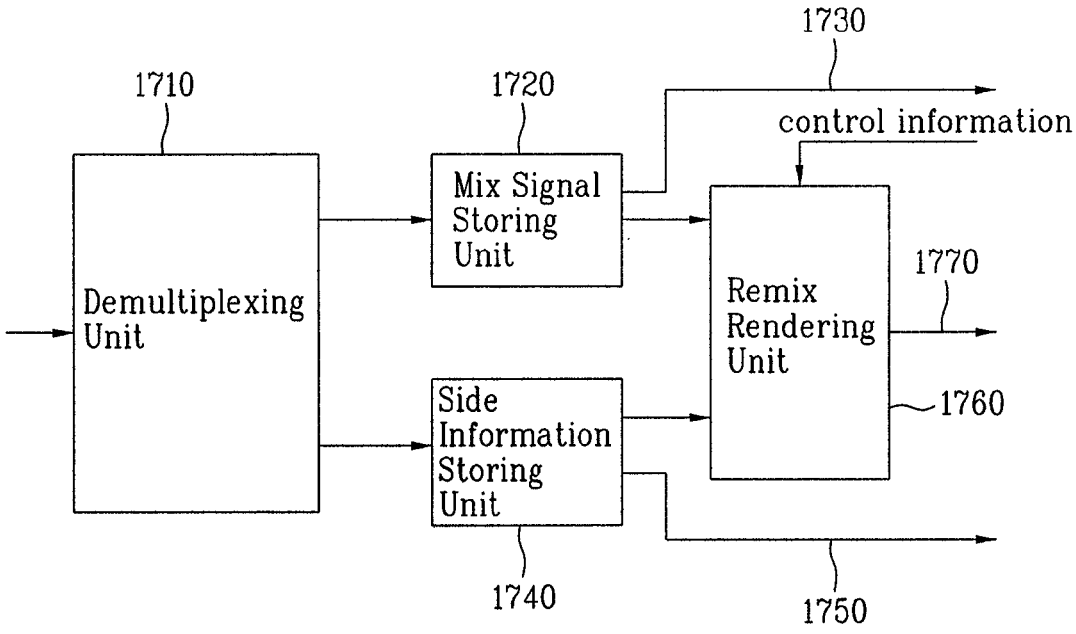
FIG. 17 is a block diagram of a tenth signal processing apparatus according to one embodiment of the present invention.

FIG. 17 is a block diagram of a tenth signal processing apparatus according to one embodiment of the present invention.

Referring to FIG. 17, a tenth signal processing apparatus according to one embodiment of the present invention includes a demultiplexing unit 1710, a mix signal storing unit 1720, a side information storing unit 1740, and a remix rendering unit 1760.

The demultiplexing unit 1710 parses a mix signal and side information and then sends the parsed mix signal and the parsed side information to the mix signal storing unit 1720 and the side information storing unit 1740, respectively. The mix signal storing unit 1720 and the side information storing unit 1740 independently store the mix signal and the side information received from the demultiplexing unit 1710, respectively. In case that the user attempts to use the mix signal 1730 or the side information 1750, the mix signal/side information 1730/1750 is independently extracted from the mix signal storing unit/side information storing unit 1720/1740 and is then outputted.

In case that the user makes a request for a remix signal 1770, a decoder generates the remix signal using the mix signal 1730, the side information and a user-mix parameter and then outputs the remix signal 1770. In this case, the user-mix parameter can be generated using control information inputted from the user. The decoder is able to output the remix signal 1770 in accordance with the request made by the user or can directly output the mix signal 1730 or the side information 1750. And, the user is able to generate the remix signal 1770 using the outputted mix signal 1730 or the outputted side information 1750 and a new mix signal or new side information.

Figure 18:
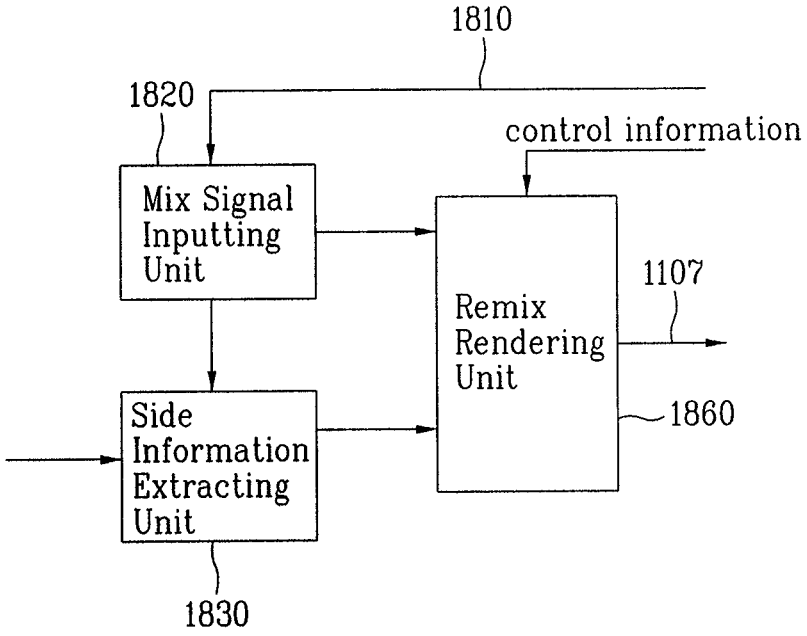
FIG. 18 is a block diagram of an eleventh signal processing apparatus according to one embodiment of the present invention.

FIG. 18 is a block diagram of an eleventh signal processing apparatus according to one embodiment of the present invention.

Referring to FIG. 18, an eleventh signal processing apparatus according to one embodiment of the present invention includes a mix signal inputting unit 1820, a side information extracting unit 180, and a remix rendering unit 1860.

The eleventh signal processing apparatus stores side information transported by an encoder or a side information providing sever. The eleventh signal processing apparatus directly generates side information on a mix signal and then stores the generated side information therein. And, the eleventh signal processing apparatus receives a mix signal 1810 from a user using the mix signal inputting unit 1820. The side information extracting unit 1830 searches whether there exists a mix signal identical to the former mix signal 1810 received from the user. If there exists the latter mix signal identical to the former mix signal 1810 received from the user, the side information extracting unit extracts a side information signal for the corresponding mix signal and then sends the extracted side information to the remix rendering unit 1860.

On the contrary, if there does not exist the latter mix signal identical to the former mix signal 1810 received from the user, the side information extracting unit 1830 searches for mix signals respectively having predetermined common features. The side information extracting unit 1830 extracts the mix signal most similar to the mix signal 1810 received from the user from the extracted mix signals having the prescribed common features and then extracts side information on the extracted mix signal. If the extracted side information differs in time sync or speed despite capable of adjusting the mix signal 1810 received from the user, the side information extracting unit 1830 modifies the side information to enable the mix signal 1810 received from the user to be adjustable.

The remix rendering unit 1860 outputs a remix signal 1870 using the mix signal received from the mix signal inputting unit 1820 and the side information or the modified side information received from the side information extracting unit 1830. If there does not exits the mix signal having a prescribed common feature with the mix signal 1810 received from the user, the side information extracting unit 1830 directly generates side information on the received mix signal 1810 and then sends the directly generated side information to the remix rendering unit 1860. Alternatively, the side information extracting unit 1830 reproduces the mix signal 1810 received from the user only without using side information.

Figure 19:
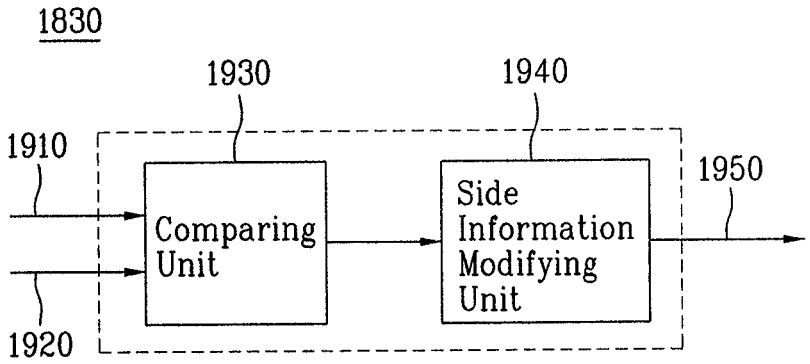
FIG. 19 is a detailed block diagram of a side information extracting unit shown in FIG. 18.

FIG. 19 is a detailed block diagram of a side information extracting unit shown in FIG. 18.

Referring to FIG. 19, a side information extracting unit 1830 includes a comparing unit 1930 and a side information modifying unit 1940.

The eleventh signal processing apparatus receives a new mix signal 1920 from a signal providing server or a user. The comparing unit 1930 compares a mix signal 1910 stored in a decoding device to the new mix signal 1920 received from the user or the signal providing server. If the stored mix signal 1910 is identical to the new mix signal 1920, the decoding device is able to use side information on the stored mix signal 1910 as side information on the new mix signal 1920. If there exists a fine difference between the stored mix signal 1910 and the new mix signal 1920 in time sync, play speed or the like, a signal decoding device modifies the side information on the stored mix signal 1910 into side information on the new mix signal 1920 and then uses the modified side information. In particular, the signal decoding device compares the stored mix signal 1910 to the new mix signal 1920. If the two mix signals are not identical to each other, the signal decoding device modifies the side information using the side information modifying unit 1940.

A method of modifying side information will be explained with reference to FIGS. 20 to 24. The side information modifying unit 1940 outputs the modified side information. The decoding device then remixes the new mix signal using the mix signal received from the user and the modified side information.

Figure 20:
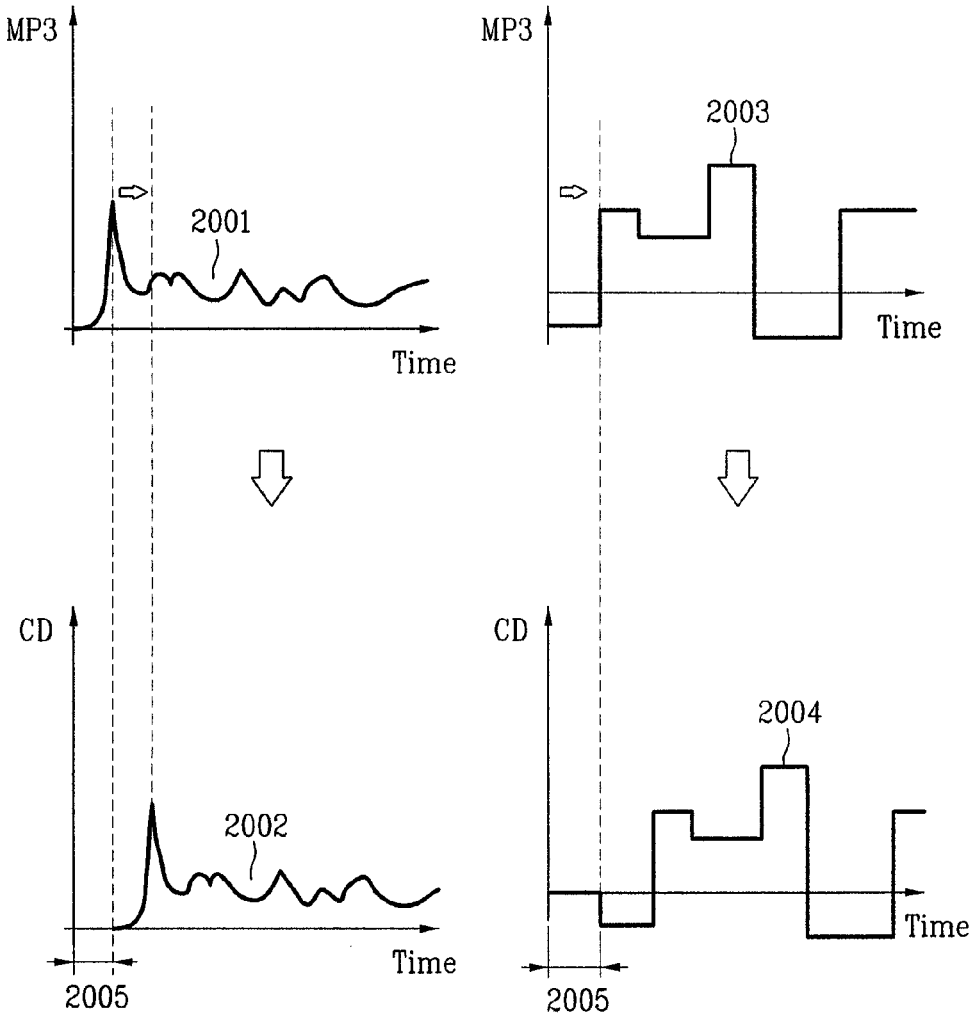
FIG. 20 and FIG. 21 are graphs for representing a method of modifying side information according to one embodiment of the present invention.
Figure 21:
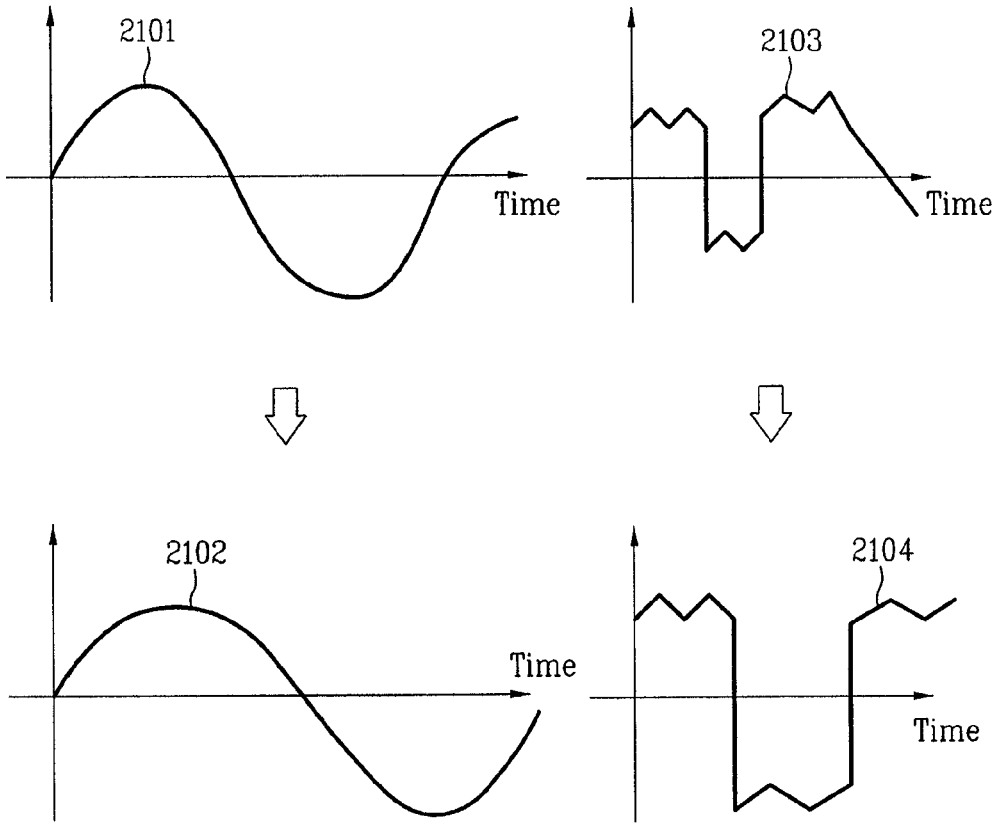

FIG. 20 and FIG. 21 are graphs for representing a method of modifying side information according to one embodiment of the present invention.

A decoding device receives and stores a mix signal 2001 and corresponding side information 2003 from an encoding device or a separate server. Optionally, the decoding device receives a mix signal 2001, generates side information 2003 on the mix signal 2001 in direct, and then stores the generated side information. The mix signal 2001 and the corresponding side information 2003 stored in the decoding device are shown in FIG. 20 and FIG. 21.

It is assumed that the mix signal and the corresponding side information stored in the decoding device in FIG. 20 have a compressed signal format of MP3 file or the like due to efficiency in transmission and storage. For instance, it is assumed that the decoding device stores a mix signal 2001 called 'November rain' and corresponding side information 2003, which are transported as MP3 file by an encoding device. In case that a user possesses an un-remixed music 'November rain' as lossless CD signals, the user is able to play the lossless CD signal as a remix signal using side information stored in the decoding device.

The side information on the music 'November rain' stored in the decoding device is an MP3 file. And, the signal the user attempts to remix is a CD signal. So, the side information stored as MP3 file should be modified into side information suitable for the CD signal. The decoding device extracts the stored side information 2003 to remix a new mix signal 2002 and then modifies the extracted side information into new side information 2004. In FIG. 20, the mix signal 2002 to be remixed is time-delayed more than the original mix signal 2001. Generally, a pause section 2005 of a head or tail in MP3 file is omitted to raise a compression ratio. So, the decoding device should generate the new side information 2004 in a manner of time-delaying the side information 2003 rendered as MP3 file by the pause section 2005.

Referring to FIG. 21, a new mix signal 2102 a user attempts to remix has a frequency lower than that of a mix signal 2101 stored in a decoding device. Namely, the new mix signal 2102 is extended on a temporal axis longer than the stored mix signal 2101. So, the decoding device has to modify side information 2103 to be fitted to the new mix signal 2102. The decoding device compares the stored mix signal 2101 and the new mix signal 2102 to each other and then modifies the former side information 2103 into side information fitted for the new mix signal 2102. The decoding device is capable of generating a new mix signal 2104 by extending the side information 2103 in aspect of time. And, the decoding device remixes the new mix signal 2102 using the modified side information 2104.

Figure 22:
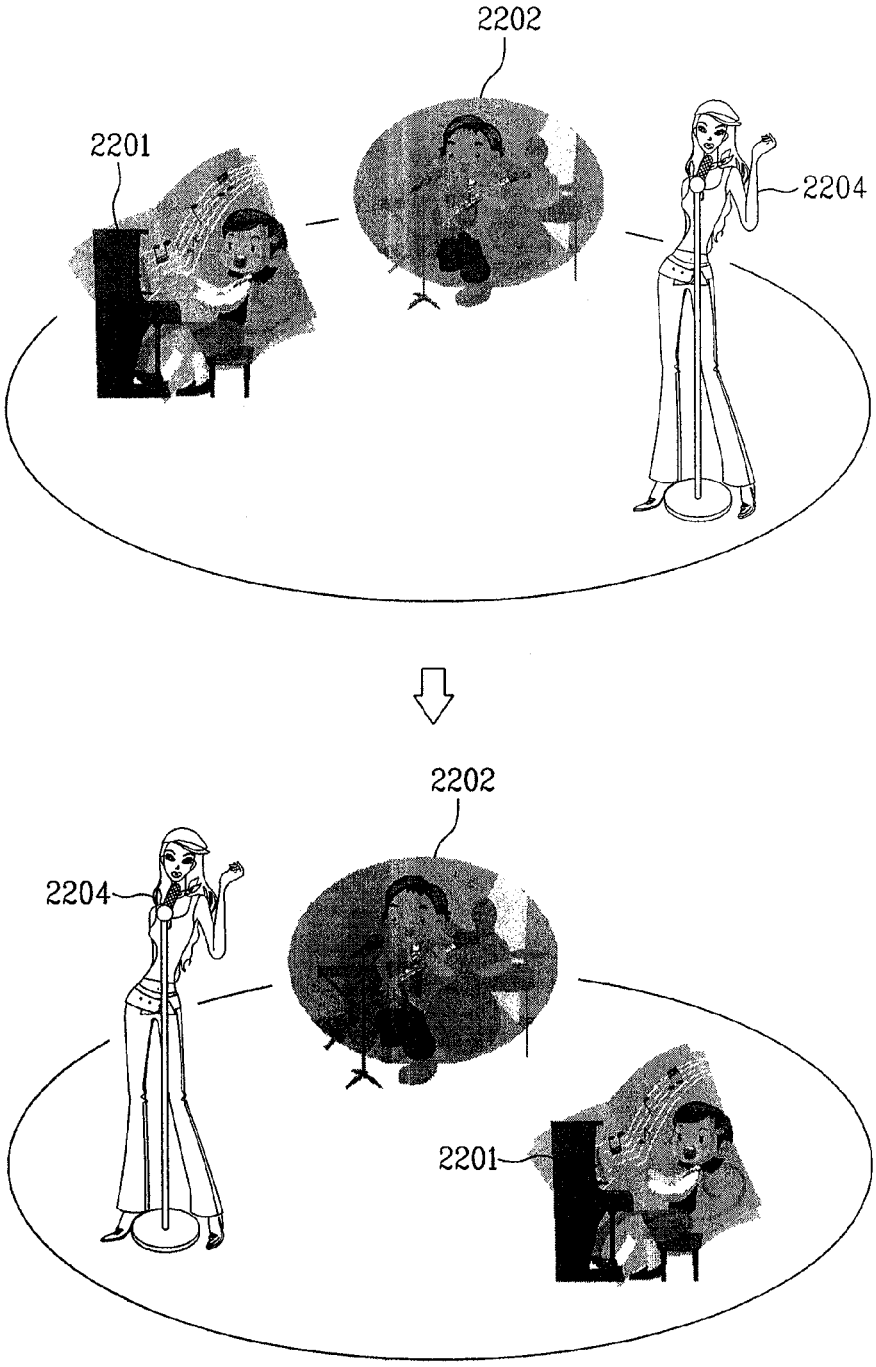
FIG. 22 is a diagram of an example for mix signal modification according to one embodiment of the present invention.

FIG. 22 is a diagram of an example for mix signal modification according to one embodiment of the present invention.

Referring to an upper diagram of FIG. 22, a piano signal 2201, a violin signal 2202 and a vocal signal 2203, which are recorded at the positions shown in the drawing, are included in an original mix signal 1201. In this case, it is assumed that a new mix signal 2202 is a signal recorded at a position modified as shown in a lower diagram of FIG. 22. A decoding device compares a mix signal 2001/2101 stored in the decoding device to a new mix signal 2202/2102 a user attempts to remix. Since the new mix signal 2002/2102 is the signal recorded in a manner of modifying positions of source signals included in the original mix signal 2001/2101, side information 2004/2104 on the new mix signal 2002/2102 should be modified as well.

Looking into the upper and lower diagrams of FIG. 22, the position of the violin signal 2202 is intact. Yet, the position of the piano signal 2202 and the position of the vocal signal 2203 are mutually switched. Hence, the decoding device is able to generate new side information 2202 in a manner of switching side information on the piano signal 2201 and side information on the vocal signal 2203 to each other while side information on the violin signal 2202 remains intact.

Figure 23:
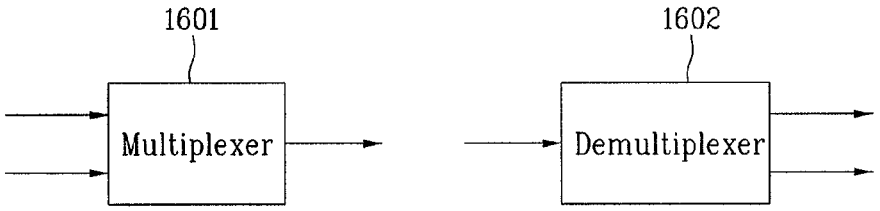
FIG. 23 is a block diagram of a multiplexer and a demultiplexer according to one embodiment of the present invention.

FIG. 23 is a block diagram of a multiplexer and a demultiplexer according to one embodiment of the present invention.

Referring to FIG. 23, a multiplexer 2301 receives a mix signal and side information, which are independently transmitted, and then multiplexes the received mix signal and side information together. The multiplexer 2301 may exist separate from an encoding device or a decoding device. For instance, in case that an encoding device outputs a mix signal and side information on the mix signal independently, the multiplexer 2301 is able to manage the two signals into a single signal in a manner of being included in or positioned in front of the decoding device by multiplexing the mix signal and side information independently transmitted by the encoding device.

In case that a mix signal and side information are transmitted as a single signal, the demultiplexer 2302 parses the single signal into the mix signal and the side information. In case of attempting to use the mix signal or the side information independently, a user is able to separate the single signal into the mix signal and the side information using the demultiplexer 2302. And, the demultiplexer 230 can exist separate from a signal encoding device or a signal decoding device.

Figure 24:
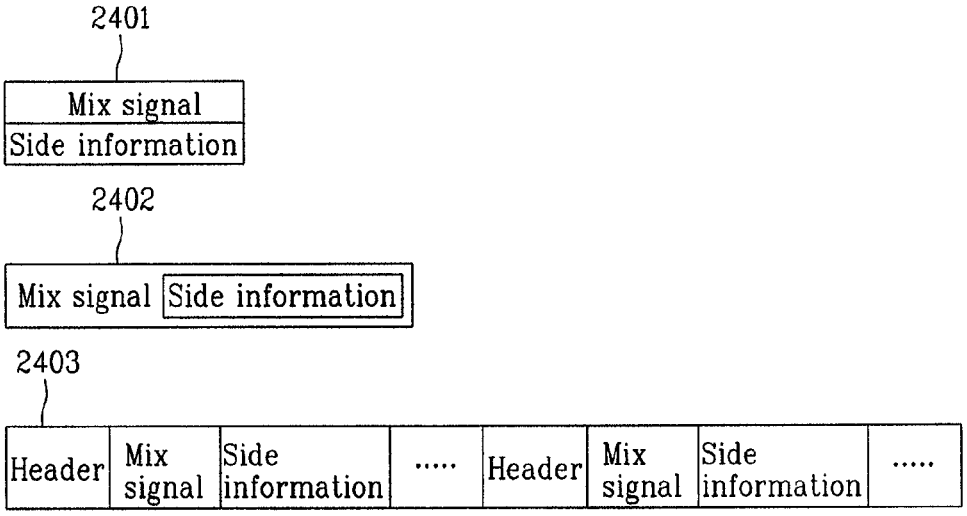
FIG. 24 is a diagram of a signal generated from multiplexing a mix signal and side information together according to one embodiment of the present invention.

FIG. 24 is a diagram of a signal generated from multiplexing a mix signal and side information together according to one embodiment of the present invention.

Referring to FIG. 24, a multiplexing unit included in an encoding or decoding device or a multiplexer independent from the encoding and decoding devices is able to multiplex a mix signal and side information on the mix signal into a simply-added form 2401 or a form 2402 in which the side information on the mix signal is included in an ancillary data area of the mix signal. And, the multiplexing unit or the multiplexer is able to generate a signal 2402 multiplexed by putting the mix signal and the side information together by a frame unit or a predetermined unit.

Figure 25:
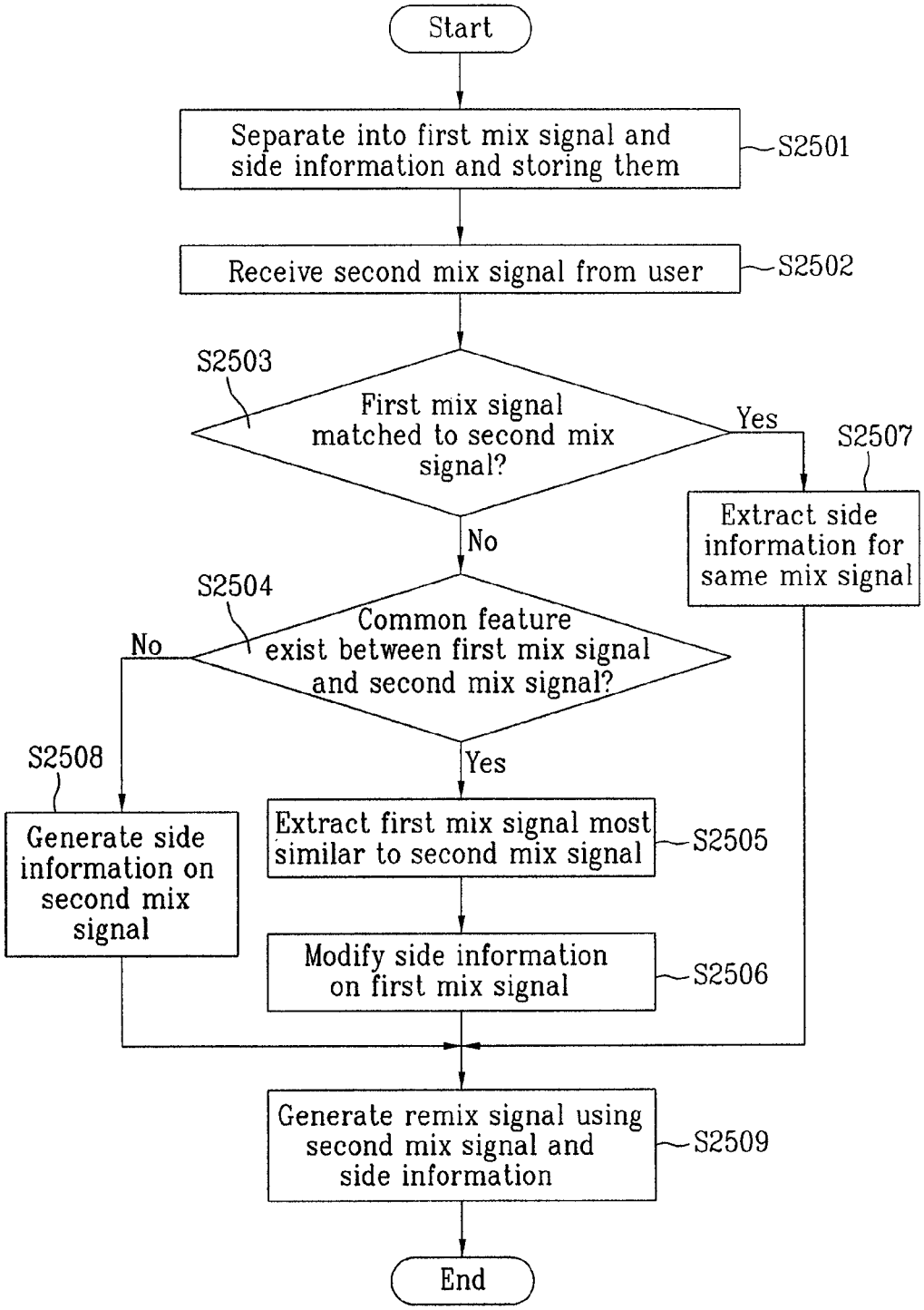
FIG. 25 is a flowchart for a method of generating a remix signal by extracting a mix signal and side information independently according to one embodiment of the present invention.

FIG. 25 is a flowchart for a method of generating a remix signal by extracting a mix signal and side information independently according to one embodiment of the present invention.

Referring to FIG. 25, a decoding device receives a first mix signal and side information on the first mix signal, separates them from each other, and then stored the separated signals (S2501). The decoding device receives a second mix signal from a user (S2502). The decoding device decides whether one of the first mix signals is identical to the second mix signal (S2503). If the first mix signal identical to the second mix signal is stored in the decoding device, the decoding device extracts side information on the first mix signal (S2507). And, the decoding device generates a remix signal using the second mix signal and the extracted side information (S2509). If any of the first mix signals is not identical to the second mix signal, the decoding device decides whether one of the first mix signals has a predetermined common feature with the second mix signal (S2504). If any of the first mix signals fails to have the predetermined common feature with the second mix signal, the decoding device directly generates side information on the second mix signal (S2508). And, the decoding device generates a remix signal using the second mix signal and the newly generated side information (S2509). If there exists the first mix signal having the predetermined common feature (e.g., bit rate, level, waveform, size, etc.) with the second mix signal, the decoding device extracts the first mix signal most similar to the second mix signal (S2505). The decoding device modifies the side information on the first mix signal into side information on the second mix signal (S2506). And, the decoding device generates a remix signal using the second mix signal and the modified side information (S2509).

Figure 26:
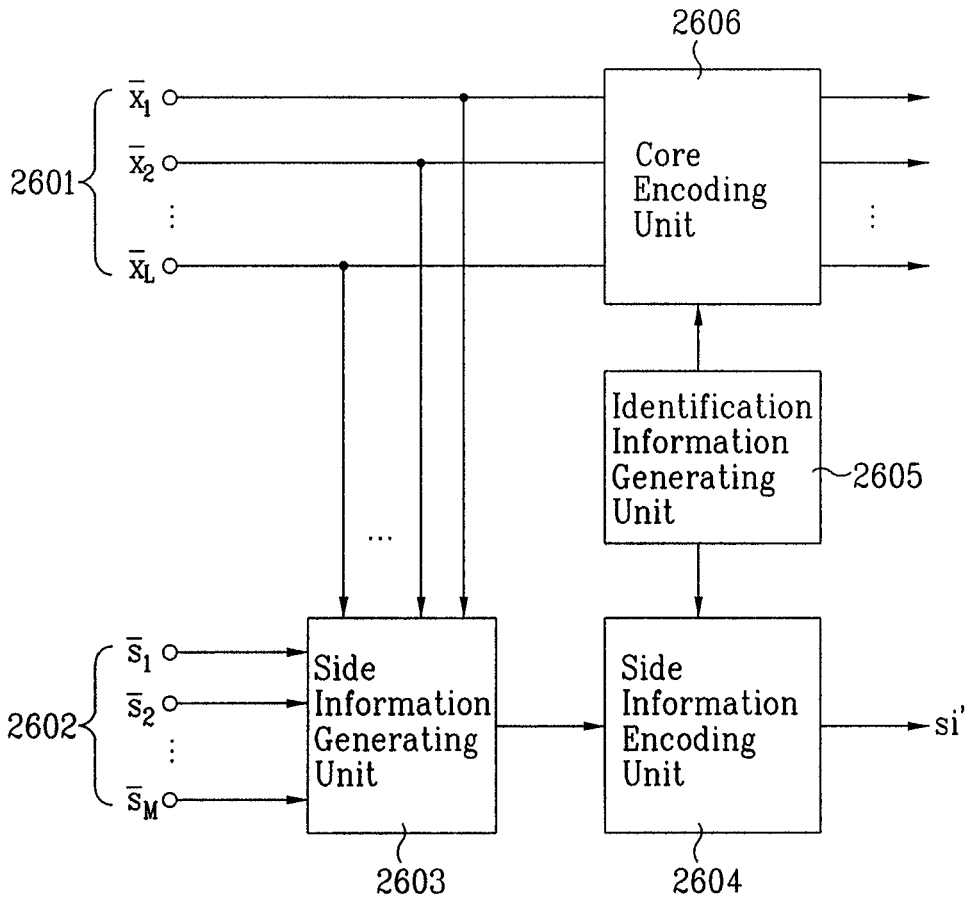
FIG. 26 is a block diagram of a twelfth signal processing apparatus according to one embodiment of the present invention.

FIG. 26 is a block diagram of a twelfth signal processing apparatus according to one embodiment of the present invention.

Referring to FIG. 26, a twelfth signal processing apparatus according to one embodiment of the present invention includes a side information generating unit 2603, an identification information generating unit 2605, a core encoding unit 2606, and a side information encoding unit 2604.

The side information generating unit 2603 generates side information from a mix signal 2601 and a source signal 2602. The identification information generating unit 2605 generates identification information. In this case, the identification information means the information given to each of the mix signal and the side information to indicate whether the mix signal and the die information are matched to each other. The identification information may be a random code generated randomly, a code including metadata of the mix signal 2601 or the source signal 2602, or a code generated from combining a random code and a metadata code together. In case that the identification code is the random code generated randomly, it may range from several-tens bits to several-thousands bits. In this case, the metadata may be the information including a composer, an album title, a phonograph record maker, a remixable musical instrument, and the like, by which implementations of the present invention are not restricted. The identification information can be inserted into the side information. So, the side information having the identification information inserted therein is independently usable.

The core encoding unit 1606 generates a mix signal ($\overline{x_1}'$, etc.) having the identification inserted therein by inserting the identification information generated by the identification information generating unit 2605 in the mix signal 2601. The side information encoding unit 2604 generates side information, in which the identification information is inserted, by inserting the identification information generated by the identification information generating unit 2605 into the side information.

Figure 27:
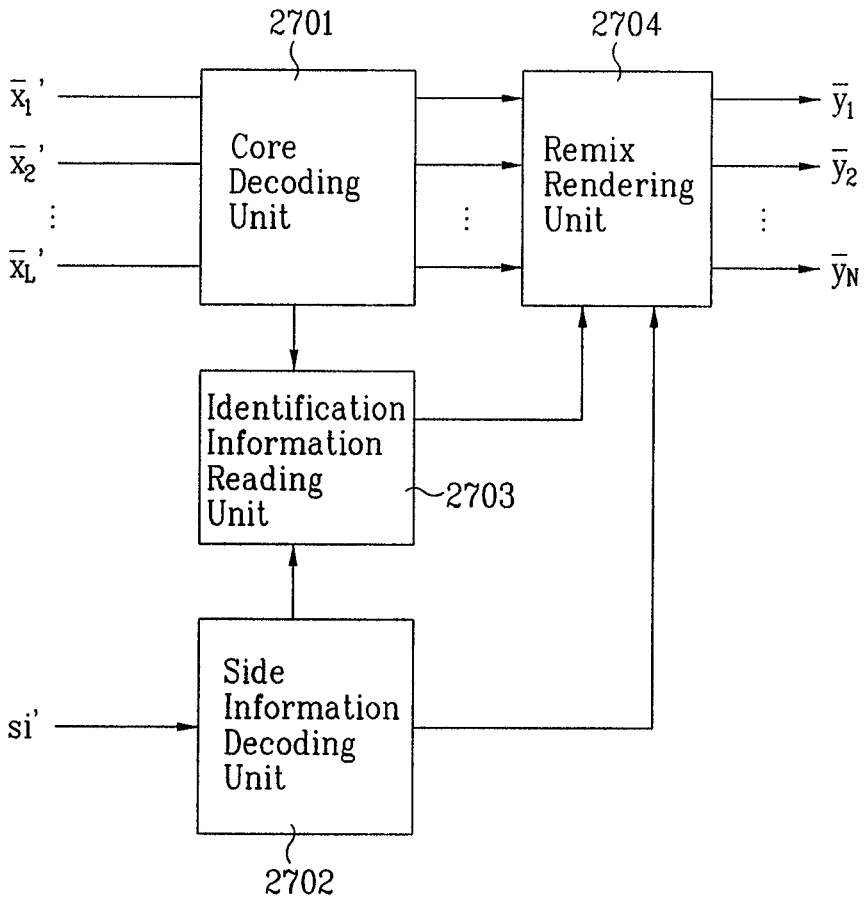
FIG. 27 is a block diagram of a thirteenth signal processing apparatus according to one embodiment of, the present invention.

FIG. 27 is a block diagram of a thirteenth signal processing apparatus according to one embodiment of the present invention.

Referring to FIG. 27, a thirteenth signal processing apparatus according to one embodiment of the present invention includes a code decoding unit 2701, a side information decoding unit 2702, an identification information reading unit, and a remix rendering unit 2704.

The core decoding unit 2701 extracts first identification information and the like from a mix signal ($\overline{x_1}'$, etc.). In this case, the mix signal ($\overline{x_1}'$, etc.) may be the signal that is generated from the core encoding unit 2606 of the twelfth signal processing apparatus explained with reference to FIG. 26. The side information decoding unit 2702 extracts second identification information from side information (si'). In this case, the side information (si') may be the information that is generated by the side information encoding unit 2604 of the twelfth signal processing apparatus explained with reference to FIG. 26.

The identification information reading unit 2703 decides whether the first identification information extracted by the core decoding unit 2701 and the second identification information extracted by the side information decoding unit 2702 are matched to each other. As a result of the decision, the identification information reading unit 2703 generates a control signal. If the first and second identification informations are not matched to each other, the identification information reading unit 2703 can generate a control signal indicating 'non-playable'. If the first and second identification informations are matched to each other, the identification information reading unit 2703 can generate a control signal indicating 'playable'.

The remix rendering unit 2704 generates a remix signal using side information in accordance with the control signal generated by the identification information reading unit 2703. In this case, the side information may be the information decoded by the side information decoding unit 2702 and the mix signal may be the signal decoded by the core decoding unit 2701. Thus, in generating the remix signal, the remix rendering unit 2704 is able to generate a remix signal ($\overline{y_1}$, etc.) by performing remixing per a source configuring a source signal.

Figure 28:
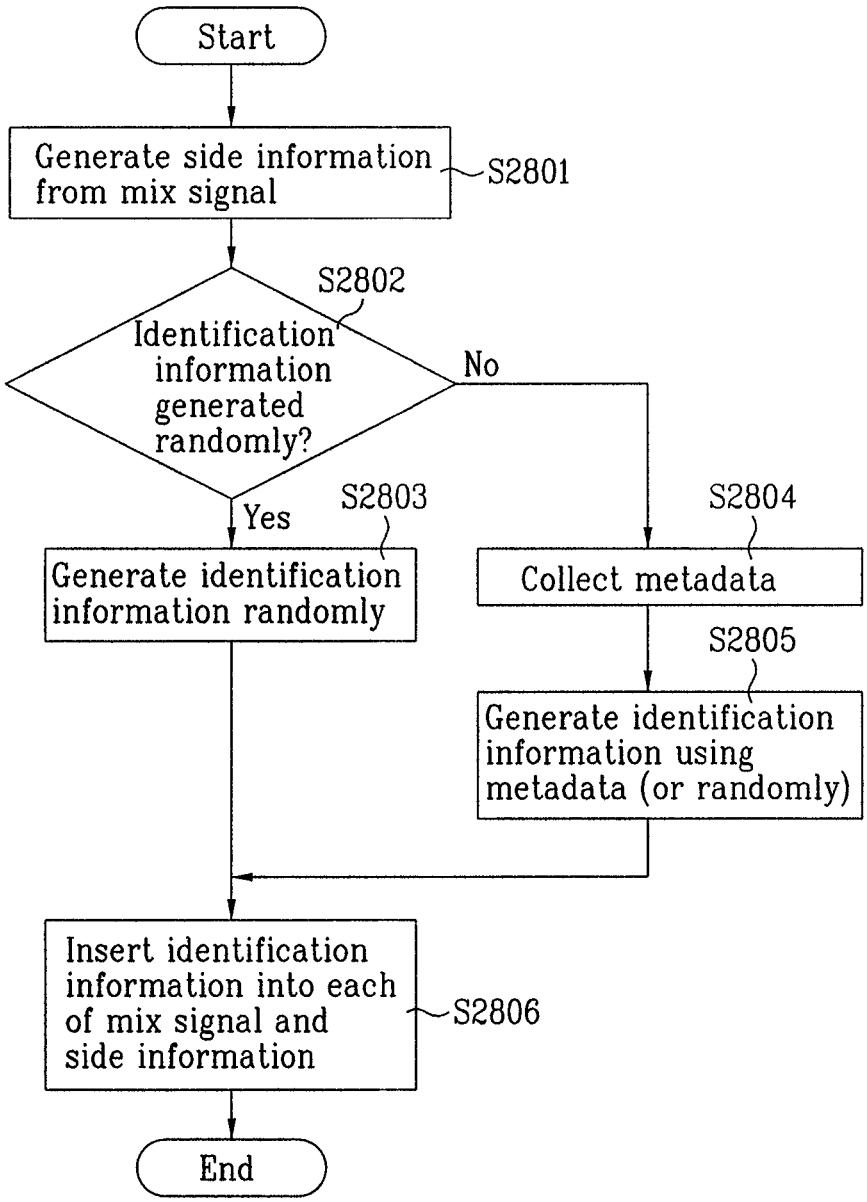
FIG. 28 is a flowchart of a signal processing method according to one embodiment of the present invention.

FIG. 28 is a flowchart of a signal processing method according to one embodiment of the present invention. A sequence of a signal processing method shown in FIG. 28 can be implemented by the twelfth signal processing apparatus shown in FIG. 26.

Referring to FIG. 28, first of all, side information is generated using a mix signal and a source signal (S2801). Subsequently, it is decided whether identification information will be generated randomly (S2802). If it is decided that the identification information will be generated randomly ('yes' in the step S2802), the identification information is generated by generating a code randomly (S2803).

On the contrary, if it is decided that the identification information will not be generated randomly ('no' in the step S2802), metadata (e.g., a composer, an album title, a phonograph record maker, a remixable musical instrument, etc.) of the mix signal or the source signal is collected or obtained (S2804). The metadata can be collected or obtained in a manner of being extracted from the mix signal or being provided by an accessed information providing server. Alternatively, the metadata can be collected or obtained in various ways. Subsequently, identification information is generated using the metadata collected in the step S2804 (S2805). In this case, the random code randomly generated in the step S2803 and the identification information generated in the step S2805 can be combined together. Finally, the identification information generated in the step S2803 and the identification information generated in the step S2805 are inserted in the mix signal and the side information, respectively (S2806).

Figure 29:
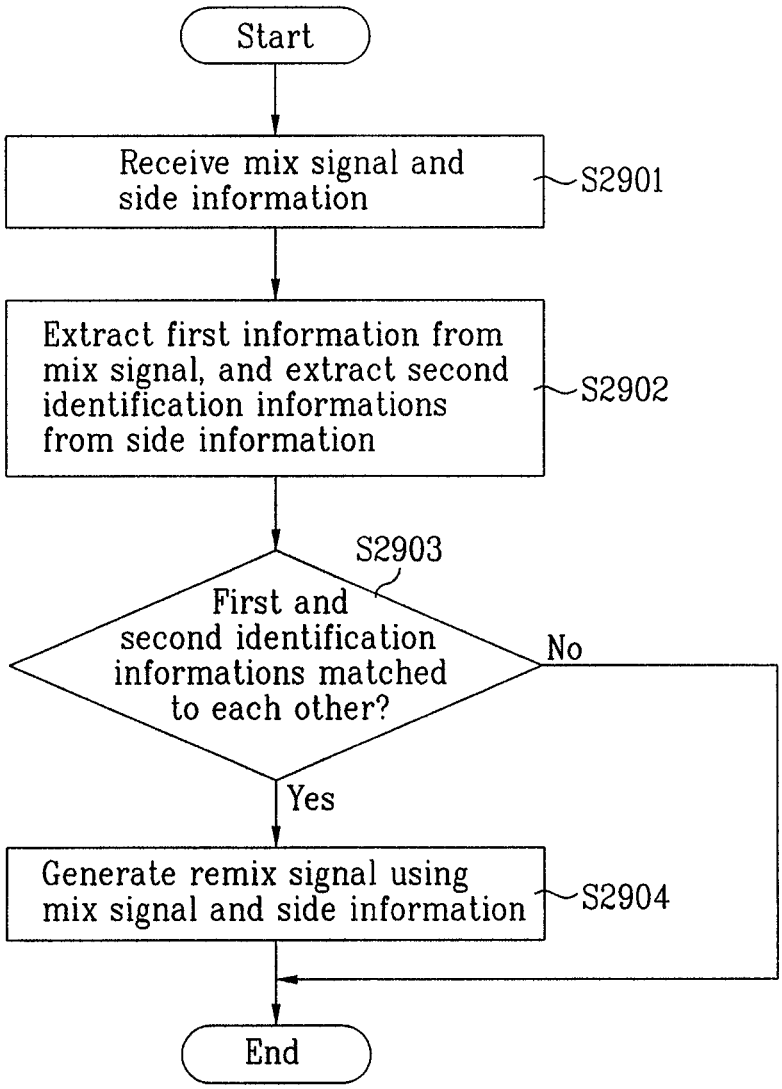
FIG. 29 is a flowchart of a signal processing method according to one embodiment of the present invention.

FIG. 29 is a flowchart of a signal processing method according to one embodiment of the present invention. A sequence of a signal processing method shown in FIG. 29 can be implemented by the thirteenth signal processing apparatus shown in FIG. 27.

Referring to FIG. 29, first of all, a mix signal and side information are received (S2901). In this case, the mix signal may be the signal including identification information and the side information may be the information including identification information. Subsequently, first identification information is extracted from the mix signal received in the step S2901 and second identification information is extracted from the side information received in the step S2901 (S2902). It is then decided whether the first identification information extracted in the step S2902 and the second identification information extracted in the step S2902 are matched to each other (S2903). If the first identification information and the second identification information are not matched to each other, it is decided that the mix signal and the side information are not matched to each other. Hence, the procedure is ended ('no' in the step S2903). As a result of the decision made in the step S2903, if the first identification information and the second identification information are matched to each other ('yes' in the step S2903), it is decided that the mix signal and the side information are matched to each other. Hence, a remix signal is generated using the side information (S2904). In particular, the step S2904 may be the step of generating a remix signal by performing remixing per a source configuring a source signal.

Figure 30:
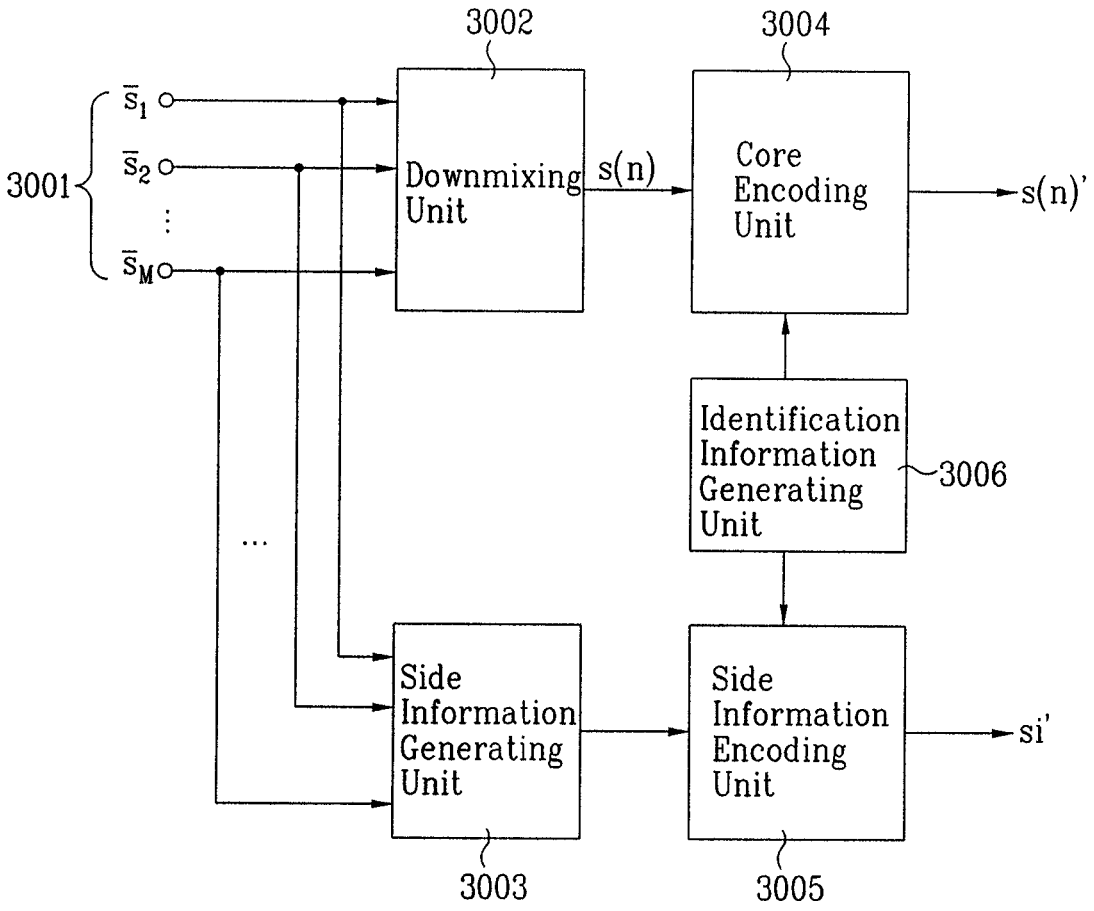
FIG. 30 is a block diagram of a fourteenth signal processing apparatus according to one embodiment of the present invention.

FIG. 30 is a block diagram of a fourteenth signal processing apparatus according to one embodiment of the present invention. Differences between a fourteenth signal processing apparatus according to one embodiment of the present invention and the twelfth signal processing apparatus explained with reference to FIG. 26 are schematically explained as follows.

First of all, in the twelfth signal processing apparatus, the side information is generated from the mix signal 2601 and the source signal 2602. On the other hand, in the fourteenth signal processing apparatus shown in FIG. 30, a source signal 3001 is downmixed by a downmixing unit 3002 to generate a sum signal. And, side information is extracted in the course of downmixing the source signal 3001. The fourteenth signal processing apparatus is explained in detail with reference to FIG. 30 as follows.

Referring to FIG. 30, the fourteenth signal processing apparatus includes a downmixing unit 3001, a side information generating unit 3003, an identification information generating unit 3006, a core encoding unit 3004, and a side information encoding unit 3005.

The downmixing unit 3002 generates a sum signal S(n) by downmixing a source signal 3001 constructed with at least one source. The downmixing unit 3001 performs the almost same function of the former downmixing unit 402 explained with reference to FIG. 4. The side information generating unit 3003 generates side information from the source signal 3001 constructed with at least one source. In this case, the side information may include subband power and gain factor corresponding to each source signal or a parameter corresponding to a delay in a remix rendering unit.

The identification information generating unit 3006 is an element for generating identification information. The identification information generating unit 3006 is almost similar to the former identification information generating unit 2605 shown in FIG. 26, of which details will be omitted in the following description. The core encoding unit 3004 generates a sum signal S(n)' containing the identification information by inserting the identification information generated by the identification information generating unit 3006 into a sum signal S(n). And, the side information encoding unit 3005 generates side information Si' containing the identification information by inserting the identification information generated by the identification information generating unit 3006 into the side information.

Figure 31:
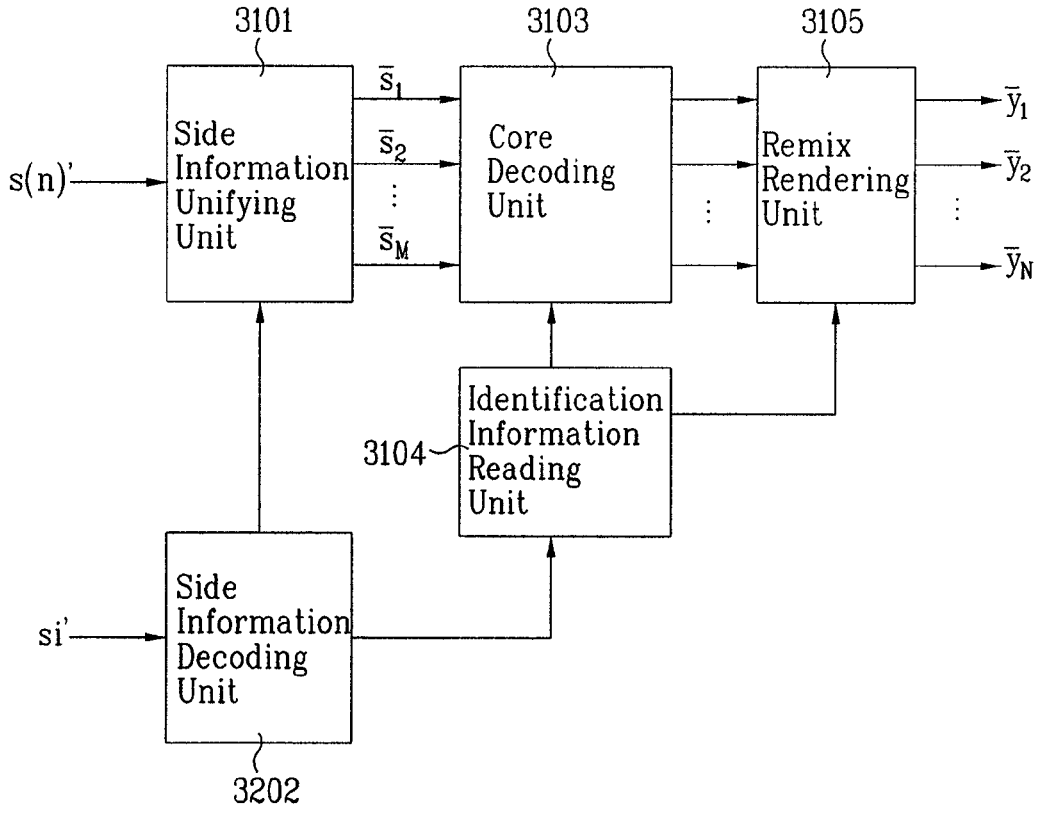
FIG. 31 is a block diagram of a fifteenth signal processing apparatus according to one embodiment of the present invention.

FIG. 31 is a block diagram of a fifteenth signal processing apparatus according to one embodiment of the present invention. First of all, a fifteenth signal processing apparatus according to one embodiment of the present invention just differs from the thirteenth signal processing apparatus explained with reference to FIG. 27 in receiving a sum signal S(n)' containing identification information instead of receiving a mix signal containing identification information and side information and separating the received sum signal S(n)' into source signals via a side information unifying unit 3101.

Referring to FIG. 31, the fifteenth signal processing apparatus includes a side information unifying unit 3101, a core decoding unit 3103, a side information decoding unit 3102, an identification information reading unit 3104, and a remix rendering unit 3105.

The side information unifying unit 3101 receives a sum signal S(n)' and separates the received signal into at least one source signal ($\overline{s_i}$) (i.e., source signals) using side information decoded by the side information decoding unit 3102. And, the side information unifying unit 3101 performs the almost same function of the former side information unifying unit 705 explained with reference to FIG. 7.

The core decoding unit 3103 extracts first identification information from the at least one source signal ($\overline{s_i}$).

The side information decoding unit 3102 extracts second identification information from the side information.

The identification information reading unit 3104 decides whether the first identification information extracted by the core decoding unit 3103 and the second identification information extracted by the side information decoding unit 3102 are matched to each other and then generates a control signal. And, the remix rendering unit 3105 generates a source signal using the side information in accordance with the control signal generated by the identification information reading unit 3104. Thus, in playing back a source signal, it is able to generate a remix signal ($\overline{y_1}$, etc.) by performing remixing on each source (each source signal) configuring the source signal.

Figure 32:
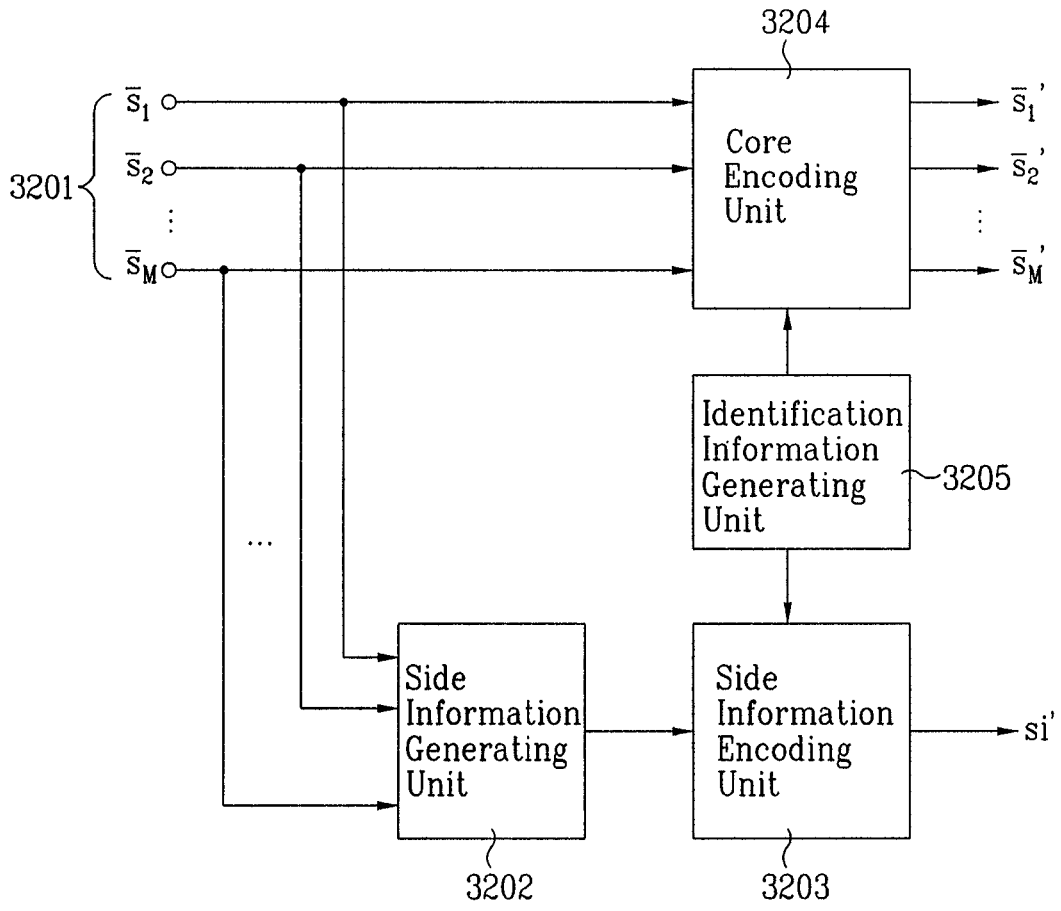
FIG. 32 is a block diagram of a sixteenth signal processing apparatus according to one embodiment of the present invention.

FIG. 32 is a block diagram of a sixteenth signal processing apparatus according to one embodiment of the present invention. A difference between a sixteenth signal processing apparatus according to one embodiment of the present invention and the fourteenth signal processing apparatus explained with reference to FIG. 30 is explained as follows. First of all, in the fourteenth signal processing apparatus, the source signal 3001 is downmixed by the downmixing unit 3002 to generate the sum signal. On the other hand, in the sixteenth signal processing apparatus, identification information is intactly inserted without downmixing a source signal 3201. The difference from the fourteenth signal processing unit is mainly explained with reference to FIG. 32 as follows.

Referring to FIG. 32, the fourteenth signal processing apparatus includes a side information generating unit 3202, an identification information generating unit 3205, a core encoding unit 3204, and a side information encoding unit 3203. The side information generating unit 3202, the identification information generating unit 3205 and the side information encoding unit 3203 are almost identical to the former side information generating unit 3003, the former identification information generating unit 3006 and the former side information encoding unit 3005 explained with reference to FIG. 30, respectively, of which details will be omitted in the following description.

The core encoding unit 3204 inserts identification into at least one source (i.e., source signal ( )) of a source signal 3201 constructed with a plurality of sources.

Figure 33:
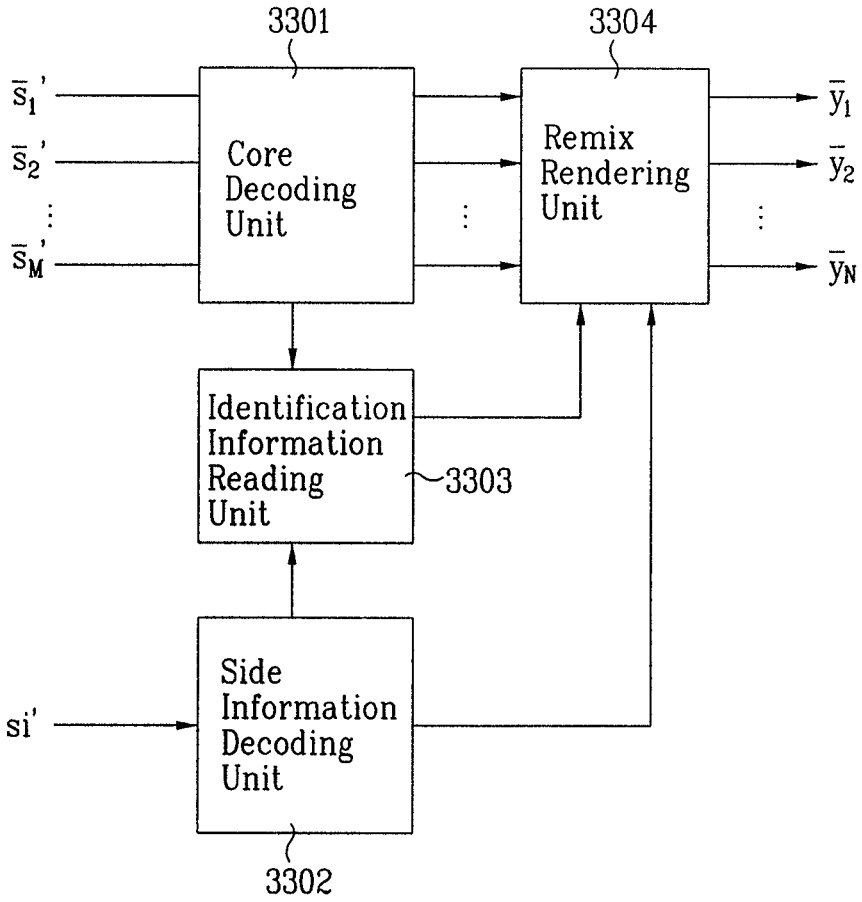
FIG. 33 is a block diagram of a seventeenth signal processing apparatus according to one embodiment of the present invention.

FIG. 33 is a block diagram of a seventeenth signal processing apparatus according to one embodiment of the present invention. A difference between a seventeenth signal processing apparatus according to one embodiment of the present invention and the fifteenth signal processing apparatus explained with reference to FIG. 31 is explained as follows.

First of all, in the fifteenth signal processing apparatus, the sum signal S(n) is separated into individual source signals by the side information unifying unit 3101. On the other hand, in the seventeenth signal processing unit, since an individual source signal 3301 is received instead of a sum signal S(n), a side information unifying unit is not included in the seventeenth signal processing apparatus.

Referring to FIG. 33, the seventeenth signal processing apparatus includes a core decoding unit 3301, a side information decoding unit 3302, an identification information reading unit 3307, and a remix rendering unit 3308, which are almost identical to the former core decoding unit 3103, the former side information decoding unit 3102, the former identification information reading unit 3104 and the former remix rendering unit 3105 shown in FIG. 31, respectively. So, relevant details will be omitted in the following description.

Figure 34:
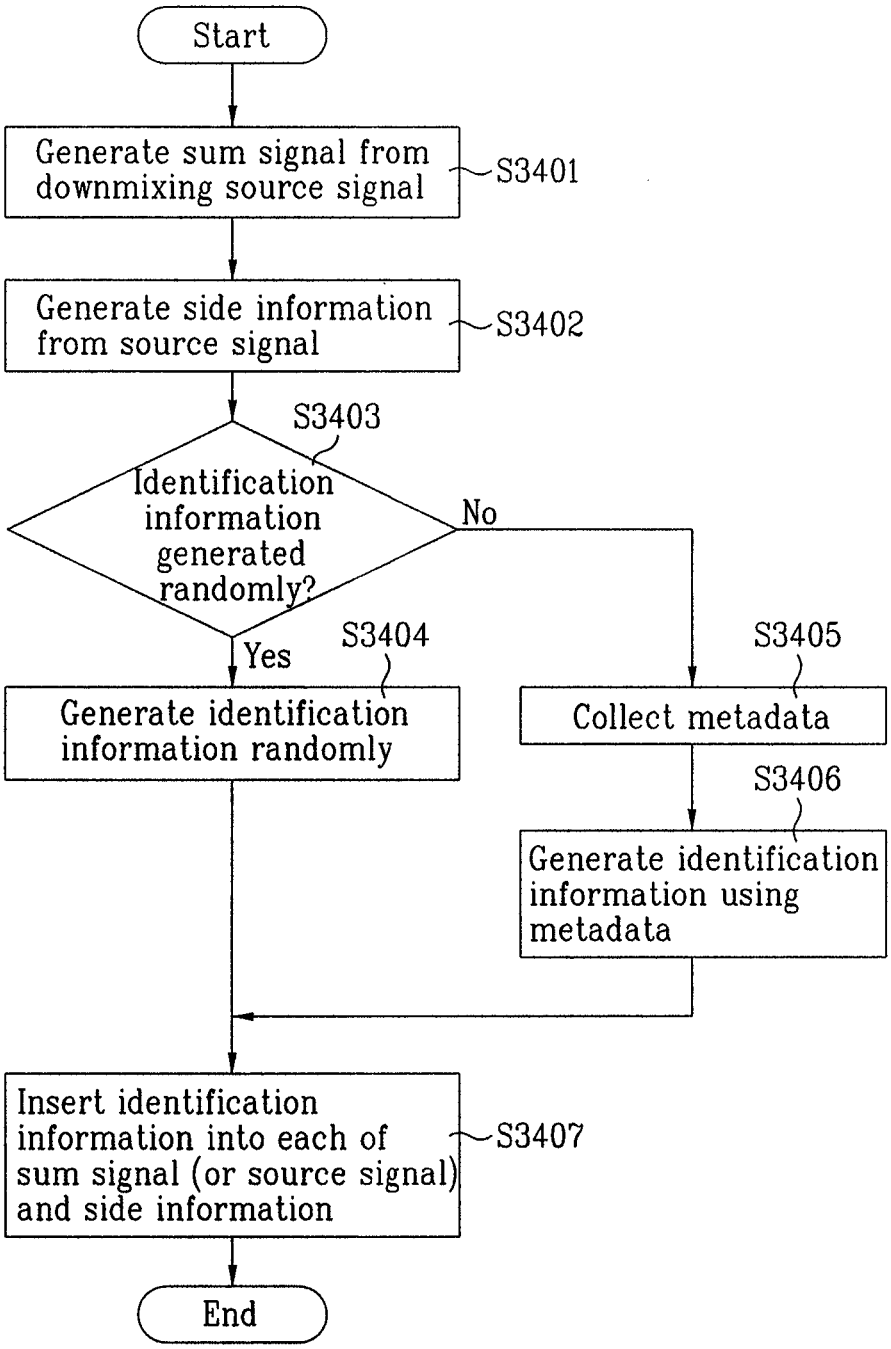
FIG. 34 is a flowchart of a signal processing method according to one embodiment of the present invention.

FIG. 34 is a flowchart of a signal processing method according to one embodiment of the present invention. First of all, a signal processing method shown in FIG. 34 can be implemented by the fourteenth/sixteenth signal processing apparatus shown in FIG. 30/32.

Referring to FIG. 34, first of all, a sum signal is generated by downmixing at least one source signal (S3401) (corresponding to a case of a second example only). Subsequently, side information is generated using the at least one source signal in the step S3401 (S3402). Steps S3403 to S3406 identical to the former steps S2802 to S2805 explained with reference to FIG. 28 are then executed. Finally, identification information generated in the step S3404 and identification information generated in the step S3406 are inserted into the sum signal (at least one source signal in case of a third example) and side information, respectively (S3407).

Figure 35:
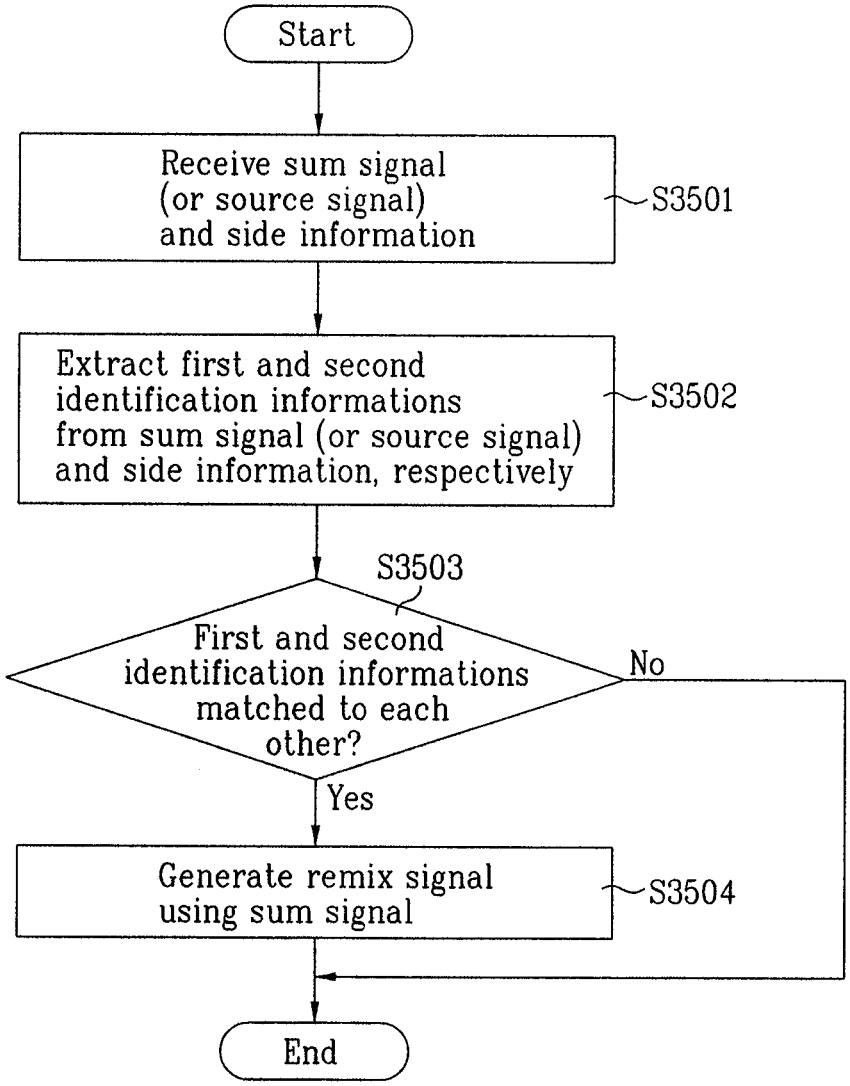
FIG. 35 is a flowchart of a signal processing method according to one embodiment of the present invention.

FIG. 35 is a flowchart of a signal processing method according to one embodiment of the present invention. First of all, a signal processing method shown in FIG. 35 can be implemented by the fifteenth/seventeenth signal processing apparatus shown in FIG. 31/33.

Referring to FIG. 35, a sum signal (at least one source signal in case of a third example) and side information are received (S3501). Subsequently, first identification information is extracted from the sum signal (or at least one source signal) and second identification information is extracted from the side information (S3502). The sum signal is then played back on the condition that the first identification information and the second identification information are matched to each other ('no' in step S3503). Thus, in reproducing a source signal, it is able to generate a remix signal in a manner of performing remixing per a source (each source signal) constructing the source signal.

Figure 36:
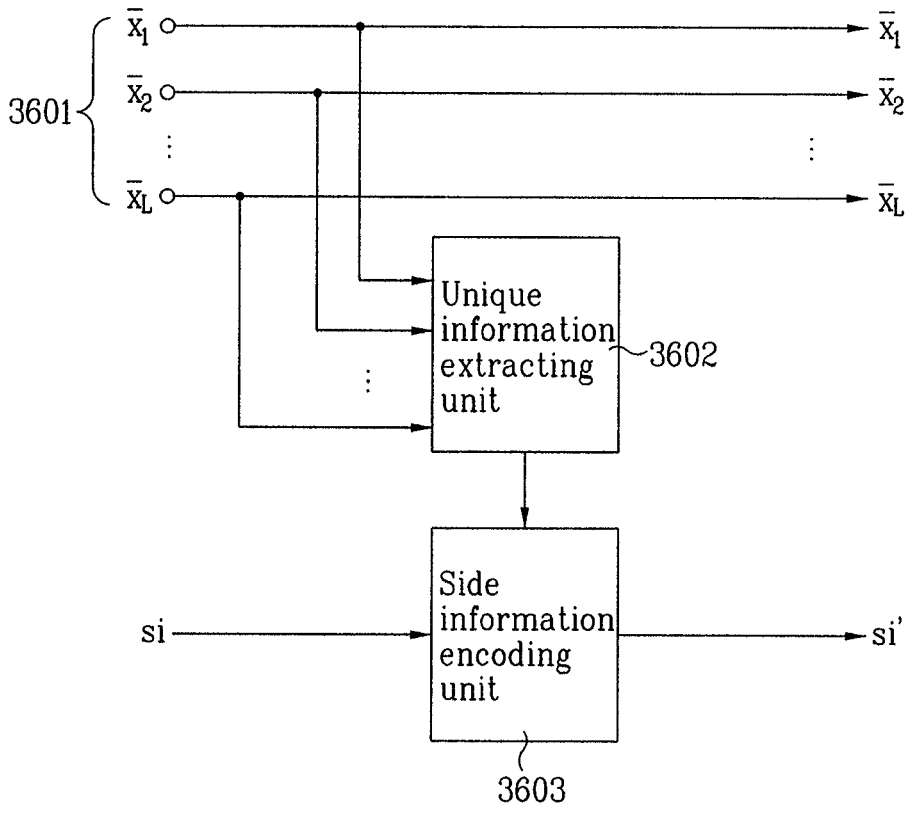
FIG. 36 is a block diagram of an eighteenth signal processing apparatus according to one embodiment of the present invention.

FIG. 36 is a block diagram of an eighteenth signal processing apparatus according to one embodiment of the present invention. In an eighteenth signal processing apparatus according to one embodiment of the present invention, prescribed information is inserted into side information only without inserting any information into a mix signal (sum signal or source signal).

Referring to FIG. 36, an eighteenth signal processing apparatus according to one embodiment of the present invention includes a unique information extracting unit 3702 and a side information encoding unit 3603.

The unique information extracting unit 3602 extracts unique information from a mix signal 3601 (sum signal or source signal). In this case, the unique information is the information that retains a unique signal appearing on a specific mix signal only to discriminate the mix signal from other signals. For instance, the unique information includes a value of a sample in a specific section of a mix signal. Alternatively, the unique information includes a sample length and a value of a sample in a specific section of a mix signal. And, the unique information can be implemented in various ways. For instance, assuming that unique information includes 'length of sample' and 'values of three consecutive samples from a point corresponding to 3 seconds from the beginning', if a sampling frequency of a mix signal is 44.1 KHz, in case of a music having a total time 3:12.45, a length of sample is calculated by Formula 24.

$$(3*60+12.45)\ [\text{sec}]*44100[1/\text{sec}]=8487045 \qquad \text{[Formula 24]}$$

If a value of a first sample among three samples from a point corresponding to 3 seconds from the beginning is 50(L1) and 196(R1), if a value of a second sample is 5421(L2) and 4515(R2), and if a value of a third sample is 18542(L3) and 15487(R3), unique information can become '8487045, 50(L1), 196(R1), 5421(L2), 4515(R2), 18542(L3), 15487 (R3)' resulting from combining sample lengths and sample values together.

And, the side information encoding unit 3603 generates side information (si') containing the unique information by inserting the unique information of the specific mix signal 3601 extracted by the unique information extracting unit 3602 into side information (si) corresponding to the mix signal.

Figure 37:
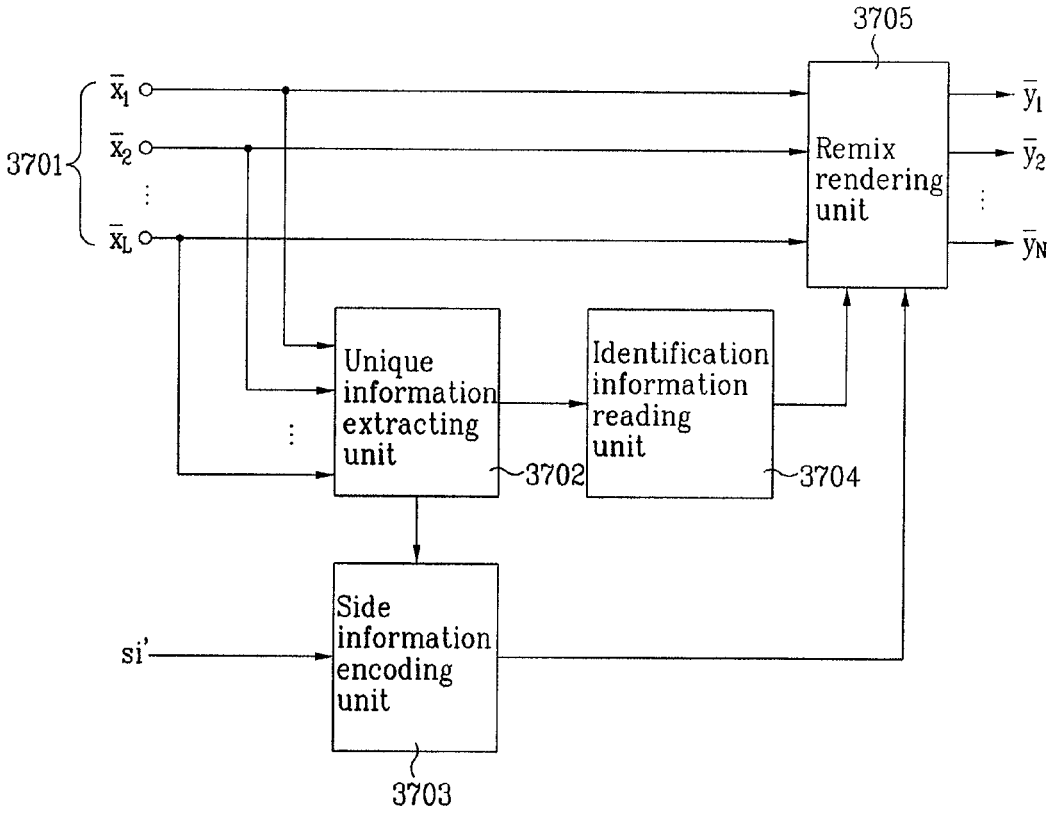
FIG. 37 is a block diagram of a nineteenth signal processing apparatus according to one embodiment of the present invention.

FIG. 37 is a block diagram of a nineteenth signal processing apparatus according to one embodiment of the present invention.

Referring to FIG. 37, a nineteenth signal processing apparatus according to one embodiment of the present invention includes a unique information extracting unit 3702, a side information encoding unit 3703, an identification information reading unit 3704, and a remix rendering unit 3705.

The unique information extracting unit 3702 extracts first unique information for a mix signal (sum signal or source signal). The first unique information can be extracted by the same method of extracting the unique information in the former unique information extracting unit 3602 of the encoding device shown in FIG. 36. The side information encoding unit 3703 extracts second unique information from side information (si') containing unique information. The identification information reading unit 3704 generates a control signal by deciding whether the first unique information extracted by the unique information extracting unit 3702 and the second unique information extracted by the side information encoding unit 3703 are matched to each other. And, the remix rendering unit 3705 reproduces the mix signal (sum signal or source signal) using side information in accordance with the control signal generated by the identification information reading unit 3704.

Figure 38:
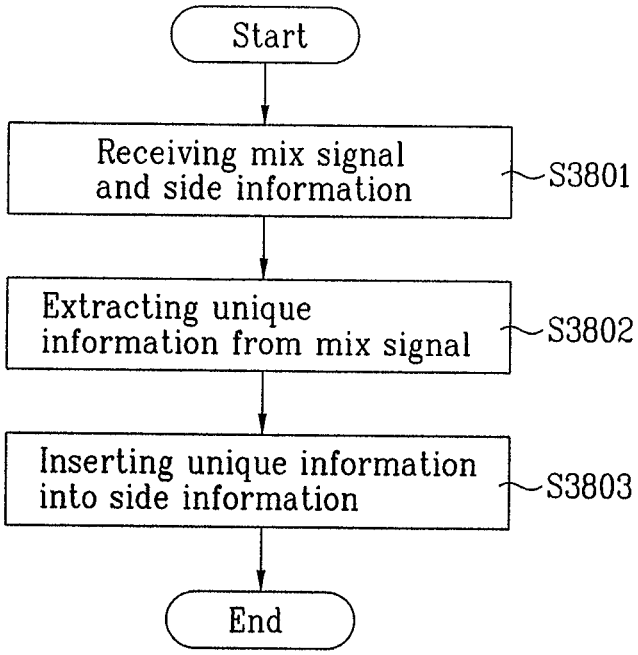
FIG. 38 is a flowchart of a signal processing method according to one embodiment of the present invention.

FIG. 38 is a flowchart of a signal processing method according to one embodiment of the present invention, which can be implemented by the eighteenth signal processing apparatus shown in FIG. 36.

Referring to FIG. 38, first of all, a mix signal (sum signal or source signal) and side information are received (S3801). Subsequently, unique information is extracted from the mix signal (sum signal or source signal) received in the step S3801 (S3802). The unique information extracted in the step S3802 is then inserted into the side information received in the step S3801 (S3803).

Figure 39:
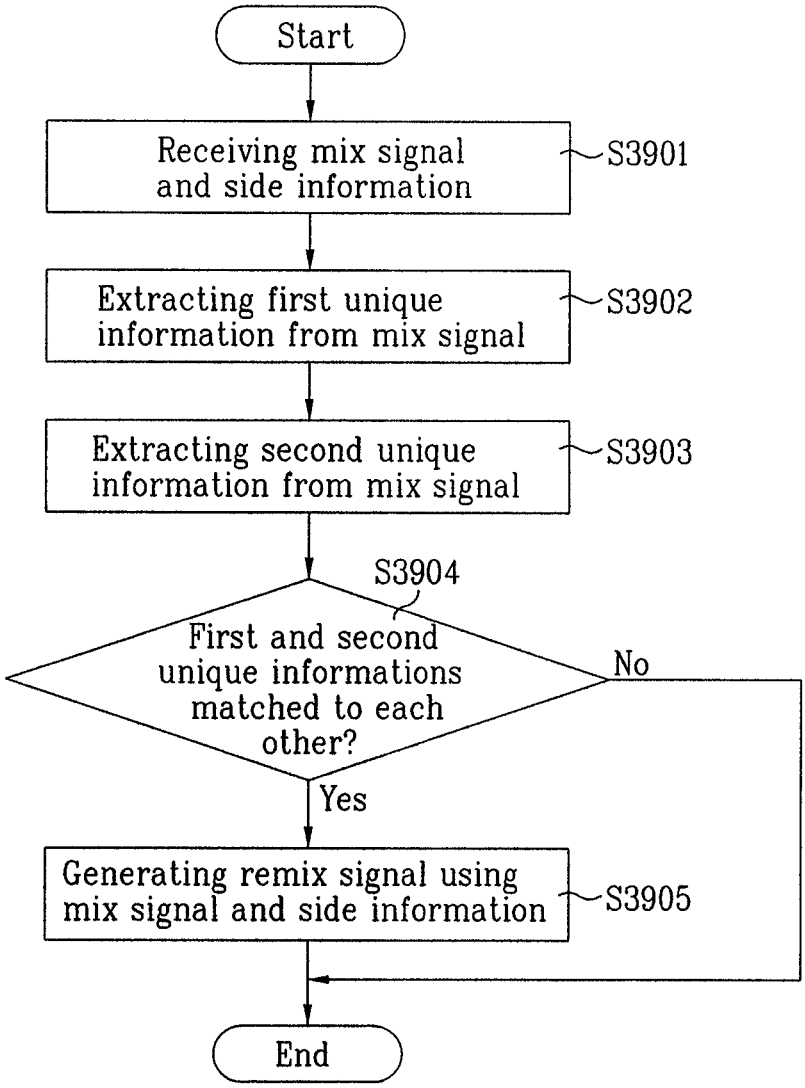
FIG. 39 is a flowchart of a signal processing method according to one embodiment of the present invention.

FIG. 39 is a flowchart of a signal processing method according to one embodiment of the present invention, which can be implemented by the eighteenth signal processing apparatus shown in FIG. 37.

Referring to FIG. 39, first of all, a mix signal (sum signal or source signal) and side information are received (S3901).

Subsequently, first unique information is extracted from the mix signal (sum signal or source signal) received in the step S3801 (S3902). And, second unique information is extracted from the side information received in the step S3801 (S3903). It is then decided whether the first unique information received in the step S3902 and the second unique information received in the step S3903 are matched to each other. If they are matched ('yes' in S3904), the mix signal (sum signal or source signal) are reproduced using the side information (S3905). Of course, in reproducing the mix signal (sum signal or source signal), it is able to generate a remix signal by performing remixing per a source configuring a source signal.

Figure 40:
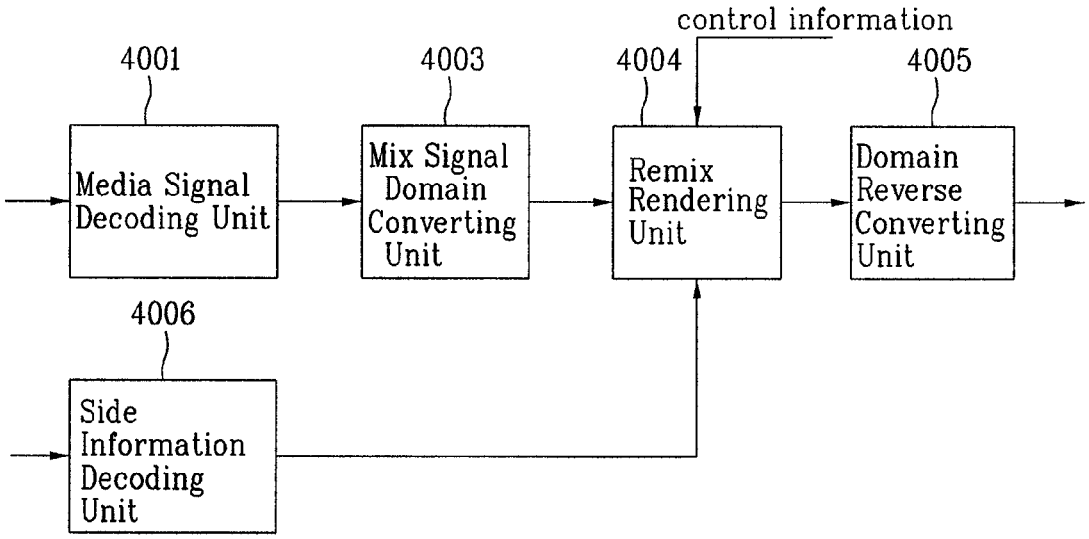
FIG. 40 is a block diagram of a twentieth signal processing apparatus according to one embodiment of the present invention.

FIG. 40 is a block diagram of a twentieth signal processing apparatus according to one embodiment of the present invention.

Referring to FIG. 40, a twentieth signal processing apparatus according to one embodiment of the present invention includes a mix signal decoding unit 4001, a mix signal domain converting unit 4003, a side information decoding unit 4006, and a remix rendering unit 4004. The twentieth signal processing apparatus receives a mix signal and side information from an encoding device. In this case, the side information includes level information, time delay information, cross-correlation information, mix information, and the like.

In particular, the level information may include a relative level between source signals to be remixed or a relative level between source and mix signals to be remixed together. And, a level of a mix signal can be separately included in side information. The time delay information may include time delay information between source signals to be remixed or time delay information between source and mix signals to be remixed together. The cross-correlation information may include cross-correlation information between source signals to be remixed, cross-correlation information between source and mix signals to be remixed together, and cross-correlation information between mix signals. And, the mix information indicates an extent that a specific source is mixed in a mix signal. For instance, in case of attempting to mix to bring an effect that a specific source is located at a right side, it is able to perform mixing in a manner that a size of a right channel is set greater than that of a left channel. Thus, the mix information is able to indicate an extent that each source is mixed in each channel. Besides, the mix information can include information on a time delay relevant to a mix, information on correlation, and the like as well as a size.

The decoding device may receive a mix signal and side information from the same encoding device or can receive a mix signal and side information from encoding devices separate from each other, respectively. In case that an encoding device transports a mix signal and side information in a single bit stream form to a decoding device, the decoding device demultiplexes the bit stream to send the mix signal and the side information to the mix signal decoding unit 4001 and the side information decoding unit 4006, respectively.

The mix signal decoding unit 4006 decodes the encoded mix signal. The twentieth signal processing apparatus is able to generate a remix signal using a mix signal and side information in a subband domain. The mix signal domain converting unit 4003 converts a domain of the mix signal to the same subband domain as the domain of the side information. The side information decoding unit 4006 decodes the side information and then sends the decoded side information to the remix rendering unit 4004. The remix rendering unit 4004 receives a mix signal having the same subband domain of the side information from the mix signal domain converting unit 4003 and also receives the side information in the subband domain from the side information decoding unit 4006.

The remix rendering unit 4004 is provided with control information by a user and then generates a user-mix parameter using the control information. The remix rendering unit 4004 generates a remix signal using the mix signal and side information in the same domain and the user-mix parameter. Having reconstructed an original mix signal, the twentieth signal processing apparatus generates a remix signal by adjusting a source signal included in the original mix signal. Alternatively, without reconstructing an original mix signal, the twentieth signal processing apparatus directly generates a remix signal using side information and a user-mix parameter. And, a domain reverse converting unit 4005 converts a domain of the generated remix signal to an original domain, e.g., a time domain.

Figure 41:
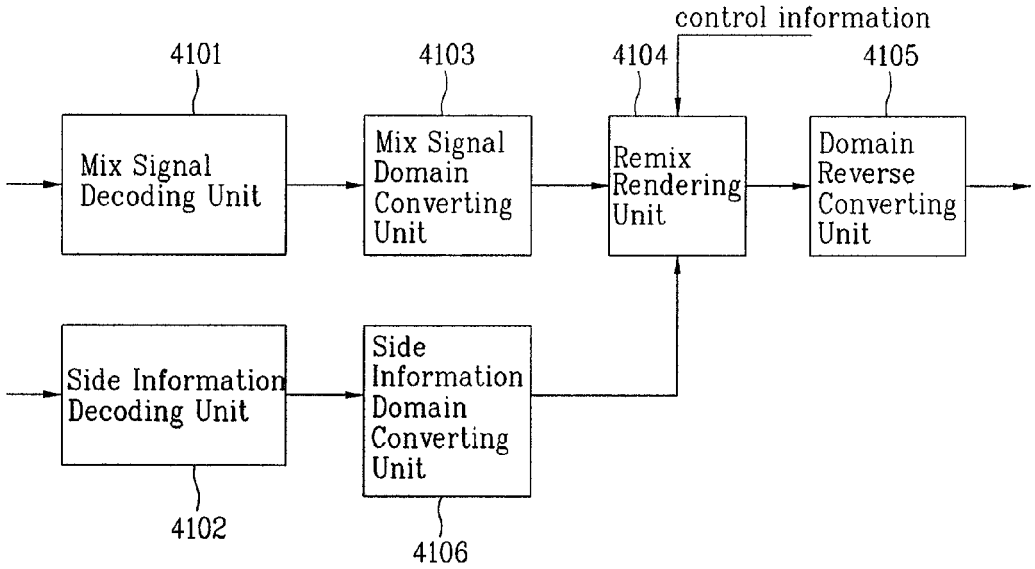
FIG. 41 is a block diagram of a twenty-first signal processing apparatus according to one embodiment of the present invention.

FIG. 41 is a block diagram of a twenty-first signal processing apparatus according to one embodiment of the present invention. An embodiment shown in FIG. 41 is characterized in that domains of a mix signal and side information are respectively converted to coincide with each other. This is different from the former embodiment shown in FIG. 40 which is characterized in performing a domain conversion on a mix signal only.

Referring to FIG. 41, a twenty-first signal processing apparatus according to one embodiment of the present invention includes a mix signal decoding unit 4101, a side information decoding unit 4102, a mix signal domain converting unit 4103, a side information domain converting unit 4106, and a remix rendering unit 4104.

The mix signal decoding unit 4101 extracts a mix signal, which is received from an encoding device or was stored previously, and then decodes the extracted mix signal. The side information decoding unit 4102 extracts side information, which is received from the encoding device or was previously generated and stored in a decoding device, and then decodes the extracted side information. The mix signal and the side information can be received from the same encoding device or may be separately received from different devices, respectively. And, the side information can be directly generated by the decoding device. The side information decoding unit 4102 decodes the side information.

The mix signal domain converting unit 4103 and the side information domain converting unit 4106 convert domains of the mix signal and the side information to the same domain, e.g., a QMF domain, respectively. For instance, it is assumed that mix signal and side information are signals in MDCT and QMF domains, respectively. For subband coding, a band is divided by a filter bank to make a low sampling frequency without causing aliasing. One of filters used for frequency division is a quadrature mirror filter (QMF). As another scheme for frequency division with high efficiency by canceling out aliasing is MDCT (modified discrete cosine transform). The MDCT is a scheme for transforming 512 samples into a frequency signal from a time signal, at a time. So, it is able to considerably reduce a multiplication count and the like using fast algorithm such as FFT. A signal in QMF domain means a signal transformed by being frequency-divided by QMF, and a signal in MDCT domain means a signal transformed by being frequency-divided by MDCT. Hence, it is able to transform the mix signal and the side information into signals in the same domain in a manner of transforming the side information into the MDCT domain by the MDCT scheme, transforming the mix signal into the QMF domain by the QMF scheme, or the like.

The remix rendering unit 4104 generates a remix signal using the mix signal received from the mix signal domain converting unit 4103, the side information received from the side information domain converting unit 4106 in the same domain of the mix signal, and a user-mix parameter. And, a domain reverse converting unit 4105 converts a domain of the remix signal to a time domain for human perception and then outputs the corresponding signal.

Figure 42:
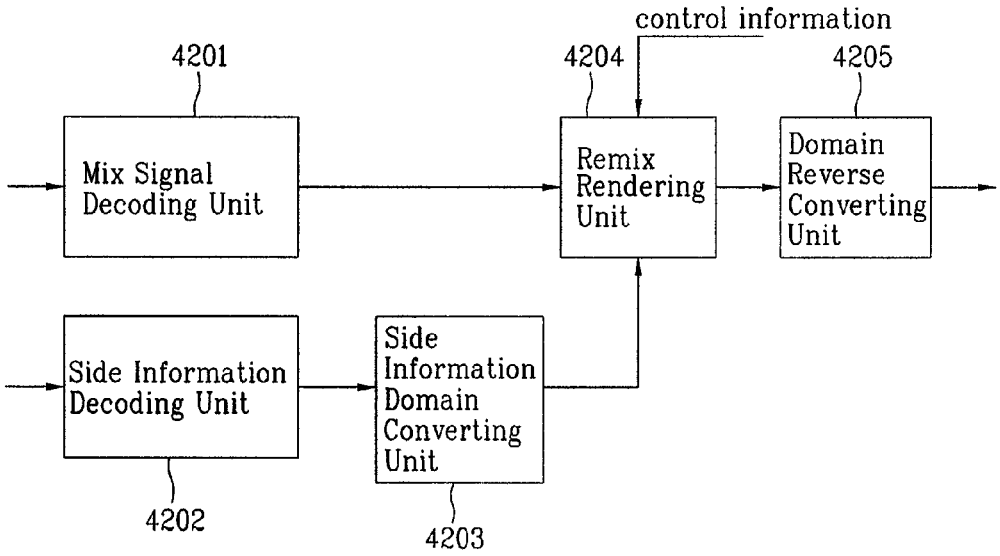
FIG. 42 is a block diagram of a twenty-second signal processing apparatus according to one embodiment of the present invention.

FIG. 42 is a block diagram of a twenty-second signal processing apparatus according to one embodiment of the present invention. Compared to the former embodiment shown in FIG. 40 or FIG. 41 in which the domain conversion is performed on the mix signal only, an embodiment shown in FIG. 42 differs from the former embodiment shown in FIG. 40 or FIG. 41 in that a domain of side information is converted only.

Referring to FIG. 42, a decoding device includes a mix signal decoding unit 4201, a side information decoding unit 4202, a side information domain converting unit 4203, and a remix rendering unit 4204.

In case that a mix signal differs from side information in domain, the twenty-second signal processing apparatus matches a domain of the mix signal and a domain of the side information to each other. For this, domain conversion is carried out both of the mix signal and the side information or the mix signal is transformed into the domain of the mix signal. Alternatively, the domain of the side information is converted to that of the mix signal by leaving the mix signal intact. Since an information size of the side information is smaller than that of the mix signal, an operation load in the domain conversion of the side information to the mix signal domain becomes smaller than the domain conversion of the mix signal to the side information domain. The mix signal decoding unit 4201 receives the mix signal, decodes the received mix signal, and then sends the decode signal to the remix rendering unit 4304. The side information decoding unit 4201 receives the side information and then decodes the received side information. The side information domain converting unit 4203 converts a domain of the side information to a same domain of the mix signal, e.g., a subband domain. And, the remix rendering unit 4204 generates a remix signal using the mix signal and side information in the same domain and a user-mix parameter.

Figure 43:
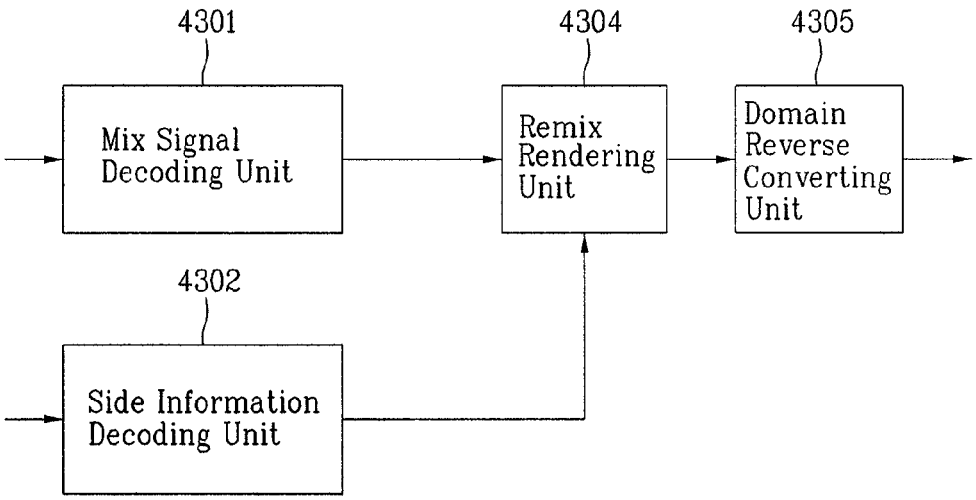
FIG. 43 is a block diagram of a twenty-third signal processing apparatus according to one embodiment of the present invention.

FIG. 43 is a block diagram of a twenty-third signal processing apparatus according to one embodiment of the present invention.

Referring to FIG. 43, a twenty-third signal processing apparatus according to one embodiment of the present invention includes a mix signal decoding unit 4301, a side information decoding unit 4302, and a remix rendering unit 4304. The decoding device receives a mix signal and side information. The mix signal decoding unit 4301 decodes the mix signal, and the side information decoding unit 4302 decodes the side information. Since domains of the mix signal and the side information are identical to each other, the decoding device does not perform separate domain conversion. And, the remix rendering unit 4304 generates a remix signal using the decoded mix signal, the decoded side information, and a user-mix parameter. As both of the mix signal and the side information are in the same domain, domain conversion is not carried out. Hence, complexity and an operation quantity or load required for the domain conversion can be reduced.

Figure 44:
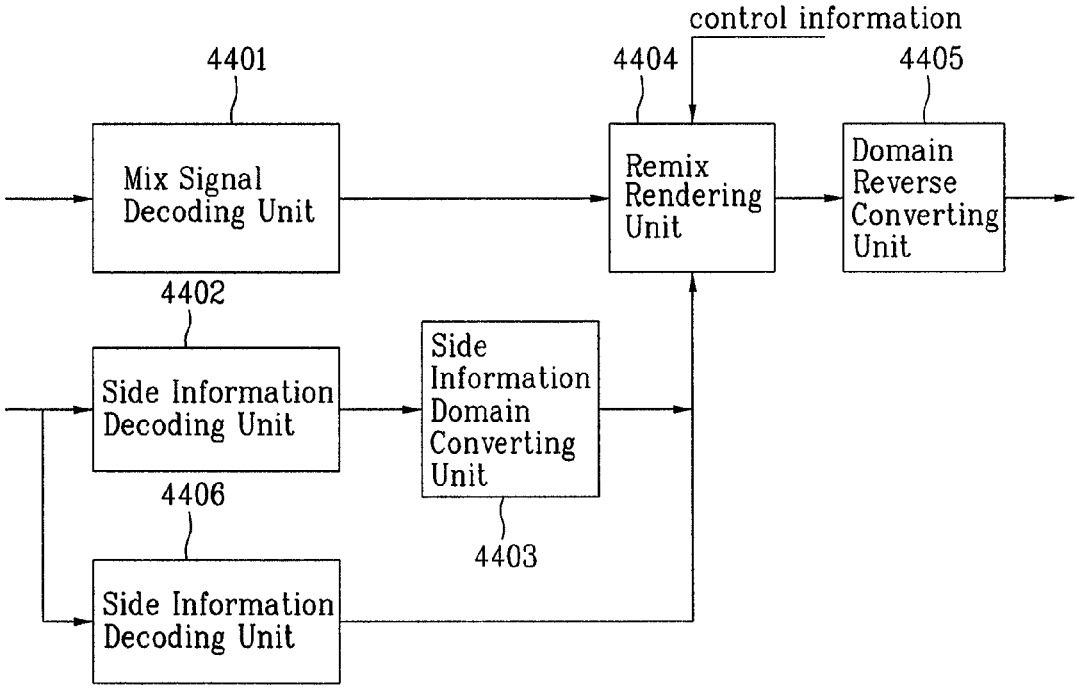
FIG. 44 is a block diagram of a twenty-fourth signal processing apparatus according to one embodiment of the present invention.

FIG. 44 is a block diagram of a twenty-fourth signal processing apparatus according to one embodiment of the present invention.

Referring to FIG. 44, a twenty-fourth signal processing apparatus according to one embodiment of the present invention includes a mix signal decoding unit 4401, side information decoding units 4405 and 4402, a side information domain converting unit 4403, and a remix rendering unit 4404. The decoding device decides whether domains of a mix signal and side information are matched to each other. If the domains of the mix signal and the side information are not matched to each other, the decoding device converts the domain of the side information using the side information decoding unit 4402 and the side information domain converting unit 4403. The decoding device converts the domain of the side information to the same domain of the domain of the mix signal using the side information domain converting unit 4403.

If the domains of the mix signal and the side information are matched to each other, the decoding device processes the side information using the side information decoding unit 4406. The side information decoding unit 4406 decodes the side information and then sends the decoded side information to the remix rendering unit 4404. And, the remix rendering unit 4404 generates a remix signal using the side information, the mix signal, and a user-mix parameter.

Figure 45:
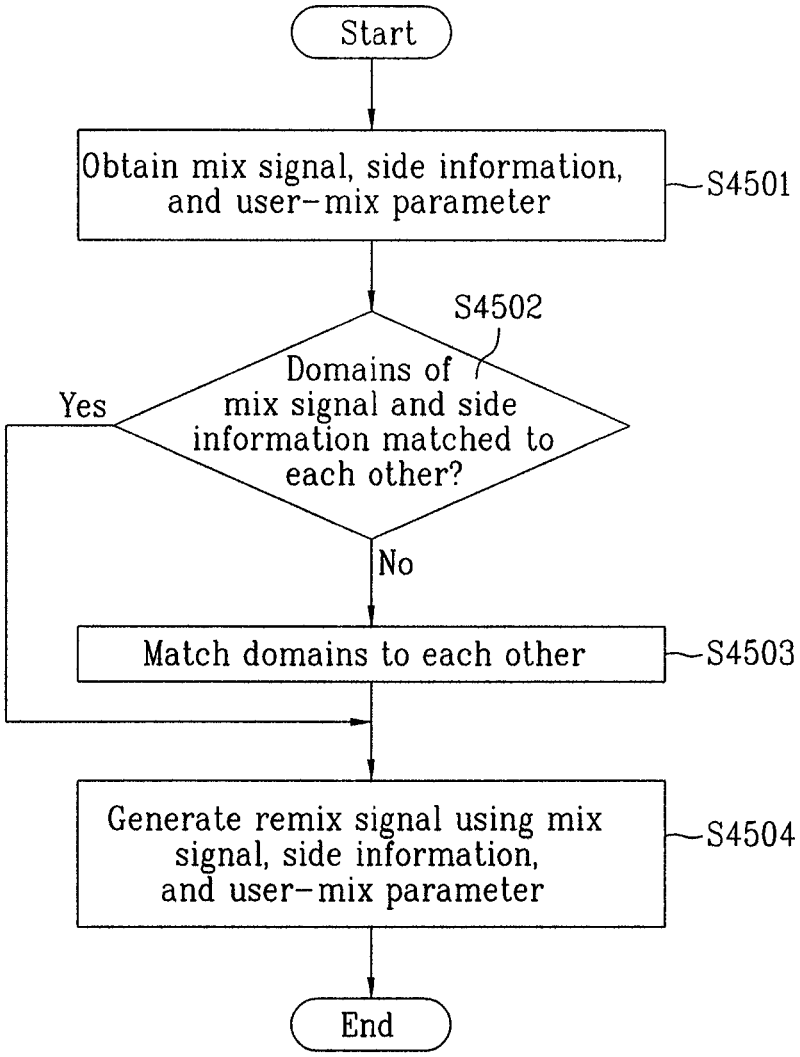
FIG. 45 is a flowchart of a signal processing method according to one embodiment of the present invention.

FIG. 45 is a flowchart of a signal processing method according to one embodiment of the present invention.

Referring to FIG. 45, a signal processing apparatus obtains a mix signal, side information, and a user-mix parameter (S4500). The signal processing apparatus decides whether the mix signal and the side information are signals in the same domain (S4501). If the domains of the mix signal and the side information are matched to each other, a decoding device respectively decodes the mix signal and the side information and then generates a remix signal using the decoded mix signal, the decoded side information, and a user-mix parameter (S4503).

If the domains of the mix signal and the side information are not matched to each other, the decoding device matches the domains of the mix signal and the side information to each other (S4502). The decoding device is able to match the domains to each other by converting the domains of the mix signal and the side information to be matched to each other or converting the domain of the mix signal to the domain of the mix signal. As the domain conversion is completed, if the domains of the mix signal and the side information are matched to each other, the decoding device generates a remix signal using the mix signal, the side information, and a user-mix parameter (S4503).

Figure 46:
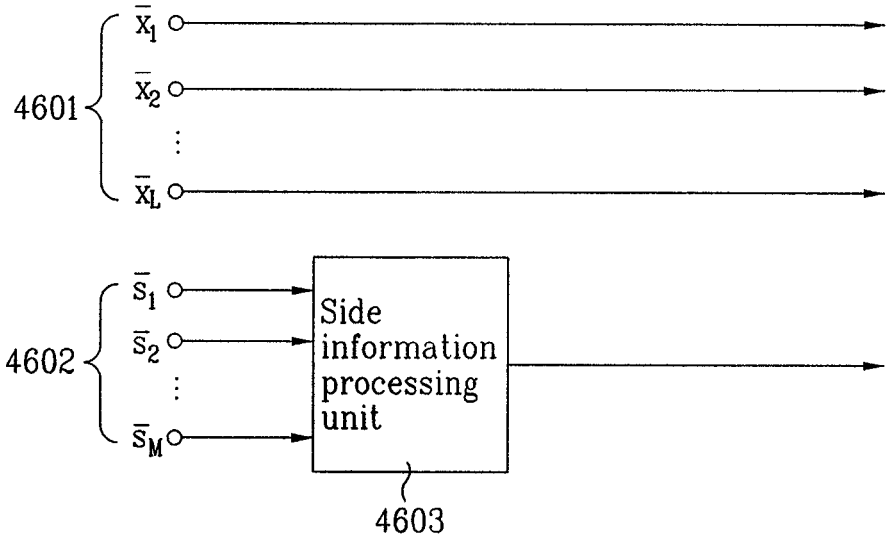
FIG. 46 is a block diagram of a twenty-fifth signal processing apparatus according to one embodiment of the present invention.

FIG. 46 is a block diagram of a twenty-fifth signal processing apparatus according to one embodiment of the present invention.

Referring to FIG. 46, a twenty-fifth signal processing apparatus according to one embodiment of the present invention includes a side information processing unit 4603. The twenty-fifth signal processing apparatus may directly send a mix signal 4601 to a decoding device. Alternatively, in case that there exist a plurality of mix signals 4601, the twenty-fifth signal processing apparatus downmixes the mix signals 4601 into one or two downmix signals and then transmits the two downmix signals. For mix signal transmission efficiency, the mix signal 4601 can be transmitted by being encoded, which is not shown in the drawing.

The side information processing unit 4603 generates side information using the mix signal 4601 and a source signal 4602. The source signal 4602 is included in the mix signal 4601 or may be a separate source signal not included in the mix signal 4601.

The side information processing unit 4603 is able to modify the generated side information. In particular, the side information processing unit 4603 is able to a size of the side information by normalizing the side information or setting a portion of the side information to a default value. And, the side information processing unit 4603 encodes the modified side information and then sends the encoded signal to the decoding device.

Figure 47:
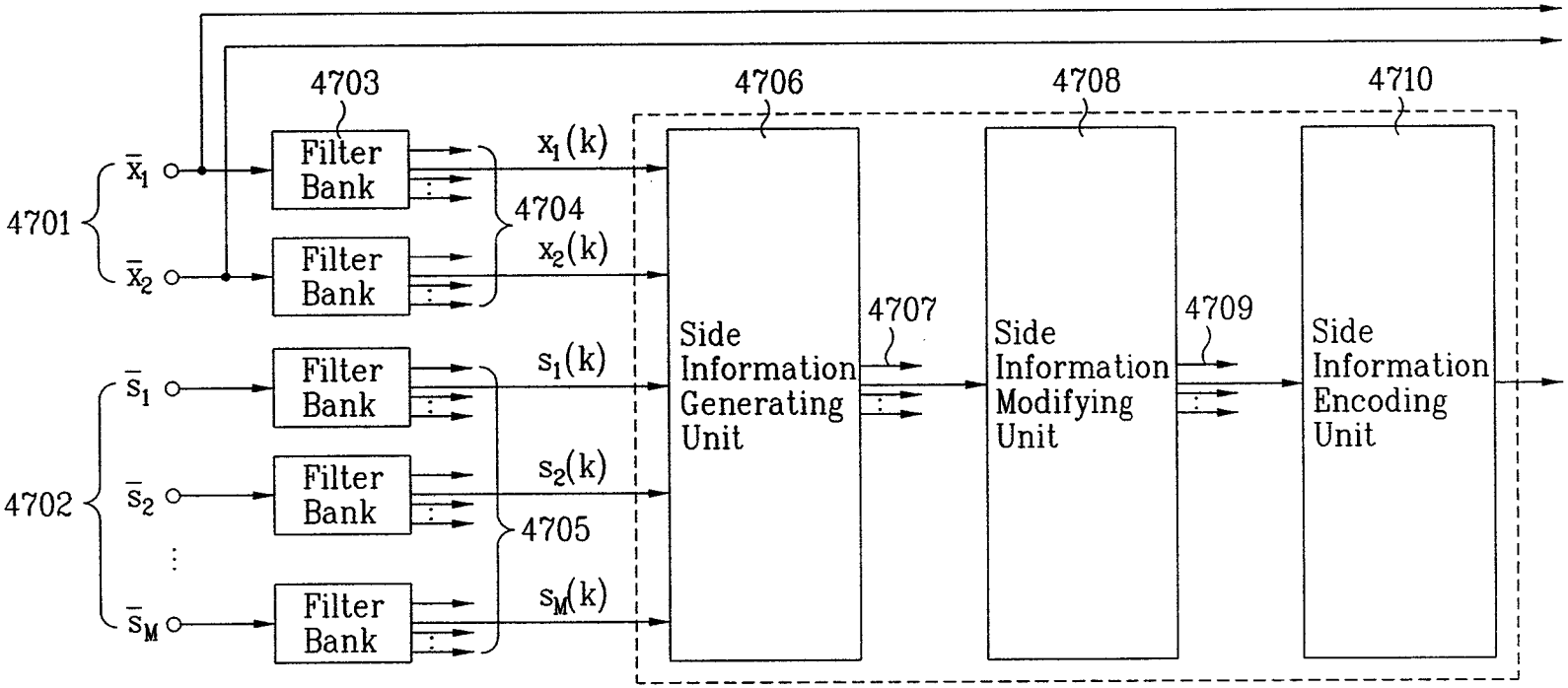
FIG. 47 is a detailed block diagram of the twenty-fifth signal processing apparatus shown in FIG. 46.

FIG. 47 is a detailed block diagram of the twenty-fifth signal processing apparatus shown in FIG. 46.

Referring to FIG. 47, the signal processing apparatus includes a filter bank 4703 and a side information processing unit 4603. The side information processing unit 4603 includes a side information generating unit 4706, a side information modifying unit 4708, and a side information encoding unit 4710. In the present invention, a mix signal includes a mono, stereo or multi-channel signal. For clarity and convenience, the mix signal includes a stereo mix signal 4701 in FIG. 47. The mix signal ($\overline{x_1}(n)$ and $\overline{x_2}(n)$) 4701, as shown in Formula 1, can be represented as a sum of a source signal 4702 included in the mix signal 4701.

$$\tilde{x}_1(n) = \sum_{i=1}^{I} a_i \tilde{s}_i(n)$$

$$\tilde{x}_2(n) = \sum_{i=1}^{I} b_i \tilde{s}_i(n),$$

In this formula, 'I' indicates the number of source signals included within a mix signal and '$\overline{s_i}(n)$' indicates the source signals. And, '$a_i$' and '$b_i$' are an amplitude panning for each of the source signals and a gain factor for determining a gain, respectively. The source signals 4702 having different gain factors are mixed in the mix signal 4701. The filter bank 4702 decomposes the mix signal 4701 and the source signal 4702 into per-subband signals 4704 and 4705 in time-frequency domain. The side information generating unit 4706 generates per-subband side information such as gain factors $a_i$ and $b_i$, a short-time subband power ($E\{s_i^2(k)\}$) 4707, and the like using the per-subband mix signal 4704 and the per-subband source signal 4705.

The side information modifying unit 4708 modifies the per-subband side information 4707. In particular, the side information modifying unit 4708 modifies the per-subband side information 4707 into new side information 4709 such as a new gain factor, a new short-time subband power and the like. The side information modifying unit 4708 modifies the side information in a manner that the mix signal represented using the new side information 4709 is set to have the same value of the original mix signal 4701. In particular, the mix signal 4701 represented as a product of a gain factor and a source signal can be represented as ',' using a new gain factor having the same value and a new source signal.

In this case, if one of the new gain factors $a_i'$ and $b_i'$ is set to a default value, an encoding device needs not to sent the gain factor set to the default value. The encoding device is able to modify the side information into a value more suitable for quantization and coding. The side information encoding unit 4710 encodes the modified side information 4709 and then transmits the encoded information to a decoding device. Alternatively, the side information encoding unit 4710 transforms the modified side information 4709 into a value suitable for quantization and coding, encodes the transformed information, and then transmits the encoded information to the decoding device.

Figure 48:
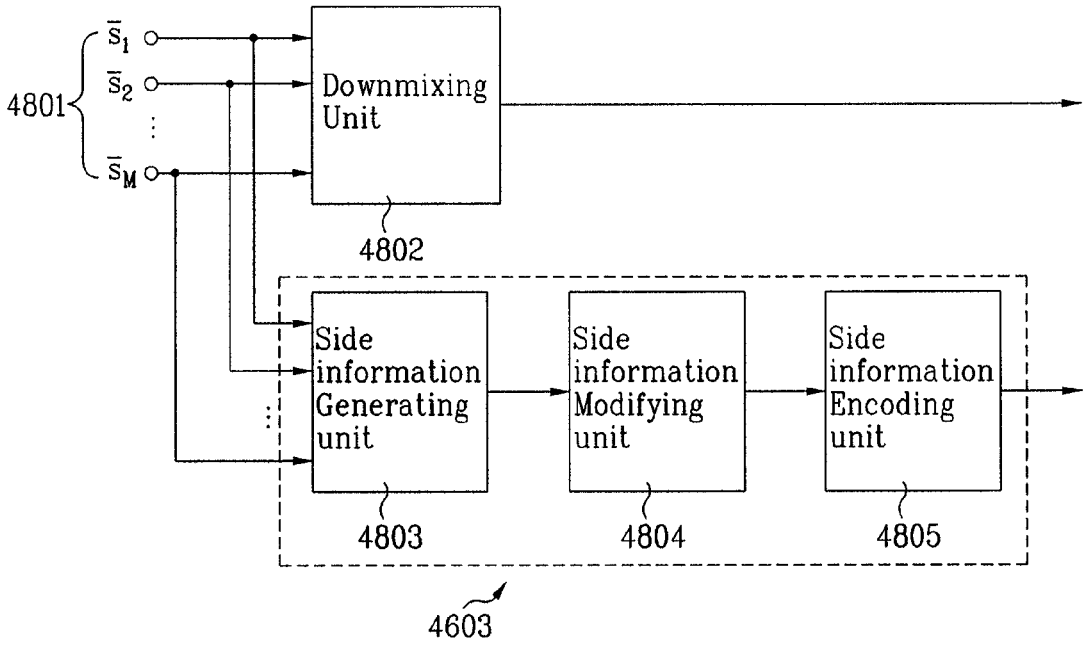
FIG. 48 is a block diagram of a twenty-sixth signal processing apparatus according to one embodiment of the present invention.

FIG. 48 is a block diagram of a twenty-sixth signal processing apparatus according to one embodiment of the present invention.

Referring to FIG. 48, a twenty-sixth signal processing apparatus according to one embodiment of the present invention includes a downmixing unit 4802 and a side information processing unit 4603. The side information processing unit 4603 includes a side information generating unit 4803, a side information modifying unit 4804, and a side information encoding unit 4805. The twenty-fifth signal processing apparatus shown in FIG. 47 differs from the twenty-sixth signal processing apparatus shown in FIG. 48 in the information used to generate side information. The twenty-fifth signal processing apparatus shown in FIG. 47 generates side information using a source signal and a mix signal. On the contrary, the twenty-sixth signal processing apparatus shown in FIG. 48 generates side information using a source signal only.

The downmixing unit 4802 downmixes a source signal 4801 and then sends the downmixed signal to a decoding device. The side information processing unit 4603 generates side information, encodes the generated side information and then transmits the encoded information to a decoding device. The side information generating unit 4803 is able to generate the side information using a portion or whole part of the source signal 4801. The side information modifying unit 4804 modifies the side information generated by the side information generating unit 4803 into new side information for transmission efficiency and the like. The side information modifying unit 4804 is able to transform the modified side information into a value suitable for quantization, encoding, and the like. The side information encoding unit 4805 encodes the modified side information and then transmits the encoded information to the decoding device. Alternatively, the side information encoding unit 4805 transforms the modified side information for quantization and the like, encodes the transformed side information, and then transmits the encoded information to the decoding device.

Figure 49:
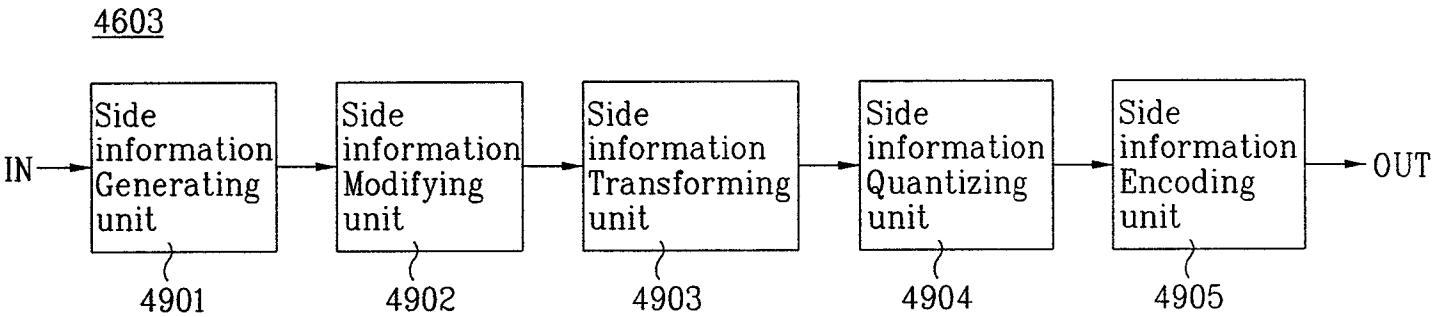
FIG. 49 is a block diagram of a side information processing unit according to one embodiment of the present invention.

FIG. 49 is a block diagram of a side information processing unit according to one embodiment of the present invention.

Referring to FIG. 49, a side information processing unit 4603 includes a side information generating unit 4901, a side information modifying unit 4902, a side information transforming unit 4903, a side information quantizing unit 4904, and a side information encoding unit 4905. The side information processing unit 4603 generates side information, processes the side information, and then transmits the processed information to a decoding device. The side information generating unit 4901 included in the side information processing unit 4603 generates the side information using at least one of a mix signal and a source signal. The side information includes gain factors $a_i$ and $b_i$ and a short-time subband power $E\{s_i^2(k)\}$.

The side information modifying unit 4902 generates new gain factors $a_i'$ and $b_i'$, a new short-time subband power $E\{s_i'^2(k)\}$, and the like by modifying the side information. The side information modifying unit 4902 modifies the side information. Level information included in the side information can be modified into the following. First of all, $s_i(n)^2$ or $E[s_i(n)^2]$ is transmitted to transmit a level of each source signal. In this case, $s_i(n)^2$ indicates an $i^{th}$ source signal. A domain of the source signal may be a time domain or a subband domain. If so, it may be difficult to perform quantization die to a considerable fluctuation of the level value. To settle this difficulty, a relative value to a specific source signal such as $E[s_i(n)^2]/E[s_1(n)^2]$ is transmitted or a relative value to a level of mix signal such as $E[s_i(n)^2]/E[x(n)^2]$ can be transmitted. In this case, x(n) indicates a mix signal.

To cancel out influence of interference between signals which may take place in constructing a mix signal, a value represented as Formula 25 can be transmitted.

$$\frac{E[S_i(n)^2]}{\sum_{j=1}^{N} E[S_j(n)^2]}, \quad \text{[Formula 25]}$$

In Formula 25, 'N' indicates the number of source signals constructing a mix signal. If a mix signal is constructed in a manner of giving a specific weight (e.g., gain factor) to each source instead of being constructed with a simple sum of $s_i(n)$, the construction can be achieved by applying the weight to a source signal level sum configuring a denominator of Formula 25.

For instance, new gain factors are generated by normalizing two gain factors using one of the two gain factors. In this case, one of the gain factors is modified into a specific constant (i.e., 1). The side information modifying unit 4902 is able to modify a source signal as son as modifies gain factors. For instance, the side information modifying unit 4902 modifies $a_i$ and $b_i$ into $$a_i' = \frac{a_i}{b_i} \text{ and } b_i' = \frac{b_i}{b_i},$$

respectively by normalizing gain factors of a mix signal using a gain factor $b_i$ and modifies $s_i$ into $s_i'=b_i s_i$, which results in Formula 26.

$$x_1 = \sum \frac{a_i}{b_i} b_i s_i = \sum a_i' s_i' \quad \text{[Formula 26]}$$

$$x_2 = \sum \frac{b_i}{b_i} b_i s_i = \sum b_i' s_i'$$

The above value is the same value of an original mix value. So, even if an encoding device modifies the side information such as gain factors $a_i$ and $b_i$ and a short-time subband power $E\{s_i^2(k)\}$ into new side information such as new gain factors $a_i'$ and $b_i'$, a new short-time subband power $E\{s_i'^2(k)\}$, and the like, there is no difference for a decoding device to generate a remix signal. As $b_i'$ of the new gain factor is set to a default value, it is unnecessary for the encoding device to transmit $b_i'$ separately. Hence, a size of side information is reduced.

The side information transforming unit 4903 transforms the side information modified by the side information modifying unit 4902 into a form convenient for transmission. The encoding device may transmit side information $a_i$, $b_i$ and $E\{s_i^2(k)\}$ to the decoding device by encoding them intact. Alternatively, the encoding device is able to transmit the side information by transforming the side information into a value more suitable for quantization and encoding. The side information transforming unit 4903 is able to transform side information $a_i'$, $b_i'$, $E\{s_i'^2(k)\}$ into $g_i'$, $l_i'$, $A_i(k)'$ using Formula 3 and Formula 4.

In this case, since $b_i'$ is defaulted as a specific constant value, the encoding device just transmits one of $g_i'$ and $l_i'$ and $A_i(k)'$ only. The side information quantizing unit 4904 quantizes one of $g_i'$ and $l_i'$ and $A_i(k)'$. And, the side information encoding unit 4905 encodes the quantized side information and then transmits the encoded information to the decoding device.

The side information can include various information as well as gain factor, short-time subband power, time delay information, cross-correlation information, and mix information. For instance, if side information is not generated together with a mix signal, mismatch of time sync or the like may cause a problem in reproduction. So, timing information can be included in the side information. The timing information may be included in a mix signal only. Alternatively, the timing information can be included in both side information and a mix signal. Hence, it is able to solve a sync problem using the timing information in case of reproducing side information together with a mix signal. In this case, the timing information may be the information on a real time or information on a relative time. And, the timing information includes the information enabling a decision in accordance with a characteristic of a mix signal.

Mix signals generated from mixing with the same source may have difference in-between in accordance with a mix scheme or a coding scheme. For instance, a difference in time sync or the like may be generated between a music recorded in CD and a music transformed into MP3 file. In this case, accuracy in playback may be affected by side information multiplexed with MP3 file is used for CD. So, it is possible to modify the side information into a form suitable for a signal to be newly used in a manner of comparing the multiplexed signal and the side information to the signal to be newly used.

Figure 50:
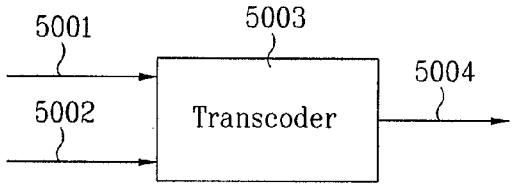
FIG. 50 is a block diagram of a transcoder transforming side information to be suitable for a mix signal to be newly applied thereto according to one embodiment of the present invention.

FIG. 50 is a block diagram of a transcoder transforming side information to be suitable for a mix signal to be newly applied thereto according to one embodiment of the present invention.

Referring to FIG. 50, an input-1 5001 is a multiplexed signal and an input-2 5002 is a mix signal to which side information will be newly applied. In some cases, the input-1 5001 can be inputted together with both a mix signal and side information. A transcoder 5003 compares a mix signal included in the input-1 5001 to a mix signal of the input-2 5002 and plays a role in modifying side information based on the comparison. An output 5004 may become the modified side information or can be an output generated from multiplexing a signal of the input-2 and side information together.

When an encoding device generates side information, it is possible to adjust a size of side information in accordance with an application. For instance, an application capable of muting a specific object needs more information than an application capable of panning a specific object only. Hence, an encoding device for generating side information can provide a decoding device with guide information on a maximum control for securing a quality of sound. In this case, the guide information is identically applied to all source signals or can be independently applied to each source signal.

The side information can contain an identifier for designating a specific channel of a mono- or multi-channel. Let's assume a case that a mix signal and side information are generated in case that multi-source is inputted. The multi-source may be a mono source, a stereo source having two channels, or a multi-channel having channels exceeding two channels. In case that a source has a multi-channel, it is possible to process the source on the assumption that each channel is an independent source.

For instance, in case of a source having a stereo channel, it is able to assume that a $k^{th}$ input source is mono. And, it is also able to assume that a $(K+1)^{th}$ input source is stereo. If the $k^{th}$ input source is an $n^{th}$ process source, a first channel of the $(k+1)^{th}$ input stereo source is recognized as the $n^{th}$ process source and a second channel of the $(k+1)^{th}$ input stereo source is recognized as an $(n+2)^{th}$ process source. Hence, it is able to perform coding in manner of recognizing a single input source as a single process source for each channel, i.e., two process sources.

So, in case that there exist total N process sources, a type of each of the process sources needs to be included in a bit sequence. For instance, it is necessary to transmit information indicating that an $n^{th}$ process source is a mono signal, that an $(n+1)^{th}$ process source corresponds to a first channel of a stereo source, and that an (n+2)th process source is a second channel of the stereo source constructed tithe the $(n+1)^{th}$ process source. In this case, assuming that process sources of the stereo source are always transmitted by being adjacent to each other, it can be observed that process source types are limited to three types including a mono, a first channel, and a second channel.

Figure 51:
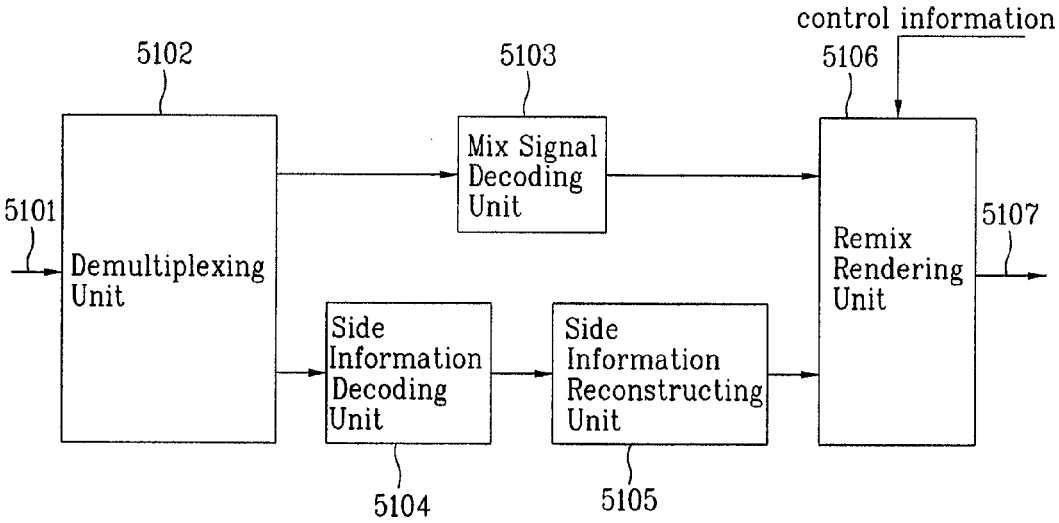
FIG. 51 is a block diagram of a twenty-seventh signal processing apparatus according to one embodiment of the present invention.

FIG. 51 is a block diagram of a twenty-seventh signal processing apparatus according to one embodiment of the present invention.

Referring to FIG. 51, a twenty-seventh signal processing apparatus according to one embodiment of the present invention includes a demultiplexing unit 5102, a mix signal decoding unit 5105, a side information decoding unit 5104, a side information reconstructing unit 5105, and a remix rendering unit 5106.

If a multiplexed mix signal and first side information 5101 is inputted to the demultiplexing unit 5102, the demultiplexing unit 5102 demultiplexes the inputted signal into an encoded mix signal and an encoded first side information. The demultiplexing unit 5102 then sends the encoded mix signal and the encoded first side information to the mix signal decoding unit 5103 and the side information decoding unit 5104, respectively. In this case, the first side information indicates the information generated from modifying second side information used in remixing the mix signal.

The mix signal decoding unit 5103 decodes the encoded mix signal into a mix signal, and the side information decoding unit 5104 decodes the encoded first side information into a first side information. Subsequently, the side information reconstructing unit 5105 reconstructs the generated first side information into an original second side information. The side information reconstructing unit 5105 is optionally included. In particular, the twenty-seventh signal processing apparatus according to the present invention can be configured to generate a remix signal using either the first side information or the second side information. The first or second side information and the decoded mix signal are sent to the remix rendering unit 5106. The remix rendering unit 5106 is able to generate a remix signal 5107 using the first or second side information, the mix signal, and a user-mix parameter. In this case, the user-mix parameter can be generated using control information obtained from a user.

Figure 52:
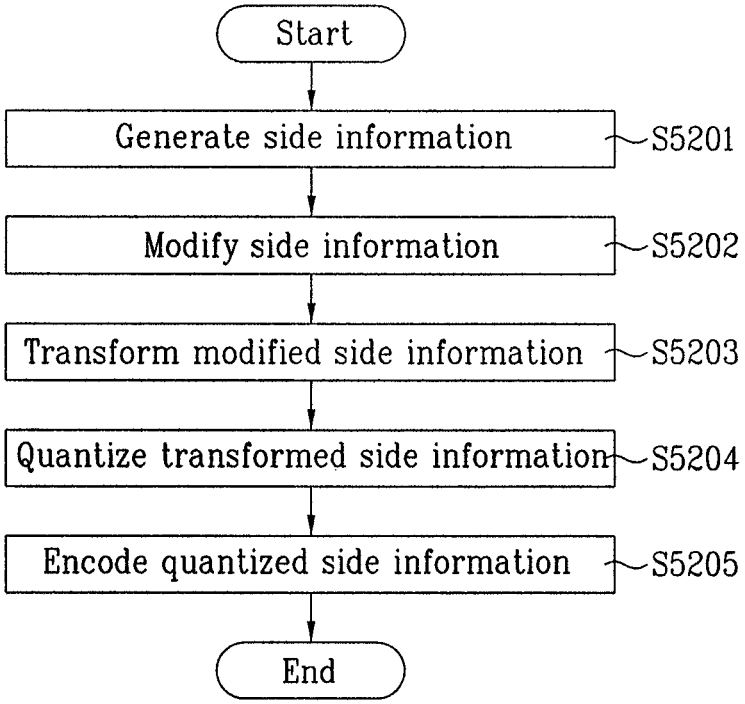
FIG. 52 is a flowchart of a signal processing method according to one embodiment of the present invention.

FIG. 52 is a flowchart of a signal processing method according to one embodiment of the present invention.

Referring to FIG. 52, the side information generating unit 4901 generates side information using a mix signal or a source signal (S5201). The side information modifying unit 4902 modifies the generated side information (S5202). The side information transforming unit 4903 transforms the modified side information into another form (S5203). The side information quantizing unit 4904 quantizes the transformed side information (S5204). And, the side information encoding unit 4905 encodes the quantized side information and then sends the quantized information to a decoding device (S5205).

For instance, a side information modifying method according to one embodiment of the present invention is explained as follows. First of all, the side information generating unit 4901 generates side information $a_i$, $b_i$ and $E\{s_i^2(k)\}$ using a mix signal or a source signal. The side information modifying unit 4902 modifies the generated side information. In particular, the side information modifying unit 4902 generates $a_i'$ and $b_i'$ by normalizing gain factors using one of the gain factors, e.g., $b_i$.

In this case, if the gain factor $b_i$ is normalized, a new gain factor $b_i'$ becomes 1. The side information modifying unit 4902 modifies a source signal $s_i$ into $s_i'$ using the gain factor used for the normalization. The side information modifying unit 4902 modifies per-subband power $E\{s_i^2(k)\}$ into $E\{s_i'^2(k)\}$ using the modified source signal $s_i'$. The modified side information $a_i'$ and $E\{s_i'^2(k)\}$ is transformed into $g_i'$ or $l_i'$ and $A_i(k)'$ more suitable for quantization and encoding. In this case, since $b_i'$ becomes 1 by the normalization, it is necessary to transform the gain factor $a_i'$ only. Hence, either $g_i'$ or $l_i'$ is used. The transformed side information $g_i'$ or $l_i'$ and $A_i(k)'$ is quantized, encoded and then sent to the decoding device.

Figure 53:
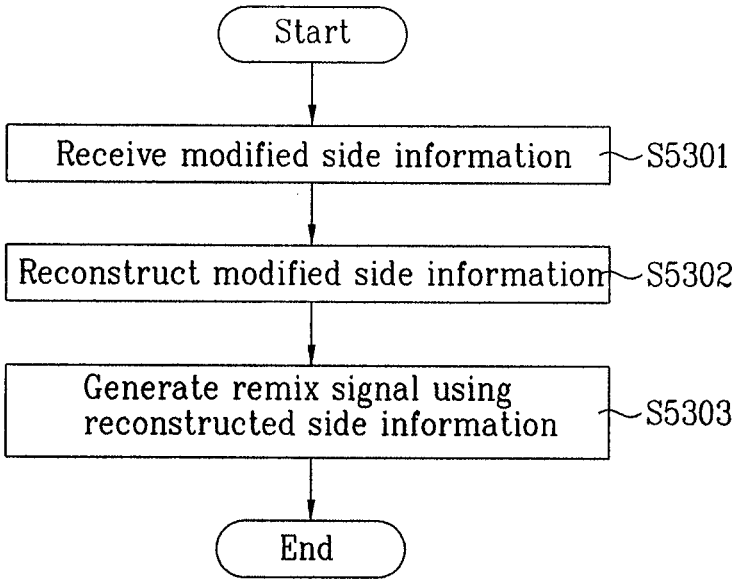
FIG. 53 is a flowchart of a signal processing method according to one embodiment of the present invention.

FIG. 53 is a flowchart of a signal processing method according to one embodiment of the present invention.

Referring to FIG. 53, a signal processing apparatus according to the present invention receives modified side information (S5301). In this case, the modified side information includes modified a gain factor and a modified subband power. As mentioned in the foregoing description, a value of one of modified gain factors is defaulted as a specific value. So, a decoding device just receives a non-defaulted gain factor and a subband power in the modified side information.

If an encoding device modifies side information, a source signal is correspondingly modified. So, it can be understood that a new source signal is generated. Hence, the encoding device substantially transmits a newly generated source signal and side information on the newly generated source signal. In case that the encoding device modifies side information, gain factors and a source signal are modified. So, a mix signal constructed with a product of the gain factor and the source signal is identical to an original signal. The decoding device receives the modified side information and then decodes the received information. The decoding device then generates original side information using the modified side information. In this case, control information provided by a user may be inputted to the decoding device.

Subsequently, the modified side information is reconstructed into the original side information (S5302). In some cases, the modified side information is directly usable without being reconstructed into the original side information. The decoding device is able to generate a remix signal using the mix signal, the control information, and the original side information (S5303). The decoding device according to the present invention is capable of generating a remix signal using modifies side information instead of original side information. So, the remix signal generated by the decoding device has nothing to do with a presence or non-presence of side information modification carried out by the encoding device.

INDUSTRIAL APPLICABILITY

While the present invention has been described and illustrated herein with reference to the preferred embodiments thereof, it will be apparent to those skilled in the art that various modifications and variations can be made therein without departing from the spirit and scope of the invention. Thus, it is intended that the present invention covers the modifications and variations of this invention that come within the scope of the appended claims and their equivalents.

What is claimed is:

1. A signal processing method, the signal comprising a mix signal and unified side information, the unified side information generated using at least one of the mix signal and unified source signals, the unified source signals generated by grouping at least two source signals, the method comprising:

receiving the mix signal and the unified side information;

extracting first identification information from the mix signal and second identification information from the unified side information;

generating a control signal indicating playable when the first identification information and the second identification information are matched to each other;

generating a remix signal by remixing the mix signal and the unified side information when the control signal is generated; and outputting the remix signal through one or more loudspeakers.

2. The signal processing method of claim 1, wherein the mix signal is a stereo channel signal, and each channel of the stereo channel signal includes a plurality of source signals.

3. The signal processing method of claim 2, when the mix signal is a stereo channel signal including a plurality of source signals ($S_{1_L}$, $S_{1_R}$, $S_{2_L}$, $S_{2_R}$, . . . , $S_{M_L}$, $S_{M_R}$), one unified source signal is generated by Formula $$\overline{S_1}=\tfrac{1}{2}*(S_{1_L}+S_{2_R}),$$

wherein $\overline{S_1}$; indicates a unified source signal generated from grouping $S_{1_L}$ and $S_{1_R}$.

4. The signal processing method of claim 3, if a source signal is Si, side information corresponding to the source signal (Si) includes at least one of gain factor ($a_i$, $b_i$) and subband power ($E\{s_i^2(k)\}$), wherein the unified side information corresponding to the unified source signal $\overline{S_1}$, $\overline{S_2}$, . . . , $\overline{S_M}$) is generated by Formula $$\overline{a_1},\overline{b_1},\in\{\overline{S_1}^2(k)\}$$

$$\overline{a_2},\overline{b_2},\in\{\overline{S_2}^2(k)\}$$

. . .

$$\overline{a_M},\overline{b_M},\in\{\overline{S_M}^2(k)\}$$

wherein the gain factors ($\overline{a_1}$, $\overline{b_1}$), is generated from the source signals ($S_{1_L}$, $S_{1_R}$) and the unified source signal ($S_1$) by Formula $$S_{1\,L}=\overline{a_1}*\overline{S_1}$$

$$S_{1_R}=\overline{b_1}*\overline{S_1}.$$

5. A signal processing apparatus, the signal comprising a mix signal and unified side information, the unified side information generated using at least one of the mix signal and unified source signals, the unified source signals generated by grouping at least two source signals, the apparatus comprising:

a core decoding unit decoding the mix signal and extracting first identification information from the mix signal;

a side information decoding unit decoding the unified side information and extracting second identification information from the unified side information;

an identification information reading unit deciding whether the first identification information and the second identification information are matched to each other, wherein the identification information reading unit generates a control signal indicating playable when the first identification information and the second identification information are matched to each other; and a remix rendering unit generating a remix signal by remixing the mix signal and the unified side information when the control signal is generated, and outputting the remix signal through one or more loudspeakers.

6. The signal processing apparatus of claim 5, wherein the mix signal is a stereo channel signal, and each channel of the stereo channel signal includes a plurality of source signals.

7. the signal processing apparatus of claim 6, when the mix signal is a stereo channel signal including a plurality of source signals ($S_{1_L}$, $S_{1_R}$, $S_{2_L}$, $S_{2_R}$, . . . , $S_{M_L}$, $S_{M_R}$), one unified source signal is generated by Formula $$\overline{S_1}=\tfrac{1}{2}*(S_{1_L}+S_{1_R}),$$

wherein $S_1$ indicates a unified source signal generated from grouping $S_{1_L}$ and $S_{1_R}$.

8. The signal processing apparatus of claim 7, if a source signal is Si, side information corresponding to the source signal (Si) includes at least one of gain factor ($a_i$, $b_i$) and subband power ($E\{s_i^2(k)\}$), wherein the unified side information corresponding to the unified source signal ($\overline{S_1}$, $\overline{S_2}$, . . . , $\overline{S_M}$) is generated by Formula $$\overline{a_1},\overline{b_1},\in\{\overline{S_1}^2(k)\}$$

$$\overline{a_2},\overline{b_2},\in\{\overline{S_2}^2(k)\}$$

. . .

$$\overline{a_M},\overline{b_M},\in\{\overline{S_M}^2(k)\}$$

wherein the gain factors ($\overline{a_1}$, $\overline{b_1}$) is generated from the source signals ($S_{1_L}$, $S_{1_R}$) and the unified source signal ($S_1$) by Formula $$S_{1\,L}=\overline{a_1}*\overline{S_1}$$

$$S_{1_R}=\overline{b_1}*\overline{S_1}.$$

* * * * *